US012303077B2

(12) United States Patent
Starkey

(10) Patent No.: US 12,303,077 B2
(45) **Date of Patent: *May 20, 2025**

(54) ROLL TOWEL DISPENSER

(71) Applicant: Bradley Fixtures Corporation, Menomonee Falls, WI (US)

(72) Inventor: Michael M. Starkey, Kent, OH (US)

(73) Assignee: Bradley Fixtures, LLC, Menomonee Falls, WI (US)

( * ) Notice: Subject to any disclaimer, the term of this patent is extended or adjusted under 35 U.S.C. 154(b) by 460 days.

This patent is subject to a terminal disclaimer.

(21) Appl. No.: 17/498,185

(22) Filed: Oct. 11, 2021

(65) Prior Publication Data

US 2022/0022705 A1 Jan. 27, 2022

Related U.S. Application Data

(63) Continuation of application No. 16/413,170, filed on May 15, 2019, now Pat. No. 11,141,027.

(60) Provisional application No. 62/751,202, filed on Oct. 26, 2018, provisional application No. 62/672,238, filed on May 16, 2018.

(51) Int. Cl.

| | |
|---|---|
| ***A47K 10/36*** | (2006.01) |
| ***A47K 10/38*** | (2006.01) |
| *A47K 10/32* | (2006.01) |

(52) U.S. Cl.

CPC ..... *A47K 10/3687* (2013.01); *A47K 10/3625* (2013.01); *A47K 10/38* (2013.01); *A47K 2010/3253* (2013.01); *A47K 2010/326* (2013.01); *A47K 2010/3668* (2013.01)

(58) Field of Classification Search

CPC ..... A47K 10/3625; A47K 10/3687; A47K 10/38; A47K 2010/3668; A47K 2010/326; A47K 2010/3252

USPC ..... 83/649

See application file for complete search history.

(56) References Cited

U.S. PATENT DOCUMENTS

| | | | |
|---|---|---|---|
| 2,144,070 | A | 1/1939 | Leinbach |
| 3,145,940 | A | 8/1964 | Henry |
| 3,322,359 | A | 5/1967 | Dales |
| 3,459,353 | A | 8/1969 | Taylor |
| 3,730,409 | A | 5/1973 | Ratti |

(Continued)

FOREIGN PATENT DOCUMENTS

| | | | |
|---|---|---|---|
| CN | 111802949 | A | 10/2020 |
| EP | 3 721 771 | A1 | 10/2020 |

(Continued)

OTHER PUBLICATIONS

International Search Report and Written Opinion regarding corresponding PCT Application No. PCT/US2018/033319, mail date Oct. 25, 2018, 13 pps.

(Continued)

*Primary Examiner* — Nhat Chieu Q Do

(74) *Attorney, Agent, or Firm* — Boyle Fredrickson, S.C.

(57) ABSTRACT

A roll towel dispenser includes a frame configured to support a roll of paper towel. The roll towel dispenser also includes a main roller coupled to the frame whereby the main roller has an axis of rotation. The roll towel dispenser further includes a transfer member coupled to the main roller and extending away from the main roller. The transfer member is configured to move relative to the main roller during operation of the roll towel dispenser.

17 Claims, 23 Drawing Sheets

(56) References Cited

U.S. PATENT DOCUMENTS 4,106,684 A 8/1978 Hartbauer et al.
4,298,122 A 11/1981 Ekelund
4,688,751 A 8/1987 Valot
4,721,265 A 1/1988 Hawkins
4,807,824 A 2/1989 Gains et al.
D303,610 S 9/1989 Mastandrea
D303,886 S 10/1989 Reid
D308,244 S 5/1990 Leonakis
D312,369 S 11/1990 De Luca et al.
D325,486 S 4/1992 Goldstein
D343,973 S 2/1994 Mele
5,294,192 A 3/1994 Omdoll et al.
5,375,785 A 12/1994 Boone et al.
D359,959 S 7/1995 Scianna et al.
5,452,832 A 9/1995 Niada
D368,487 S 4/1996 Lindberg
D373,998 S 9/1996 Tutt et al.
5,558,302 A 9/1996 Jesperson
5,588,627 A 12/1996 Sharpe
5,623,880 A 4/1997 Kuntz
5,651,384 A 7/1997 Rudrich
5,669,576 A 9/1997 Moody
5,924,617 A 7/1999 Lacount et al.
5,979,822 A 11/1999 Morand et al.
6,056,234 A 5/2000 Kim
6,069,354 A 5/2000 Alfano et al.
D430,999 S 9/2000 Lodi
6,145,783 A 11/2000 Kim
6,224,010 B1 5/2001 Morand
D444,050 S 6/2001 Wyers
D447,656 S 9/2001 Richter
D450,689 S 11/2001 Langford et al.
6,314,850 B1 11/2001 Morand
6,321,963 B1 11/2001 Gracyalny et al.
6,411,920 B1 6/2002 McConnell et al.
6,419,136 B2 7/2002 Formon et al.
6,460,798 B1 10/2002 Haen et al.
6,499,684 B2 12/2002 Eaton et al.
D475,610 S 6/2003 Rehkemper et al.
6,592,067 B2 7/2003 Denen et al.
6,695,246 B1 2/2004 Elliott et al.
6,736,348 B1 5/2004 Formon et al.
6,820,785 B2 11/2004 Kapiloff
6,826,985 B2 12/2004 Broehl
6,854,684 B2 2/2005 Byrd et al.
6,892,620 B2 5/2005 Kapiloff
D509,690 S 9/2005 Wolpert et al.
6,977,588 B2 12/2005 Schotz et al.
D515,566 S 2/2006 Hwang
D515,899 S 2/2006 Chan
7,017,856 B2 3/2006 Moody et al.
D518,350 S 4/2006 Hay
D526,546 S 8/2006 Jirele et al.
7,084,592 B2 8/2006 Rodrian
7,182,288 B2 2/2007 Denen et al.
7,182,289 B2 2/2007 Moody et al.
D538,274 S 3/2007 Gray
7,213,782 B2 5/2007 Osborne et al.
7,237,744 B2 7/2007 Morris et al.
D549,710 S 8/2007 Hynecek et al.
D553,402 S 10/2007 Orgna et al.
7,296,765 B2 11/2007 Rodrian
7,325,768 B2 2/2008 Byrd et al.
7,327,744 B2 2/2008 Agrawal et al.
7,354,015 B2 4/2008 Byrd et al.
D568,655 S 5/2008 Friesen et al.
D570,856 S 6/2008 Forester
7,387,274 B2 6/2008 Moody et al.
7,398,944 B2 7/2008 Lewis et al.
D574,816 S 8/2008 Tang
7,416,152 B2 8/2008 Wieser et al.
D582,242 S 12/2008 Bryan
D588,074 S 3/2009 Hollner
7,523,885 B2 4/2009 Lewis
7,594,622 B2 9/2009 Witt et al.
D610,486 S 2/2010 Yoshie et al.
7,698,980 B2 4/2010 Morris et al.
7,783,380 B2 8/2010 York et al.
D623,452 S 9/2010 McNeely et al.
7,793,882 B2 9/2010 Reinsel et al.
7,878,446 B2 2/2011 Reinsel et al.
7,896,196 B2 3/2011 Wegelin et al.
7,905,444 B2 3/2011 Chen
7,931,228 B2 4/2011 Omdoll
D638,805 S 5/2011 Clymer et al.
7,984,872 B2 7/2011 Kuehneman et al.
7,987,756 B2 8/2011 Lewis et al.
7,996,108 B2 8/2011 Yardley
D644,468 S 9/2011 Hansen
D654,741 S 2/2012 Hansen
8,113,483 B2 2/2012 Bayley et al.
D656,348 S 3/2012 Velazquez et al.
D657,984 S 4/2012 Hansen
8,162,252 B2 4/2012 Cittadino et al.
D658,481 S 5/2012 Pratt
8,186,551 B2 5/2012 Morris et al.
8,224,480 B2 7/2012 Mok et al.
D664,796 S 8/2012 Cattacin et al.
D666,038 S 8/2012 Wilkins et al.
D668,484 S 10/2012 Velazquez et al.
8,297,160 B2 10/2012 Friesen et al.
D674,223 S 1/2013 Green et al.
8,382,026 B2 2/2013 Keily et al.
D682,795 S 5/2013 McDonald et al.
D687,651 S 8/2013 Niada
8,528,851 B2 9/2013 Friesen et al.
D699,048 S 2/2014 Paal et al.
D699,470 S 2/2014 Pasquini
8,684,297 B2 4/2014 Moody et al.
8,777,149 B2 7/2014 Goeking et al.
8,789,787 B2 7/2014 Kling et al.
8,796,624 B2 8/2014 Mok et al.
8,807,475 B2 8/2014 Rodrian et al.
8,882,021 B2 11/2014 Cittadino et al.
8,919,688 B2 12/2014 Kuehneman et al.
8,960,588 B2 2/2015 Byrd et al.
9,027,871 B2 5/2015 Kuehneman et al.
9,066,639 B2 6/2015 Hagleitner
9,068,326 B2 6/2015 Chen et al.
9,144,352 B2 9/2015 Cittadino et al.
9,167,941 B2 10/2015 Cittadino et al.
9,248,988 B2 2/2016 Keily et al.
9,345,367 B2 5/2016 Keily et al.
9,370,283 B2 6/2016 Fellhoelter
D764,469 S 8/2016 Kaliauer et al.
D766,241 S 9/2016 Maletz et al.
9,446,924 B2 9/2016 Omdoll
D769,016 S 10/2016 Achton
D773,202 S 12/2016 Madsen et al.
9,524,604 B2 12/2016 Erb
D779,909 S 2/2017 Sheppard
D784,334 S 4/2017 Tehranchi
D787,295 S 5/2017 Young
9,635,986 B2 5/2017 Phelps
9,645,561 B2 5/2017 Borke et al.
D789,111 S 6/2017 Terrill et al.
D792,122 S 7/2017 Hagleitner
D792,357 S 7/2017 Tehranchi
9,701,508 B2 7/2017 Diamond
D795,607 S 8/2017 Gottschalk
9,770,143 B2 9/2017 Corley et al.
9,918,597 B2 3/2018 Rubenson et al.
D821,406 S 6/2018 Turksu et al.
9,999,326 B2 6/2018 Borke et al.
10,123,666 B2 11/2018 Ruthven et al.
10,159,389 B2 12/2018 Goeking et al.
D839,021 S 1/2019 Green
D840,710 S 2/2019 Hagleitner
10,213,068 B2 2/2019 Diamond
D843,129 S 3/2019 Hagleitner
10,238,245 B2 3/2019 Rubenson et al.
D848,421 S 5/2019 Turksu et al.
10,299,638 B2 5/2019 Henson et al.
10,441,117 B2 10/2019 Osborne, Jr.

(56) References Cited

U.S. PATENT DOCUMENTS

| | | | | |
|---|---|---|---|---|
| 10,485,388 | B1 | 11/2019 | Mcintosh | |
| 10,517,443 | B2 | 12/2019 | Diamond | |
| D874,461 | S | 2/2020 | Siminoff et al. | |
| 10,610,064 | B2 | 4/2020 | Osborne et al. | |
| 10,660,485 | B2 | 5/2020 | Johnson et al. | |
| 10,660,486 | B2 | 5/2020 | Osborne, Jr. | |
| D886,656 | S | 6/2020 | Zaidi | |
| 10,694,900 | B2 | 6/2020 | Troutman et al. | |
| D899,890 | S | 10/2020 | Eads | |
| 10,791,884 | B2 | 10/2020 | Starkey et al. | |
| 10,835,086 | B2 | 11/2020 | Osborne, Jr. | |
| 10,898,035 | B2 | 1/2021 | Mcintosh | |
| D922,982 | S | 6/2021 | Wang | |
| D923,625 | S | 6/2021 | Siminoff et al. | |
| 11,141,027 | B2 | 10/2021 | Starkey | |
| 2002/0073821 | A1 | 6/2002 | Broehl | |
| 2002/0134881 | A1 | 9/2002 | Hoernig | |
| 2003/0110915 | A1 | 6/2003 | Kapiloff et al. | |
| 2006/0102769 | A1 | 5/2006 | Wieser et al. | |
| 2007/0079684 | A1* | 4/2007 | Friesen | B26D 1/42 83/649 |
| 2007/0176041 | A1 | 8/2007 | Friesen et al. | |
| 2008/0048064 | A1 | 2/2008 | Lemaire et al. | |
| 2009/0302727 | A1 | 12/2009 | Vincent et al. | |
| 2010/0243696 | A1 | 9/2010 | Friesen et al. | |
| 2010/0286818 | A1 | 11/2010 | Goeking et al. | |
| 2010/0314429 | A1 | 12/2010 | Troutman et al. | |
| 2011/0068215 | A1 | 3/2011 | Troutman et al. | |
| 2011/0163056 | A1 | 7/2011 | Domenig et al. | |
| 2011/0210198 | A1 | 9/2011 | Case et al. | |
| 2012/0097789 | A1 | 4/2012 | Benedetti | |
| 2012/0097790 | A1 | 4/2012 | Wilkins et al. | |
| 2012/0167739 | A1* | 7/2012 | Lewis | B26D 5/00 83/663 |
| 2012/0286087 | A1 | 11/2012 | Alvarez Tapia et al. | |
| 2012/0312853 | A1 | 12/2012 | Osborne et al. | |
| 2013/0043266 | A1 | 2/2013 | Hagleitner | |
| 2013/0119183 | A1 | 5/2013 | Cattacin et al. | |
| 2013/0193258 | A1* | 8/2013 | Keily | B26D 1/125 242/562 |
| 2013/0248644 | A1 | 9/2013 | Goeking et al. | |
| 2014/0217117 | A1 | 8/2014 | Mirbach | |
| 2014/0263703 | A1 | 9/2014 | Waitlevertch et al. | |
| 2015/0217932 | A1 | 8/2015 | Carmen | |
| 2015/0289730 | A1 | 10/2015 | Keily et al. | |
| 2015/0305578 | A1 | 10/2015 | Keily et al. | |
| 2015/0374181 | A1 | 12/2015 | Morand | |
| 2016/0331192 | A1 | 11/2016 | Rubenson et al. | |
| 2016/0353946 | A1 | 12/2016 | Osborne, Jr. | |
| 2016/0353947 | A1 | 12/2016 | Osborne, Jr. | |
| 2017/0042390 | A1 | 2/2017 | Rubenson et al. | |
| 2017/0042391 | A1 | 2/2017 | Morand | |
| 2017/0051481 | A1 | 2/2017 | Mercer | |
| 2017/0188760 | A1 | 7/2017 | Henson et al. | |
| 2017/0290471 | A1 | 10/2017 | Borke et al. | |
| 2018/0033313 | A1 | 2/2018 | Mellema et al. | |
| 2018/0177348 | A1 | 6/2018 | Swanson et al. | |
| 2018/0263434 | A1 | 9/2018 | Babikian et al. | |
| 2018/0333013 | A1 | 11/2018 | Starkey et al. | |
| 2019/0014956 | A1 | 1/2019 | Chang | |
| 2019/0106287 | A1* | 4/2019 | Borke | B65H 35/08 |
| 2019/0274490 | A1 | 9/2019 | Trampolski | |
| 2020/0029750 | A1 | 1/2020 | Zimmermann et al. | |
| 2020/0029752 | A1 | 1/2020 | Zimmermann et al. | |
| 2020/0054177 | A1 | 2/2020 | Osborne, Jr. | |
| 2020/0205620 | A1 | 7/2020 | Osborne, Jr. | |
| 2020/0205621 | A1 | 7/2020 | Osborne, Jr. | |

FOREIGN PATENT DOCUMENTS

| | | | |
|---|---|---|---|
| WO | WO-2016/154512 | A1 | 9/2016 |
| WO | WO-2016/204924 | | 12/2016 |

OTHER PUBLICATIONS

Invitation to Pay Additional Fees, Search Report and Written Opinion regarding PCT/US2019/032451 DTD Aug. 16, 2019, 15 pps.

Examination Report for CA Application No. 3,062,633 dated Jun. 29, 2023. 4 pages.

Examination Report for EP Application No. 19727265.1 dated May 22, 2023. 7 pages.

EPO Examination Report for EP App No. 18769824.6 mailing date Sep. 6, 2022, 7 pages.

* cited by examiner

ROLL TOWEL DISPENSER

CROSS-REFERENCE TO RELATED PATENT APPLICATIONS

This application is a continuation of U.S. Pat. No. 11,141,027, filed May 15, 2019 and issued Oct. 12, 2021, which claims benefit of both U.S. Provisional Application No. 62/672,238, filed May 16, 2018, and U.S. Provisional Application No. 62/751,202, filed Oct. 26, 2018, all of which are incorporated herein by reference in their entireties.

TECHNICAL FIELD

The present disclosure relates generally to a roll towel dispenser. More specifically, the present disclosure relates to a roll paper towel dispenser with a light detection and ranging (LiDAR) sensor that enables electronic touch-free operation, but yet includes a manual back-up drive mode actuated by a manual paddle.

BACKGROUND

Paper towel dispensers may be used to dispense paper towel that can be used for a variety of purposes (e.g., hand drying, wiping up spills, etc.). Paper towel dispensers are generally located in a lavatory and dispense the paper towels to occupants of the lavatory. Paper towel dispensers are often designed to handle folded flat paper towels or continuous rolls of paper towel. Roll towel dispensers utilizing continuous rolls beneficially may be designed to house multiple rolls in order to increase the amount of paper towel that can be dispensed without maintenance (e.g., the addition of new rolls). Additionally, dispensers designed to handle continuous rolls of paper employ two primary methods of operation: manual and electronic. Manual dispensers rely on the user supplying a force to a mechanism to advance the paper out of the dispenser. Conversely, electronic dispensers use an electric motor in combination with a paper feeding mechanism to dispense the paper.

SUMMARY

At least one embodiment relates to a roll towel dispenser. The roll towel dispenser includes a frame configured to support a first roll of first paper towel and a second roll of second paper towel and a main roller coupled to the frame. During operation, the first paper towel from the first roll and the second paper towel from the second roll are positioned adjacent the main roller such that the first paper towel is positioned between the second paper towel and the main roller. The main roller is configured to engage the first paper towel such that rotation of the main roller moves the first paper towel from the first roll, at least partially around the main roller, and through an outlet of the roll towel dispenser. The first paper towel slips relative to the second paper towel while the main roller moves the first paper towel such that only the first paper towel is dispensed through the outlet.

Another embodiment relates to a roll towel dispenser. The roll towel dispenser includes a frame configured to support a roll of paper towel, a main roller coupled to the frame and configured to engage the paper towel to move the paper towel toward an outlet of the roll towel dispenser, a tear bar configured to tear the paper towel, and a tear bar holder pivotally coupled to the frame and supporting the tear bar. The tear bar holder is configured to pivot in response to a user applying a force on the paper towel such that the tear bar moves in unison with the tear bar holder.

Another embodiment relates to a method of operating a paper towel dispenser. The method includes receiving, from a user presence sensor, an indication that a user is nearby the paper towel dispenser, in response to receiving the indication that the user is present, controlling a motor to drive a roller of the paper towel dispenser to dispense paper towel through an outlet, receiving, from a rotation sensor, a pulse signal regarding rotation of the roller, determining, based on the quantity of received pulse signals, an amount of dispensed paper towel, comparing the amount of dispensed paper towel to a predefined threshold amount of dispensed paper towel, and in response to the comparison, stopping rotation of the motor.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Overview

Figure 1:
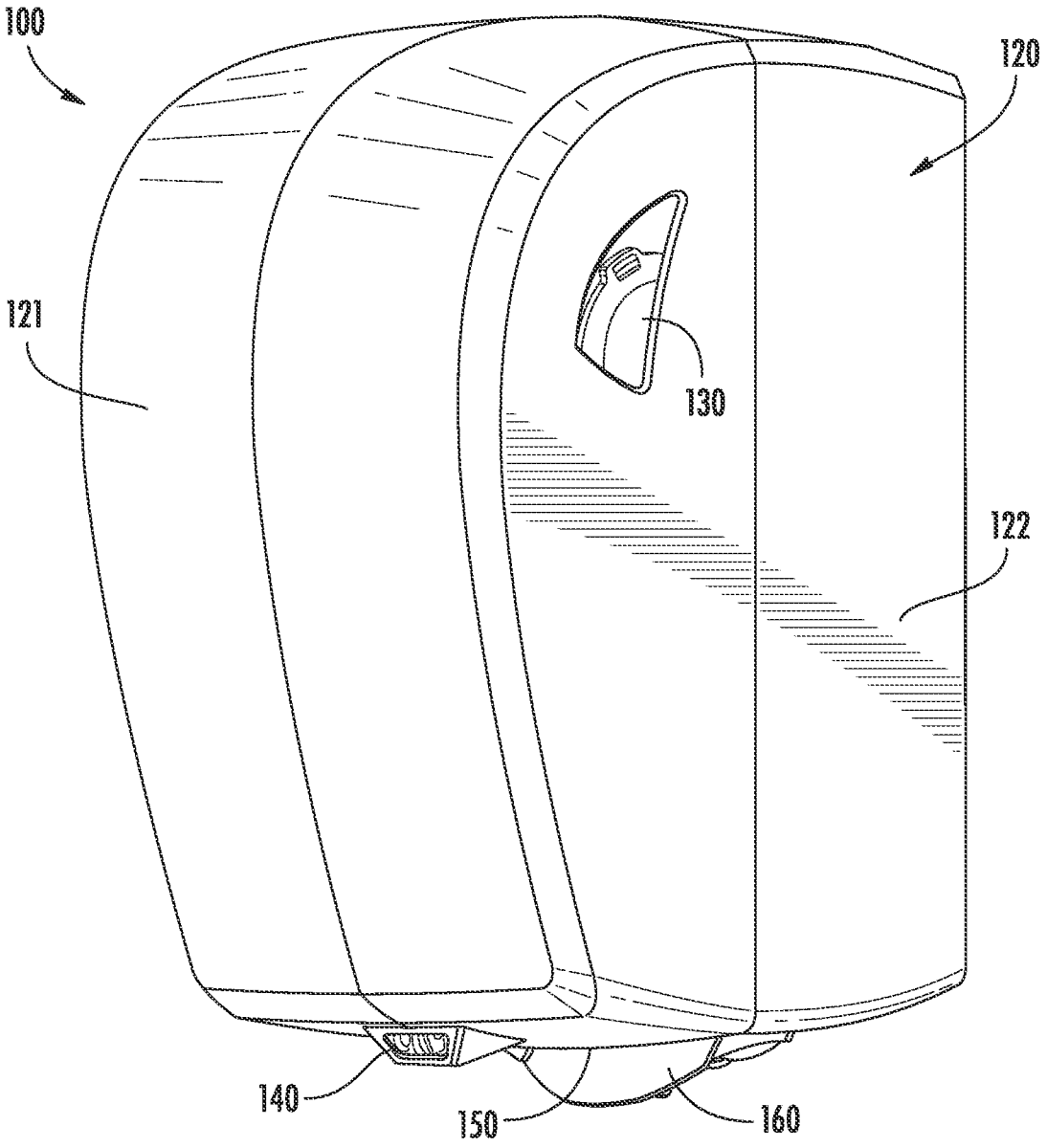
FIG. 1 is a perspective view of a roll towel dispenser, according to an exemplary embodiment.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, a roll towel dispenser is shown according to various exemplary embodiments. The roll towel dispenser is configured to operate in both an automatic mode and a manual mode. In this way, a user can apply a force to a manual paddle (or other manual actuation interface) to actuate the dispenser to distribute a paper towel (i.e., manual mode). The dispenser can also utilize a sensor, such as a light detection and ranging (LiDAR) sensor, to sense the presence of a user and/or movement to initiate a dispensing of a paper towel (i.e., an automatic mode). The dispenser may utilize one or both of the manual mode (e.g., such that a user can select whether they would like to have the paper towel dispensed manually or automatically, such that the manual mode can be utilized when the automatic mode fails, etc.).

The roll towel dispenser may include various internal components that facilitate actuation of the dispenser to distribute paper towel. The roll towel dispenser may include a roller system that drives a dispensing of a paper towel roll. The roller system can be driven to dispense a paper towel automatically by a motor or manually by a user-applied force. The roll towel dispenser may include one or more one-way bearings. Beneficially, the implementation of one way bearings can aid in not only reducing the force required to drive a main roller, but it also may beneficially prevent the main roller from being unintentionally rotated in a reverse direction by the unused drive mechanism (e.g., the automatic drive mechanism or the manual drive mechanism). Advantageously, prohibiting the main roller from rotating backwards may also reduce the risk of paper towel becoming jammed in the dispenser.

According to the present disclosure, the roller system includes a main roller, which includes at least one constant contact body and at least one transfer tab. The transfer tab and the constant contact bodies facilitate the switching or transition from a first roll (e.g., a primary roll of paper towel) to a second roll (e.g., a reserve roll of paper towel) seamlessly to keep paper towel being dispensed without user interaction (i.e., a user opening the shell to replace or add a new paper towel roll is not necessary for continued operation of the dispenser unless both the primary and secondary rolls of paper towel are emptied). Thus, the amount of roll towel dispensed from the roll towel dispenser without user interaction may be up to the total of both the first and second rolls which reduces the amount of user interaction with the roll towel dispenser, and extends the maximum duration that the roll towel dispenser can function without user interaction. However, the roll towel dispenser still permits the addition of a new roll when only one of the two rolls is completely emptied.

The main roller is driven by a motor, which may be powered by a battery or a wall outlet, or by actuation of the manual paddle. The main roller is configured to feed paper towel from either a stub roll or a reserve roll over a tear bar and through a dispenser opening to a user. The tear bar facilitates a user tearing the dispensed paper towel from its roll.

In some embodiments, the main roller includes three constant contact rollers of approximately equal length with two transfer tabs spaced between each adjacent constant contact roller. However, it is contemplated that the main roller can include one transfer tab or more than two transfer tabs. Further, the position of the transfer tabs can be changed, the size and number of constant contact rollers can be changed, the overall length and size of the main roller can be changed, and various other types of modifications can be made without departing from the teachings of the present disclosure.

The controller may be used to control the maximum amount of paper dispensed from the roll towel dispenser. For example, a counter may be used to count the revolutions of the main roller. A correlation is used to determine and/or measure the amount of paper towel dispensed based on the revolutions of the main roller. The motor may be deactivated after the maximum allowed dispensed amount of paper towel is provided. This amount may then be reset.

In some alternate embodiments, the motor may be a motor having a variable speed capability. In some other alternate embodiments, a sensor may be provided that monitors when the transfer from the stub roll to the reserve roll occurs. In this way, the motor can provide various functions, such as slowing dispensing of paper towel at the end of the cycle. These and other features and advantages of the roll towel dispenser are described in greater detail below.

Roll Towel Dispenser

Referring now to FIG. 1, a front perspective view of a roll towel dispenser, shown as dispenser 100, is shown, according to an exemplary embodiment. The dispenser 100 includes a housing, shown as outer shell 120, a window 130 defined in the outer shell 120 for observing the usage of a reserve roll 220 (shown in FIG. 2) and/or the internal components of the dispenser 100. The dispenser 100 further includes a user presence sensor, shown as LiDAR sensor 140, positioned near a bottom area of the outer shell 120 and configured to sense a presence or a movement of user proximate to the dispenser 100. Although the LiDAR sensor 140 is described primarily as a LiDAR sensor, it is contemplated that other types of sensors can be used without departing from the teachings of the present disclosure. For example, the LiDAR sensor 140 can be an infrared reflectance (IR) sensor, a capacitive field sensor, an ultrasonic sensor, or any other type of proximity sensor configured to sense a user proximate to the dispenser 100. Additionally, it is contemplated that the dispenser 100 can include some or all of the components, features, or functionality of the roll towel dispenser described in U.S. Pat. No. 10,791,884, filed May 18, 2018 and issued Oct. 6, 2020, which claims priority to U.S. Provisional Patent Application No. 62/508,895, filed May 19, 2017, the entire disclosures of which are incorporated by reference herein.

The bottom surface of the outer shell 120 includes or defines an outlet, shown as dispenser opening 150, through which paper towel is dispensed. In some embodiments, the dispenser opening 150 is at least partially defined by the frame 202. The outer shell 120 may include a front portion 121 (e.g., front piece, front part, etc.) and a back portion 122 (e.g., back piece, back part, rear part, etc.). The front portion 121 may be a front cover which may be coupled to the back portion 122. Specifically, the front portion 121 may pivotally couple to the back portion 122 by way of a pair of apertures on the sides of the back portion 122 which receive a pair of pegs which extend inward from the sides of the front portion 121. The outer shell 120 further includes a pair of parallel and opposing side walls. The window 130 may be a hole or aperture in the upper portion of the outer shell 120 to facilitate a user viewing a paper towel roll that may be contained within the dispenser 100. Beneficially, a user can use the window 130 to determine whether a new paper towel roll is needed. In an exemplary embodiment, the window 130 may be disposed in an upper portion on a side wall. In other embodiments, the window 130 is otherwise positioned (e.g., in the front of the outer shell 120 rather than on a side).

The LiDAR sensor 140 may be positioned on a bottom surface of the outer shell 120 in front of the dispenser opening 150 such that the LiDAR sensor 140 is located between the dispenser opening 150 and a front surface of the outer shell 120. In some embodiments, the LiDAR sensor 140 may be positioned or disposed behind a window such that light emitted by the internal LiDAR sensor 140 can exit and return through the window. In one embodiment, the light from the LiDAR sensor 140 is emitted horizontally outward and away from the dispenser (e.g., substantially perpendicular relative to the dispenser opening 150 where paper towel is dispensed in a substantially vertical manner). In other embodiments, the LiDAR sensor 140 may be positioned in other orientations to change the emission orientation relative to the dispenser (e.g., downward instead of substantially horizontally outward).

The dispenser 100 may further include a manual interface device or manual actuator (e.g., a lever, a paddle, a knob, a switch, a button, etc.), shown as manual paddle 160, which may be coupled to a frame 202 and/or the outer shell 120 of the dispenser 100. Specifically, the manual paddle 160 may extend generally vertically downward from the bottom surface of the outer shell 120 proximate the dispenser opening 150. The manual paddle 160 may be selectively repositionable or movable between a first position and a second position. In the first position, the manual paddle 160 protrudes outward and away from the outer shell 120. In the second position, the manual paddle 160 is moved or pivoted (e.g., about a lateral axis) closer to the outer shell 120. The manual paddle 160 is configured to receive a force from a user to move the manual paddle 160 from the first position to the second position. A biasing element, such as a spring, may be used to bias the manual paddle 160 toward the first position. The manual paddle 160 may be coupled to the main roller 350 (e.g., by one or more gears, etc.) such that the manual paddle 160 receives a force input from a user and transfers the mechanical energy to the main roller 350 as a torque. In operation, the movement of the manual paddle 160 from the first position to the second position causes the manual paddle 160 to drive rotation of the main roller 350, which in turn causes the dispenser 100 to dispense paper towel. A one-way clutch(es), shown as one-way bearing 401, prevents the force from the manual paddle 160 being transferred to the motor (e.g., the motor 400). As a result, the one-way bearing(s) prevent the force on the manual paddle 160 from driving the motor and vice versa.

Figure 2:
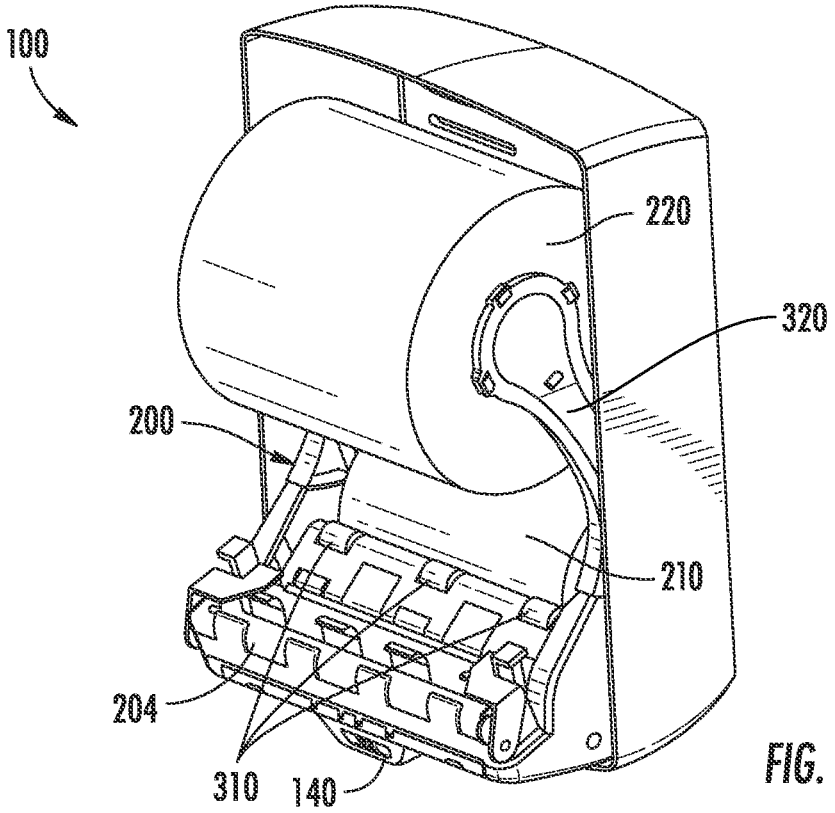
FIG. 2 is a perspective view of the roll towel dispenser of FIG. 1 with the front cover of the outer shell removed to show an internal roll configuration.
Figure 3:
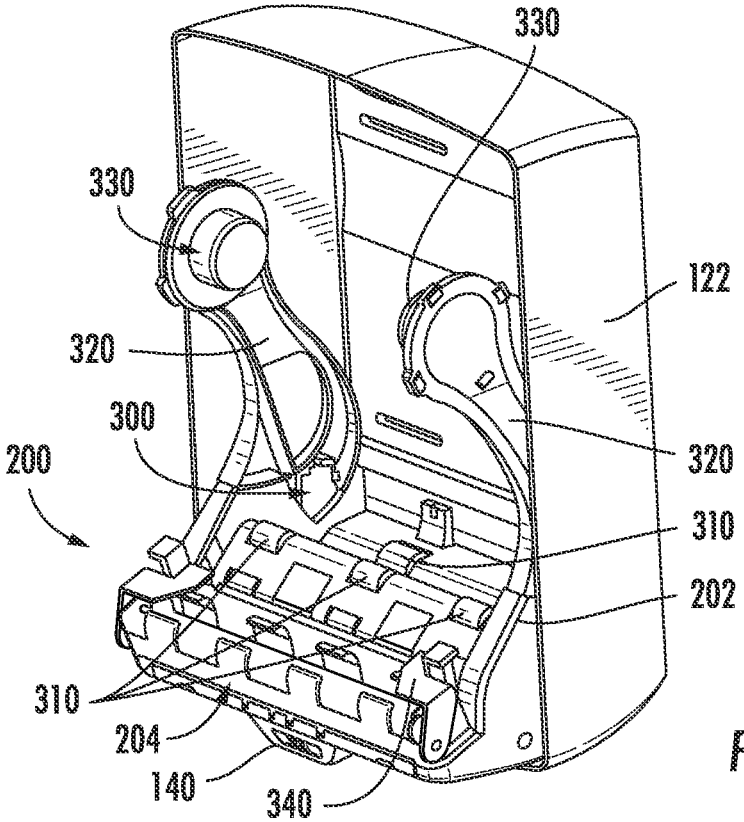
FIG. 3 is a perspective view of the roll towel dispenser of FIG. 1 with the front cover of the outer shell, a stub roll, and a reserve roll removed to show aspects of a dispensing mechanism.

Referring now to FIGS. 2 and 3, the dispenser 100 is shown with certain components removed to show certain elements in more detail. The dispenser 100 may include a dispensing mechanism 200 and a frame 202, which may be an assembly of components or, in an alternate embodiment, a single, unitary component. The outer shell 120 is a housing for various components of the dispenser 100. In particular, the outer shell 120 defines an interior volume that receives (e.g., completely contains, partially contains) the dispensing mechanism 200 and the frame 202. The frame 202 is the internal support structure for this variety of components. The frame 202 may generally be a component that provides a coupling structure for various components described herein. The frame 202 may be constructed from a variety of materials. In the example shown, the frame 202 is constructed from plastic and plastic-based materials. In other embodiments, the frame 202 is constructed from any combination of metal, plastic, rubber, and composite-based materials. The frame 202 may be coupled to an inner surface of the outer shell 120 (e.g., using one or more fasteners or snap connections, adhesive, etc.). In this regard, the frame 202 may be an internal structure for the dispenser 100 of which various components may be directly or indirectly connected to the frame 202. For example, the outer shell 120 may be coupled to the frame 202.

Figure 4:
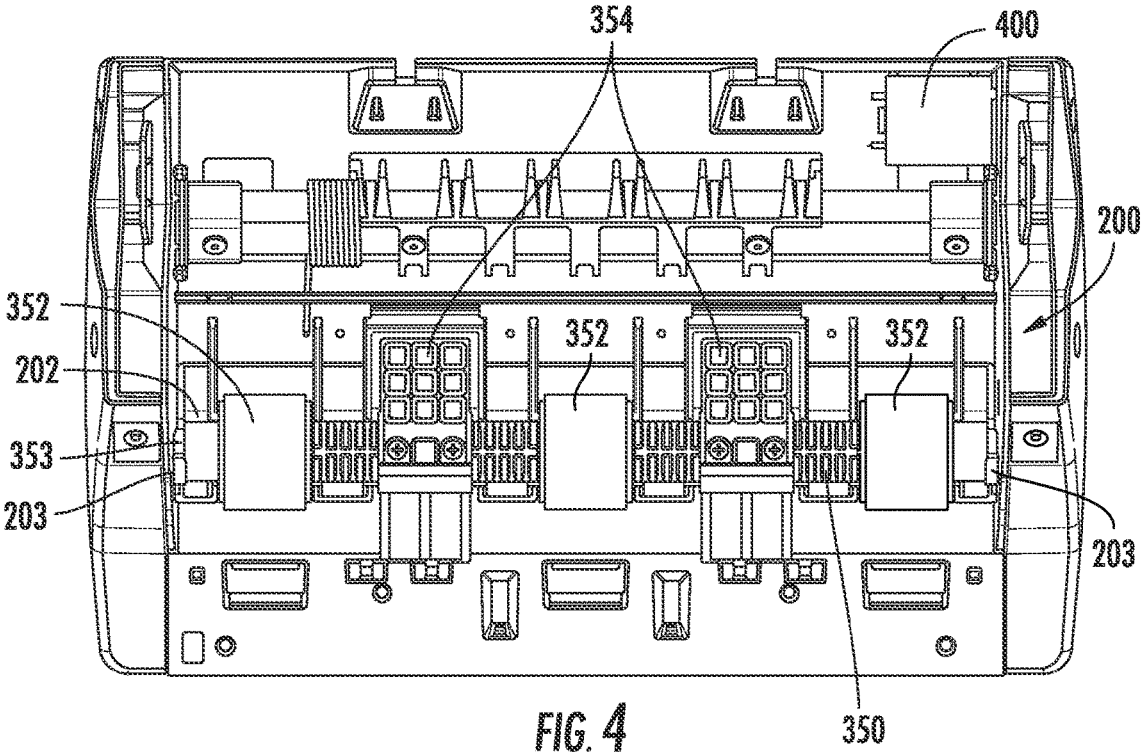
FIG. 4 is a bottom cross-sectional view of the roll towel dispenser of FIG. 1 showing the dispensing mechanism.

Referring to FIGS. 2-4, the dispensing mechanism 200 includes a receptacle 300, a main roller 350, and a transfer bar 340 (e.g., a transfer arm, transfer member, movable member, etc.). The dispensing mechanism 200 is configured to dispense paper from the dispenser 100. The receptacle 300 may be at least partially defined by the frame 202 and/or the outer shell 120. The receptacle 300 may be configured to receive a stub roll 210. The frame 202 is further configured to support a reserve roll 220. In some embodiments, the reserve roll 220 is larger (e.g., contains more paper) than the stub roll 210. The dispensing mechanism 200 is configured to automatically switch from dispensing paper from the stub roll 210 to dispensing paper from the reserve roll 220 when the stub roll 210 has been depleted or substantially depleted to facilitate a seamless and prolonged operation of the dispenser 100. At least one idle roller 310 is disposed on a lower surface of the receptacle 300 upon which the stub roll 210 may rest. Such a characteristic is beneficial to avoid reliance on various properties of the core of the stub roll (e.g., size, shape, etc.) that may vary between different rolls (e.g., between rolls from different manufacturers).

A pair of resilient arms 320 are further provided, which are spaced apart and extend vertically upward away from the dispenser opening 150, and may be coupled to the frame 202. In another embodiment, the resilient arms 320 may be of integral construction with the frame 202 (i.e., a one piece component). Specifically, the resilient arms 320 may be mounted to outer ends of the frame 202 and may extend vertically upward along and proximate to an inner surface of the side walls of the outer shell 120. The resilient arms 320 may be, for example, mounted (e.g., fixedly coupled, removably coupled, etc.) to the outer ends of the frame 202 by way of fasteners (e.g., screws, etc.), another coupling methodology (e.g., adhesive, a snap connection, etc.), or may alternatively be integrally formed with the frame 202. A pair of protrusions, shown as dual cups 330, are coupled to the upper ends of the resilient arms 320 spaced vertically above the dispenser opening 150. The dual cups 330 are spaced laterally apart and extend laterally inwardly (e.g., toward a central plane) from the resilient arms 320. The resilient arms 320 may be flexible to facilitate spreading apart the dual cups 330 to accommodate the reserve roll 220. The dual cups 330 may be inserted into the core of the reserve roll 220 to hold the reserve roll 220 between the two spaced apart resilient arms 320, rotatably coupling the reserve roll 220 to the frame 202. In this way, the properties of the core of the reserve roll 220 define the type (e.g., size, shape, etc.) of dual cups 330 that may be used.

The transfer bar 340 is coupled to the front portion of the dispenser 100. Specifically, the transfer bar 340 may be rotatably coupled to the frame 202 of the dispenser 100. As shown in FIG. 3, the transfer bar 340 includes a pair of inwardly extending pegs (e.g., extending towards each other) that are configured to be received by a pair of mating apertures of a battery receptacle 204 of the dispenser 100 which is coupled to the frame 202, such that the transfer bar 340 may pivot about the pegs. The battery receptacle 204 may be, for example, integrally formed with the frame 202, or may be coupled to the frame 202 (e.g., using one or more fasteners, adhesives, interference fits, a combination thereof, etc.). The battery receptacle 204 is configured to receive a battery which may optionally be used to power the dispenser 100.

The transfer bar 340 is configured to move, and particularly rotate or pivot about a lateral axis, between a first position and a second position. In the first position, the transfer bar 340 (particularly, the horizontal part of the transfer bar, not the pivot connection) is disposed furthest from the stub roll 210 (when present) (i.e., positioned away from the receptacle 300). In the second position, the transfer bar 340 (specifically, the horizontal part) is positioned relatively closer to the stub roll 210 (i.e., proximate the receptacle 300). The second position is the operating position. In the operating position, the dispenser 100 may be operated (e.g., to dispense paper towel from either the stub roll 210 or the reserve roll 220). As described herein, the transfer bar 340 receives and moves paper from the reserve roll 220 to a position proximate to the main roller 350 (e.g., as shown in FIG. 4).

Figure 5:
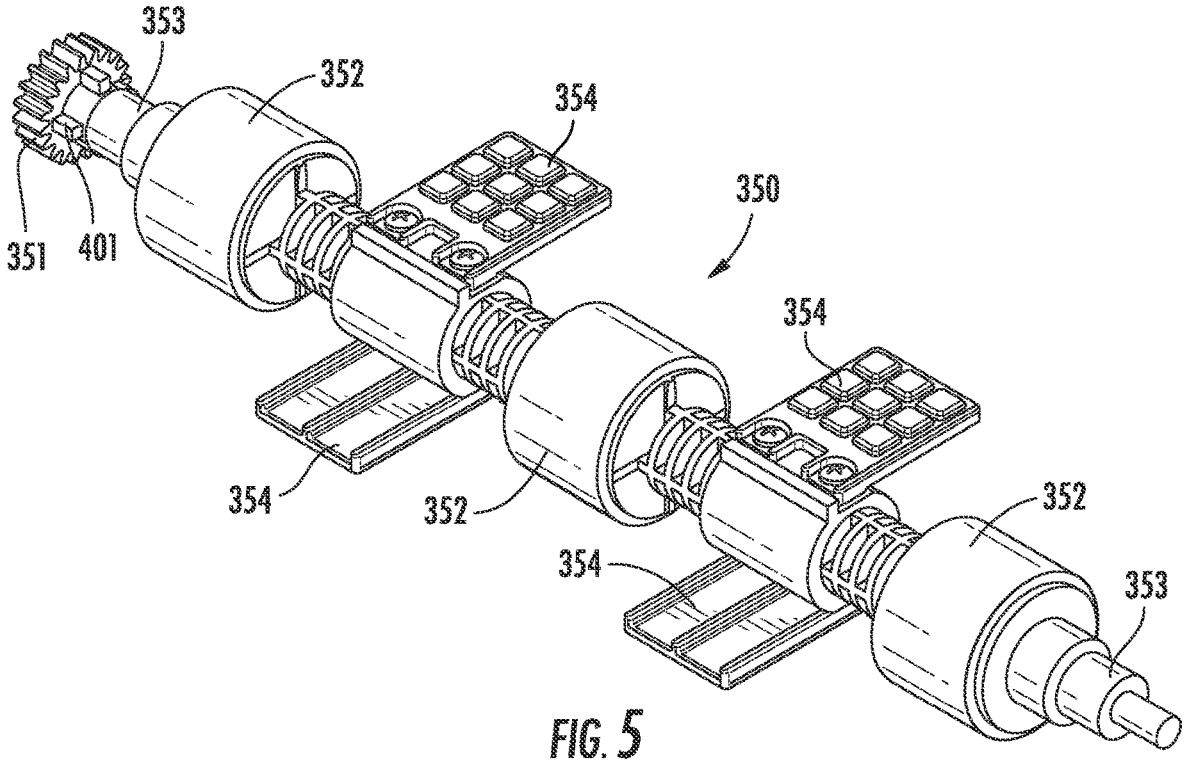
FIG. 5 is a perspective view of a main roller of the roll towel dispenser of FIG. 1.
Figure 6A:
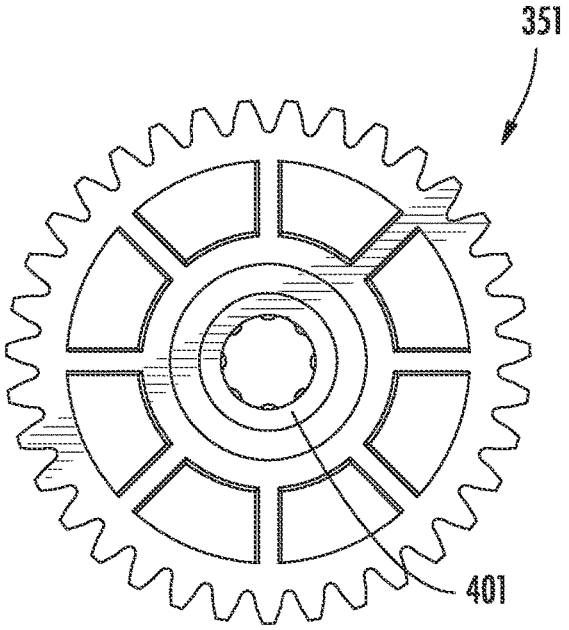
FIG. 6A is a side view of a main roller gear of the roll towel dispenser of FIG. 1.
Figure 6B:
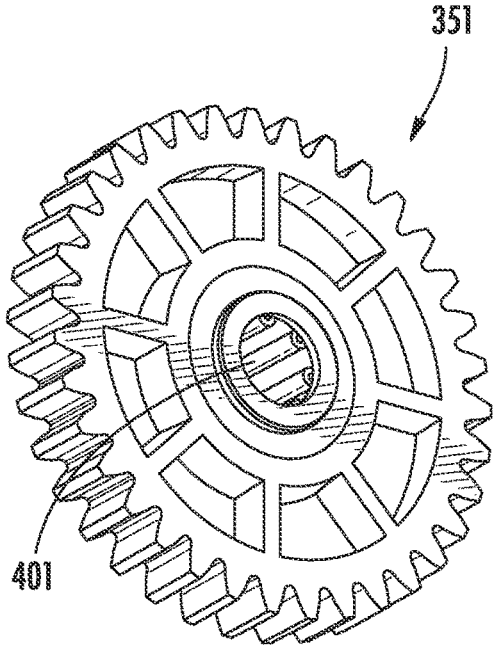
FIG. 6B is a perspective view of the main roller gear of FIG. 6A.
Figure 6C:
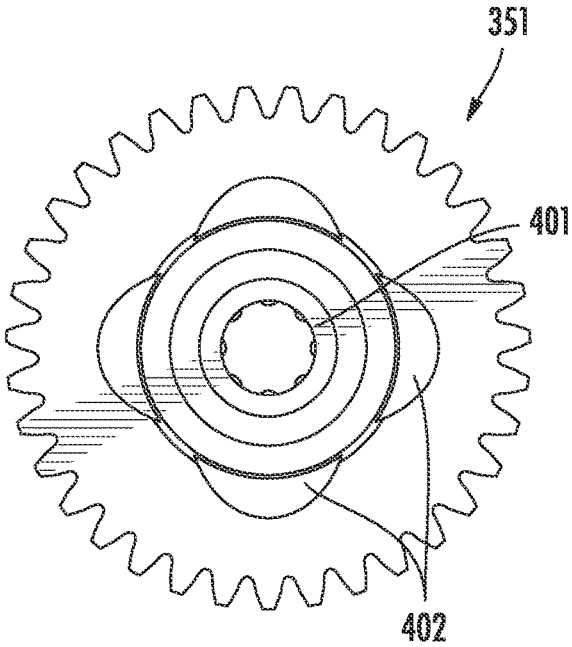
FIG. 6C is a side view of the main roller gear of FIG. 6A.
Figure 6D:
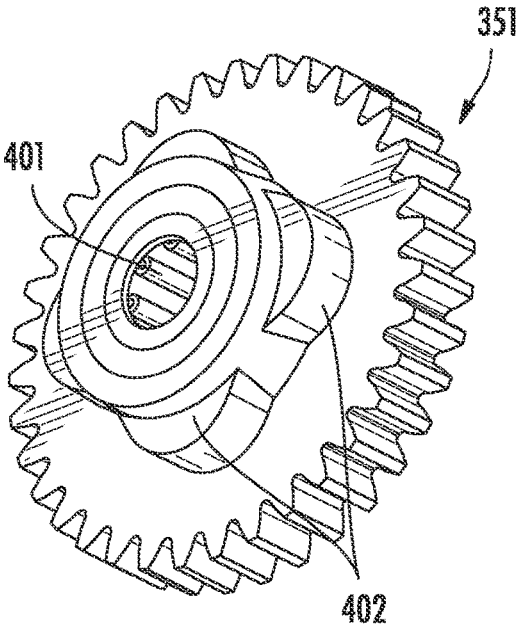
FIG. 6D is a perspective view of the main roller gear of FIG. 6A.

Referring now to FIGS. 4 and 5, the main roller 350 of the dispenser 100 is shown. As depicted, the dispenser 100 includes a main roller 350 having a set of constant contact bodies 352 (e.g., rollers, wheels, bodies, etc.) and a set of transfer tabs 354 (e.g., members, protrusions, extensions, flaps, grippers, movers, etc.). The main roller 350 is shown to include three constant contact bodies 352 of approximately equal length with two transfer tabs 354 positioned between each pair of adjacent constant contact bodies 352. In other embodiments, the main roller 350 includes more or fewer than three constant contact bodies 352 and/or more or fewer than two transfer tabs 354. The transfer tabs 354 extend radially outward from the constant contact bodies 352 (e.g., the transfer tabs 354 extend a first distance from a central axis of the main roller 350, the constant contact bodies 352 extend a second distance from the central axis, and the first distance is greater than the second distance). Similarly, in some embodiments, the positions of the transfer tabs 354 or the size and number of constant contact bodies 352 may also change, as well as the overall length and size of the main roller 350.

As shown, the constant contact bodies 352 are constant contact rollers. Thus, the constant contact bodies 352 may also be referred to as constant contact rollers or rollers 352 herein. However, the constant contact bodies 352 may be any features that are configured to apply force to the paper. In some embodiments, the constant contact bodies 352 are relatively low-friction such that the bodies 352 can slip relative to the paper. In other embodiments, the constant contact bodies are relatively high-friction such that the bodies 352 have a limited amount of slippage relative to the paper. In some embodiments, the constant contact bodies 352 are fixed to the main roller 350 such that the constant contact bodies 352 and the transfer tabs 354 rotate in unison. In other embodiments, the constant contact bodies 352 are free to rotate relative to the rest of the main roller 350 (e.g., are rotatably coupled to the rest of the main roller 350). In some embodiments, the bodies 352 are stationary or fixed in nature (e.g., relative to the frame 202) rather than capable of rolling or spinning like the constant contact bodies 352 that are shown, such that the paper slides over them.

The transfer tabs 354 may be plate-like protrusions, extensions, or members which extend (e.g., tangentially) from the main roller 350 to aid in pulling paper through the dispenser 100. Specifically and in the example shown, each transfer tab 354 is coupled to the body of the main roller 350 using at least one fastener (particularly, two screws). In other embodiments, a variety of other coupling mechanisms may be utilized to couple the transfer tabs 354 to the body of the main roller 350 (e.g., an adhesive (e.g., epoxy, glue, etc.), a joining process such as welding, etc.). Those of ordinary skill in the art will appreciate and recognize the high configurability of the coupling mechanisms that may be utilized with the transfer tabs 354 and body of the main roller 350. Each transfer tab 354 is generally shaped as a rectangular, block-like structure having a series of raised protrusions or blocks extending outward and away from the body of the transfer tab 354. As shown, a 3×3 matrix of blocks are disposed on one side of the body of the transfer tab 354 on the side that engages with the paper towel during operation. On the opposite side of the body of the transfer tab 354, three longitudinal ribs extend away from the body of the main roller 350 to provide stability (e.g., resistance to bending deformation) to the transfer tab 354, such that the transfer tab 354 does not unduly bend or flex during operation. This facilitates the transfer tab 354 gripping and pulling the paper towards the dispenser opening 150. In other embodiments: the matrix of blocks and ribs are removed; the number of ribs is increased, decreased, and/or the ribs are disposed in different positions; the raised blocks are arranged in a different pattern; and/or the number of raised blocks is increased or decreased relative to that shown; the raised blocks may be replaced with features of a different shape, such as raised cylinders; and so on. All such variations are intended to fall within the scope of the present disclosure.

The main roller 350 is rotatably coupled to the frame 202. Specifically, the main roller 350 may have a support member 353 (e.g., a boss, a shaft, etc.) extending or projecting outwardly at each end of the body of the main roller 350 to be received by the frame 202. The support member 353 may have a circular cross-section and may be received in apertures 203 defined by the frame 202. The cross-sections of the apertures 203 may match the shapes of the cross-sections of the support members 353 to facilitate support of the main roller 350. The cross-sections of the apertures 203 may be at least as large as the cross-sections of the support members 353 of the main roller 350. In this way, when the support members 353 are received within the apertures 203, the main roller 350 may be coupled to, and be able to rotate relative to, the frame 202 by way of the support members 353 rotating within the apertures 203.

The main roller 350 is coupled to a driver or driving mechanism, shown as motor 400. Specifically, the main roller 350 may be rotationally driven by the motor 400, which may be powered by a power source (e.g., a battery which may be received in the battery receptacle 204 and/or a wall outlet connected to a power grid). In addition to the motor 400, the main roller 350 may also be driven by actuation of the manual paddle 160. In this way, the dispenser 100 may be configured to operate in either an automatic mode or a manual mode. While operating in an automatic mode, the dispenser 100 is driven by the motor 400 or another driver (e.g., electrically-powered, pneumatically-powered, etc.) instead of by the user as a way of dispensing paper towel. When operating in a manual mode, the dispenser 100 is actuated by a force applied by a user on the manual paddle 160.

Referring now to FIGS. 6A-6D, various perspective views of a main roller gear 351 which couples to the main roller 350 are shown. The main roller gear 351 is positioned at or near an end of the main roller 350. The main roller gear 351 is directly coupled to the main roller 350. A one-way clutch (e.g., coupler, bearing, bushing, etc.), shown as one-way bearing 401, may be coupled (e.g., press-fit) to an inner surface/portion of the main roller gear 351 at the center of the main roller gear 351. When the main roller gear 351 is rotated in a first direction (e.g., clockwise, counterclockwise) relative to the main roller 350, the one-way bearing 401 limits relative rotation of the rotationally fixes the main roller gear 351 to the main roller 350 such that they rotate in unison (e.g., in the same speed and in the same direction). When the main roller gear 351 is rotated in a second direction opposite the first direction relative to the main roller 350, the one-way bearing rotationally decouples the main roller gear 351 from the main roller 350, permitting free relative rotation (i.e., freewheeling). Accordingly, the one-way bearing 401 may beneficially prevent the main roller 350 from rotating backwards (e.g., if the main roller gear 351 is held stationary). This prevents torque or force from being transmitted to the motor 400 or to the manual paddle 160 when these modes are not utilized.

Figure 7A:
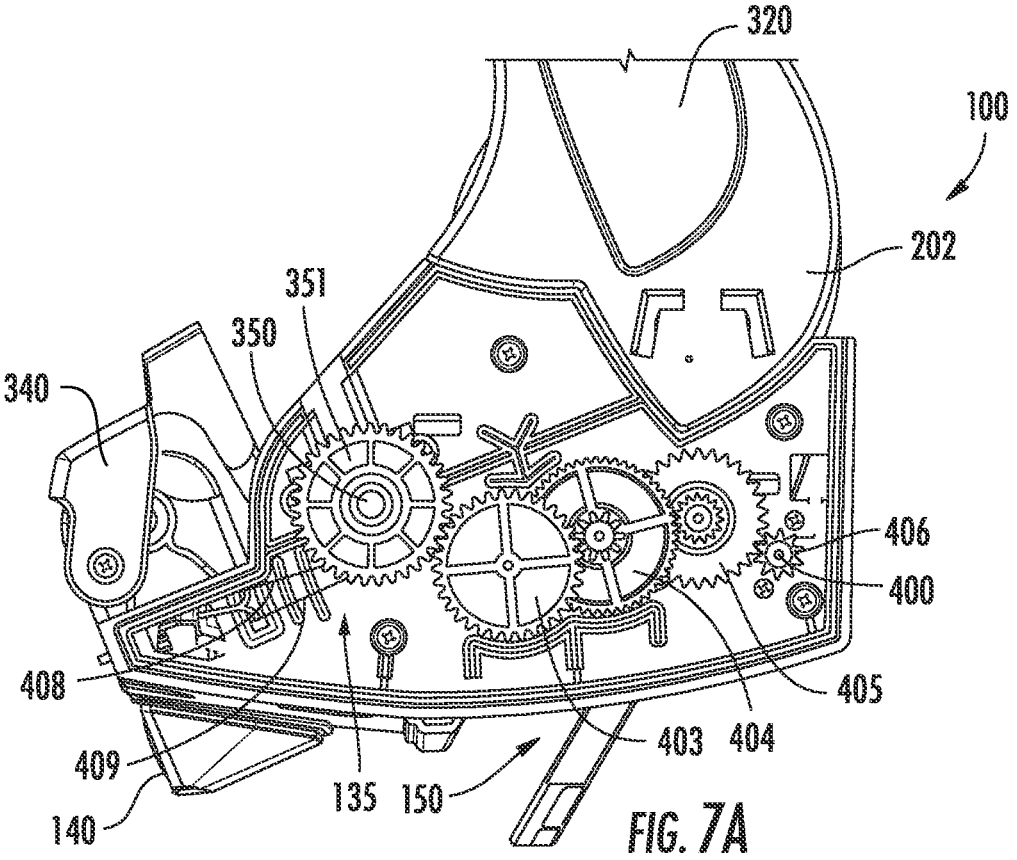
FIG. 7A is side cross-sectional view of the roll towel dispenser of FIG. 1.
Figure 7B:
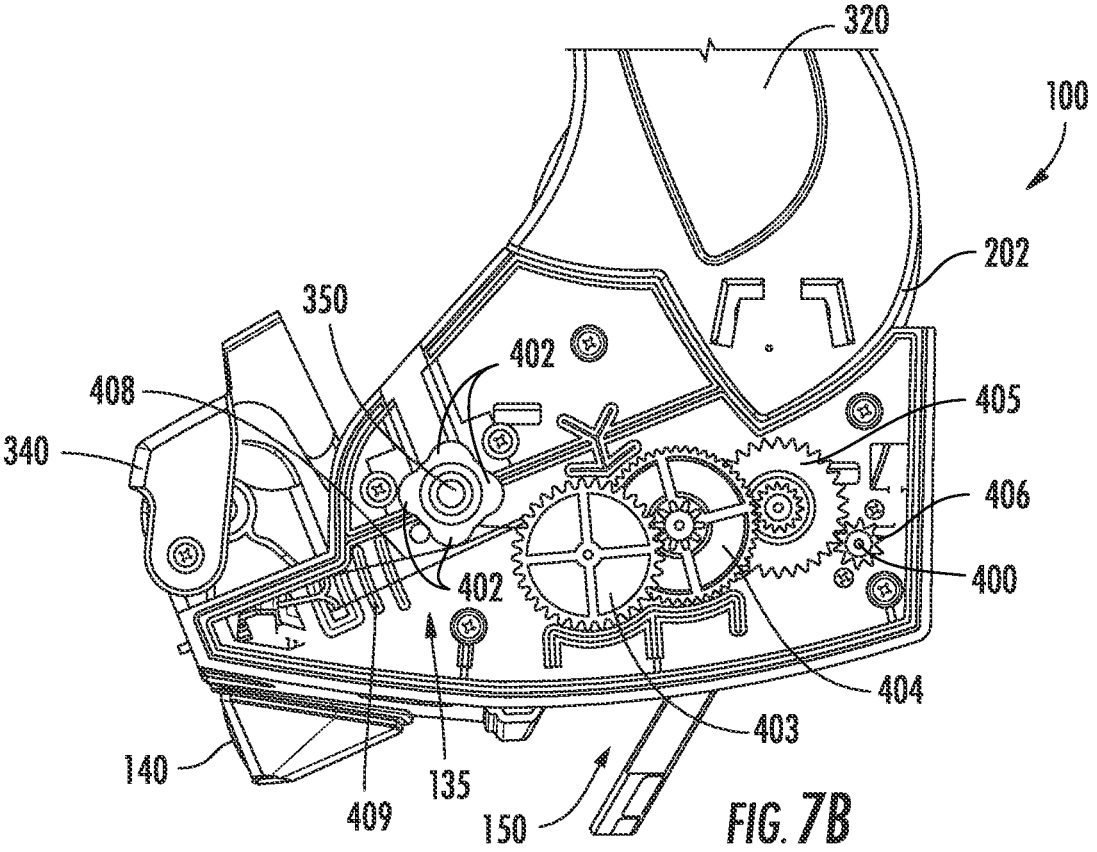
FIG. 7B is a side cross-sectional view of the roll towel dispenser of FIG. 1, with a partial section view cut through the main roller gear to show details of the nodes.

Referring now to FIGS. 7A and 7B, cross-sectional side views of the dispenser 100 are shown. The main roller 350 may be driven by the motor 400. To couple the motor 400 to the main roller 350, the dispenser 100 includes a gear train. Specifically, the motor 400 (e.g., a shaft of the motor 400) is coupled (e.g., fixedly) to a first gear, shown as drive gear 406. In operation, the motor 400 drives the drive gear 406, which in turn drives a second gear 405 rotatably coupled to the frame 202. The gear 405 drives a third gear 404 rotatably coupled to the frame 202, which in turn drives a fourth gear 403 rotatably coupled to the frame 202. The gear 403 drives the main roller gear 351, causing the main roller 350 to rotate and drive paper to exit the dispenser 100 through the dispenser opening 150. One or more of the gears may be two stage gears (e.g., gears with two sets of teeth each having different pitch diameters) to vary a gear ratio between the drive gear 406 and the main roller gear 351 (e.g., to increase the mechanical advantage of the motor 400 acting on the main roller 350).

On one side of the main roller gear 351, a series of radial protrusions, shown as lobes 402, extend radially outward from a surface of the main roller gear 351 (e.g., from the one-way bearing 401). For example, the main roller gear 351 may have four lobes 402, which may be equally spaced apart about a central axis of the main roller gear 351.

The dispenser 100 may also include a rotation sensor, shown as rotation switch 135. The rotation switch 135 includes a pair of electrical contact members, shown as leaf springs 408, 409. The two leaf springs 408, 409 may be positioned near the main roller gear 351. The leaf springs 408, 409 may be biased apart from one another. By way of example, the leaf springs 408, 409 may be positioned such that at least one of the leaf springs 408, 409 is deformed when the leaf springs 408, 409 are moved toward one another. The leaf spring 408 is positioned such that it engages the lobes 402 or the surfaces of the main roller gear 351 between the lobes 402 (e.g., is biased into contact with the lobes 402). The lobes 402 vary the radius of the main roller gear 351 such that leaf spring 408 is forced downward or permitted to move upward as the main roller gear 351 rotates. The top leaf spring 408 is repositionable between a first position and a second position. In the first position, the leaf spring 408 is raised (e.g., vertically closer to the reserve roll 220) and offset from the leaf spring 409 (e.g., does not contact the leaf spring 409). In the second position, the leaf spring 408 is lowered relative to the first position such that the leaf spring 408 comes into contact with (e.g., engages) the second spring 409. When the top leaf spring 408 and the lower leaf spring 409 come into contact, a circuit is completed, thereby registering a pulse signal or pulse (e.g., as part of a counting process described herein). In an alternate embodiment, only one leaf spring is used. In such an embodiment, the lobes 402 may be electrically conductive such that when the lobe 402 contacts the leaf spring the circuit is completed. In another alternative embodiment, more than two leaf springs may be utilized. In addition, while a configuration having the leaf springs 408, 409 is described, the circuit may register the pulses using any sensor which would detect movement of the lobes 402. Thus, the use of leaf springs should not be interpreted as limiting.

Referring now to FIG. 7B, another cross-sectional side view of the dispenser 100 is depicted. Specifically, the lobes 402 of the main roller gear 351 are shown, to detail the interaction of the lobes 402 with the leaf springs 408, 409. As the main roller gear 351 rotates, the lobes 402 comes into contact with the top leaf spring 408. Specifically, as the main roller gear 351 rotates, a lobe 402 causes the top leaf spring 408 to deflect such that the body of the top leaf spring 408 comes into contact with the lower leaf spring 409. The two leaf springs 408, 409 may be conductive, and in turn, may complete a circuit when they come in contact, permitting current to flow through the top leaf spring 408 and the bottom leaf spring 409. As the main roller gear 351 continues to rotate, the lobe 402 rotates away from the top leaf spring 408, permitting the top leaf spring 408 to return to a resting state away from the lower leaf spring 409. In this way, when the top leaf spring 408 and the lower leaf spring 409 lose contact and return to the resting state, they may no longer be in physical contact and thus, may break the electrical connection as well. Accordingly, in an embodiment where the main roller gear 351 includes four of the lobes 402, the leaf springs 408, 409 may come into contact four times during each revolution of the main roller gear 351. Each separate engagement of the leaf springs 408, 409 may be registered a pulse for the purpose of counting rotations of the main roller 350. Each pulse may indicate that the main roller 350 has rotated a predetermined angle. By way of example, in an embodiment including four lobes 402, each pulse may correspond to 90 degrees of rotation of the main roller 350.

Figure 8:
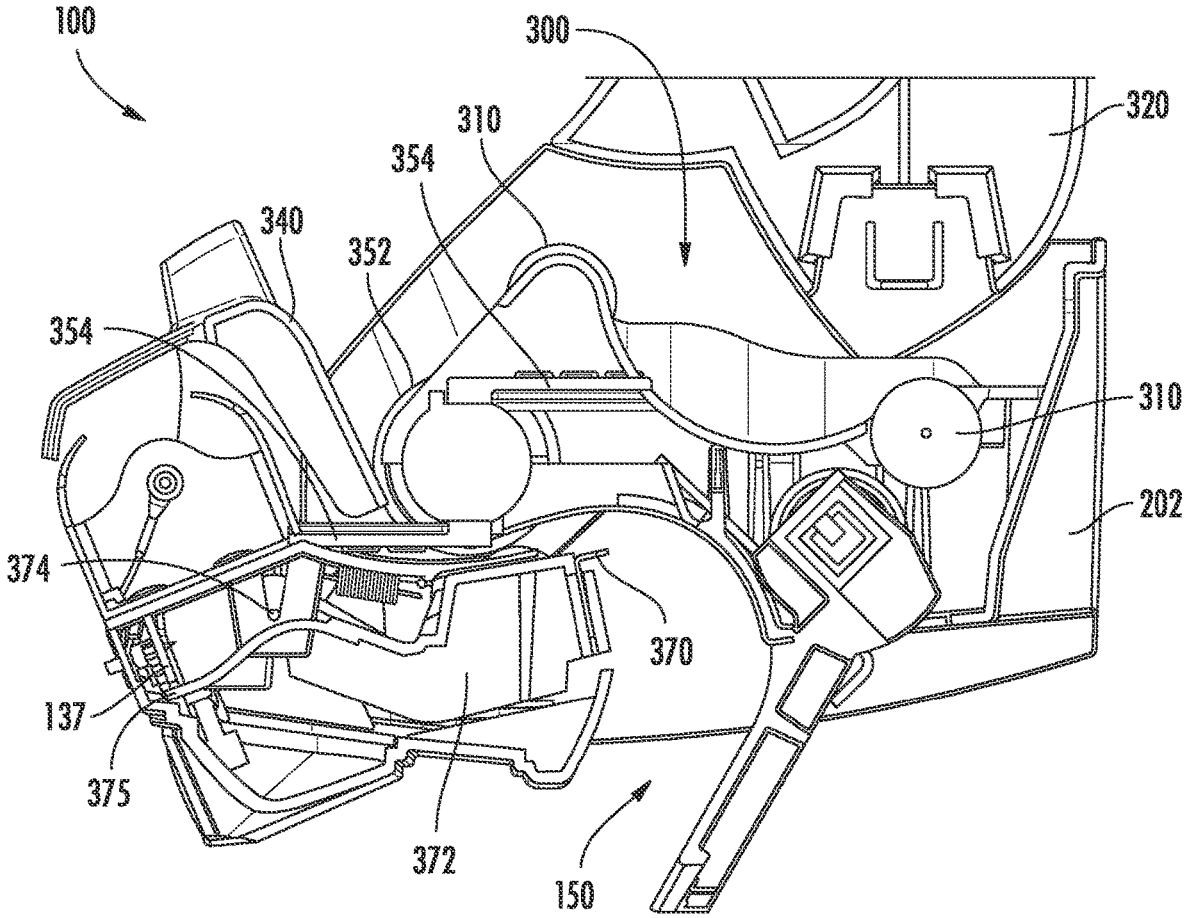
FIG. 8 is a side cross-sectional view of the roll towel dispenser of FIG. 1.

Referring now to FIG. 8, another cross-section view of the dispenser 100 is depicted. As shown, the dispenser 100 further includes a tear bar 370 and a tear bar holder 372. The tear bar holder 372 may be pivotally coupled to the lower side of the dispenser 100. For example, the tear bar holder 372 may be pivotally coupled to the frame 202 by way of a pivotable connection, such as using pegs received in corresponding apertures. As shown, the tear bar holder 372 is pivotally coupled to the frame 202 by a pin 374 such that the tear bar holder 372 rotates about a lateral axis extending through the center of the pin 374. The tear bar 370 is coupled to a distal end of the tear bar holder 372 (proximate the dispenser opening 150). The tear bar 370 may include serrations or another cutting device/mechanism that enables or facilitates the cutting of paper towel from the paper towel roll (stub or primary). In the example shown, the tear bar 370 includes serrations. The tear bar 370 may extend substantially horizontally (e.g., laterally), which facilitates paper flowing, sliding, or otherwise moving over the tear bar 370 with a minimal chance of the paper snagging or becoming caught on the tear bar 370. In this way, the paper may flow substantially horizontally over the tear bar 370, and then fall downward at or beyond a distal end of the tear bar 370. When a user pulls on the exposed paper towel, the paper may place a downward force on the tear bar 370, causing the tear bar holder 372 to pivot about a pivot point and deflect downward, and finally, causing the paper to tear over the tear bar 370. In this regard, the distance that the tear bar holder 372 is able to move or pivot is limited, such that at or near the end of the movement of the tear bar holder 372, the tear bar 370 becomes fixed or immovable. Subsequently, the downward force on the paper towel engages the paper towel with the tear bar 370 at a relatively higher pressure or force to cause a tearing, severing, or cutting of the paper from the paper towel roll using the tear bar 370.

Figure 9:
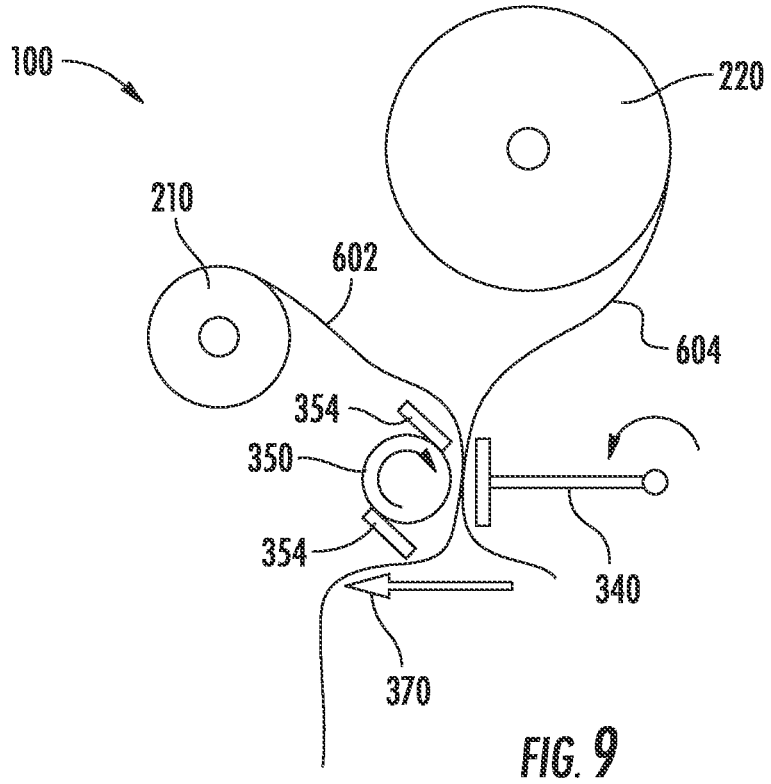
FIGS. 9-10C are schematics showing the flow of paper through the roll towel dispenser of FIG. 1.
Figure 10A:
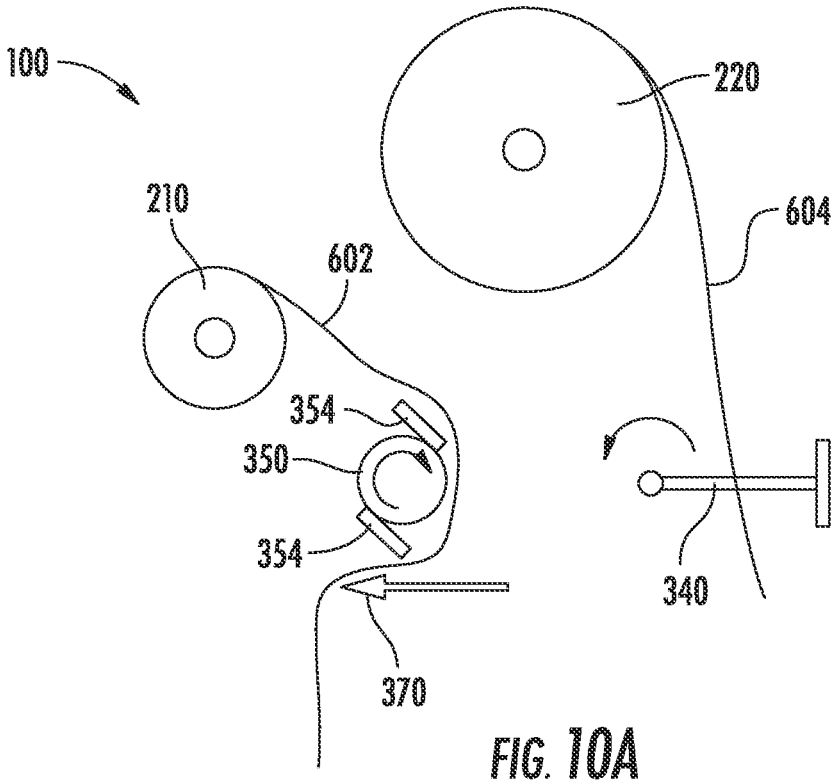
Figure 10B:
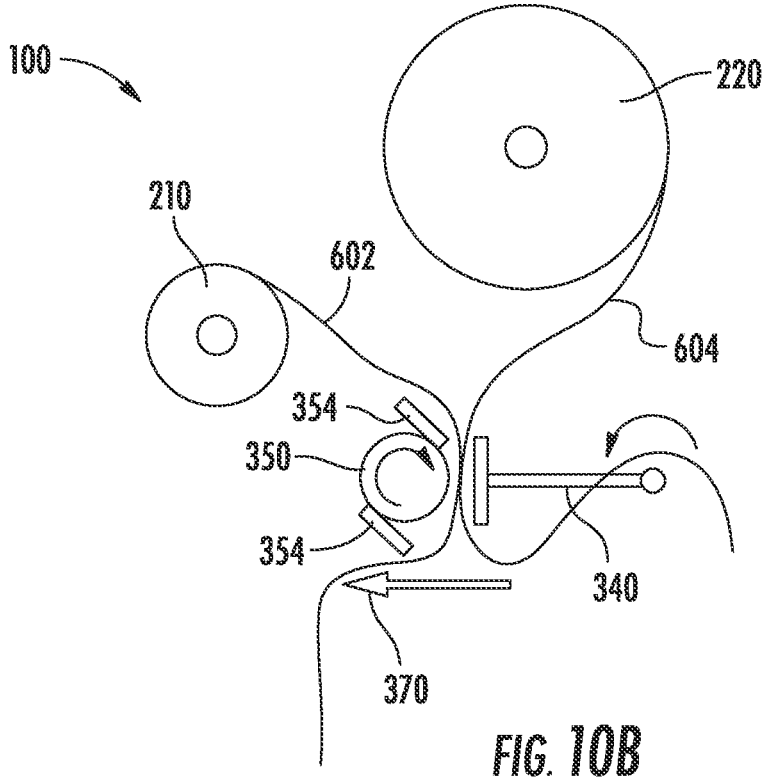
Figure 10C:
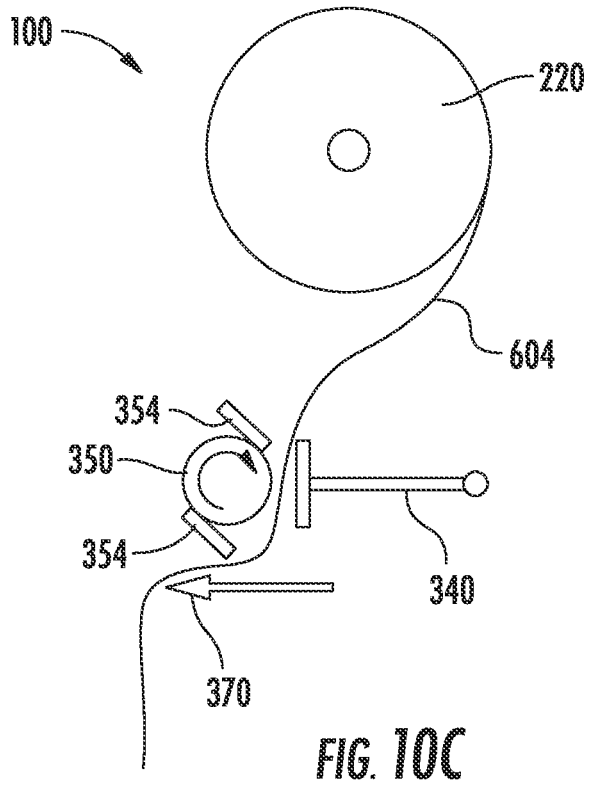

Referring now to FIGS. 9-10C, schematic illustrations showing the flow of paper through the dispenser 100 are depicted. Specifically, a series of schematic illustrations of the dispenser 100 as described above is provided, to illustrate how the transition from the stub roll 210 to the reserve roll 220 occurs. In operation, paper 602 from the stub roll 210 partially loops over or surrounds the main roller 350. Paper 604 from the reserve roll 220 is positioned near the main roller 350 when the transfer bar 340 pivots towards the main roller 350 (second position). Rotating, pivoting, or otherwise moving the transfer bar 340 to the second position causes the paper 604 from the reserve roll 220 to come into contact (or near contact) with the paper 602 from the stub roll 210. While such a configuration may seem to imply that a double feed situation is likely to occur (i.e., where paper from both the stub and reserve rolls is dispensed to a user simultaneously), beneficially and as described herein, the structure of the dispenser 100 is configured to minimize the likelihood of a double feed situation while facilitating a seamless transition from dispensing from the stub roll 210 to dispensing from the reserve roll 220.

When a user is detected using the LiDAR sensor 140, the dispenser 100 activates the motor 400 to rotate the main roller 350. In this way, the automatic mode operates when the motor 400 is energized based on the LiDAR sensor 140 detecting a user. Alternatively, in manual mode, the user may actuate the manual paddle 160 to rotate the main roller 350.

In some embodiments, the main roller 350 is configured to feed paper towel from either the stub roll 210 or the reserve roll 220 over a tear bar 370 and through the dispenser opening 150. The tear bar 370 permits a user to tear the dispensed paper towel from its roll.

With the above in mind, a description of the dispensing process and the transition process from the stub roll 210 to the reserve roll 220 is provided as follows. As the main roller 350 rotates, the transfer tabs 354 and constant contact bodies 352 grip and pull the paper 602 from the stub roll 210 to feed the paper 602 through the dispenser opening 150 to a user. The paper 602 may be fed over the tear bar 370, such that the tear bar 370 does not tear or rip off the dispensed paper 602 from the remainder of the stub roll 210 prematurely. When the motor 400 stops and the user wishes to tear off the dispensed paper 602, the user pulls down on the paper 602 such that the paper 602 engages with the tear bar 370 thereby ripping the paper 602.

This process continues until the paper 602 from the stub roll 210 is emptied. Without the paper 602 to block the transfer tabs 354, the transfer tabs 354 engage the paper 604 from the reserve roll 220 such that when the main roller 350 is subsequently driven, the transfer tabs 354 grip and pull the paper 604 from the reserve roll 220 through the dispenser opening 150 and towards a user. The transfer tabs 354 may be constructed from any compliant material that provides a high coefficient of friction between the paper and the transfer tabs 354, such that the transfer tabs 354 can grip the paper with minimal or no relative movement (e.g., sliding) between the transfer tabs 354 and the paper. In the example shown, the tabs 354 are constructed from a synthetic polymer material. In other configurations, a different material (e.g., rubber, a deformable compliant material, etc.) may be used to construct the transfer tabs 354, or at least a part thereof. In some instances, a coating, such as a sticky coating, may be applied to the engagement side of the transfer tabs 354 (e.g., on or around the raised blocks) to further increase their ability to grip and pull the paper towel. Beneficially, this relationship facilitates a smooth transition from the stub roll 210 to the reserve roll 220. The friction between the transfer tabs 354 and the paper 602 from the stub roll 210 is greater than the friction between the paper 602 from the stub roll 210 and the paper 604 from the reserve roll 220 (i.e., the paper-to-paper friction is lower than the paper-to-transfer tab friction). As such, when the paper 602 from the stub roll 210 is dispensed, the paper 602 from the stub roll 210 slips, slides, or otherwise moves relative to the paper 604 from the reserve roll 220, such that the paper 604 from the reserve roll 220 is not also dispensed. That is to say, double feeding of paper 602 and 604 is prevented. Such a configuration is beneficial as it avoids complex and costly transfer mechanisms that may be utilized in other roll towel dispensers.

Referring now to FIGS. 10A-10C, in the instance where a user wants to load a new stub roll 210 and reserve roll 220, the user may remove or pivot the front portion 121 away from the interior volume of the dispenser 100 to expose the dispensing mechanism 200 and rotate the transfer bar 340 to the position shown in FIG. 10A. The user may place the stub roll 210 into the receptacle 300 (shown in FIG. 8) and drape the paper 602 over the main roller 350. Additionally, the paper 602 may be partially looped over or surround the main roller 350. When a user loads the reserve roll 220 into the dispenser 100, the user may couple the reserve roll 220 to the dual cups 330 of the resilient arms 320. By way of example, the user may insert the dual cups 330 into a central aperture of a core of the reserve roll 220. The user may ensure that the paper 604 falls generally between the main roller 350 and the transfer bar 340 upon being loaded. The user may then rotate the transfer bar 340 to the position shown in FIG. 10B. When the transfer bar 340 is rotated accordingly, the paper 604 is pushed into contact or near contact with the paper 602.

The user may rotate the transfer bar 340 into an operational position in which the transfer bar 340 causes friction between paper 602 and 604 (as shown in FIG. 10B). The user may then actuate the dispensing mechanism 200 by way of, for example, applying a force to the manual paddle 160 or by being detected by the LiDAR sensor 140. Because the friction between the transfer tabs 354 and the paper 602 from the stub roll 210 is greater than the friction between the paper 602 from the stub roll 210 and the paper 604 from the reserve roll 220, the paper 602 slips or slides relative to the paper 604 from the reserve roll 220. The paper 604 from the reserve roll 220 is not pulled through the space between the main roller 350 and the transfer bar 340 due to the relatively low friction between the paper 602 from the stub roll 210 and the paper 604 from the reserve roll 220. In this way, the dispenser 100 dispenses the paper 602 from the stub roll 210 until it is depleted.

Once the paper 602 from the stub roll 210 has been depleted (as shown in FIG. 10C) and because the paper 604 from the reserve roll 220 is in a ready position, the transfer tabs 354 grip the paper 604 from the reserve roll 220 and begin feeding the paper 604 from the reserve roll 220 through the dispenser 100. The friction between the transfer tabs 354 and the paper 604 from the reserve roll 220 is relatively higher than the friction between the paper 602 and the paper 604 and is sufficient to cause the paper 604 from the reserve roll to be pulled through the space between the main roller 350 and the transfer bar 340.

Automatic Mode of the Roll Towel Dispenser

Figure 11:
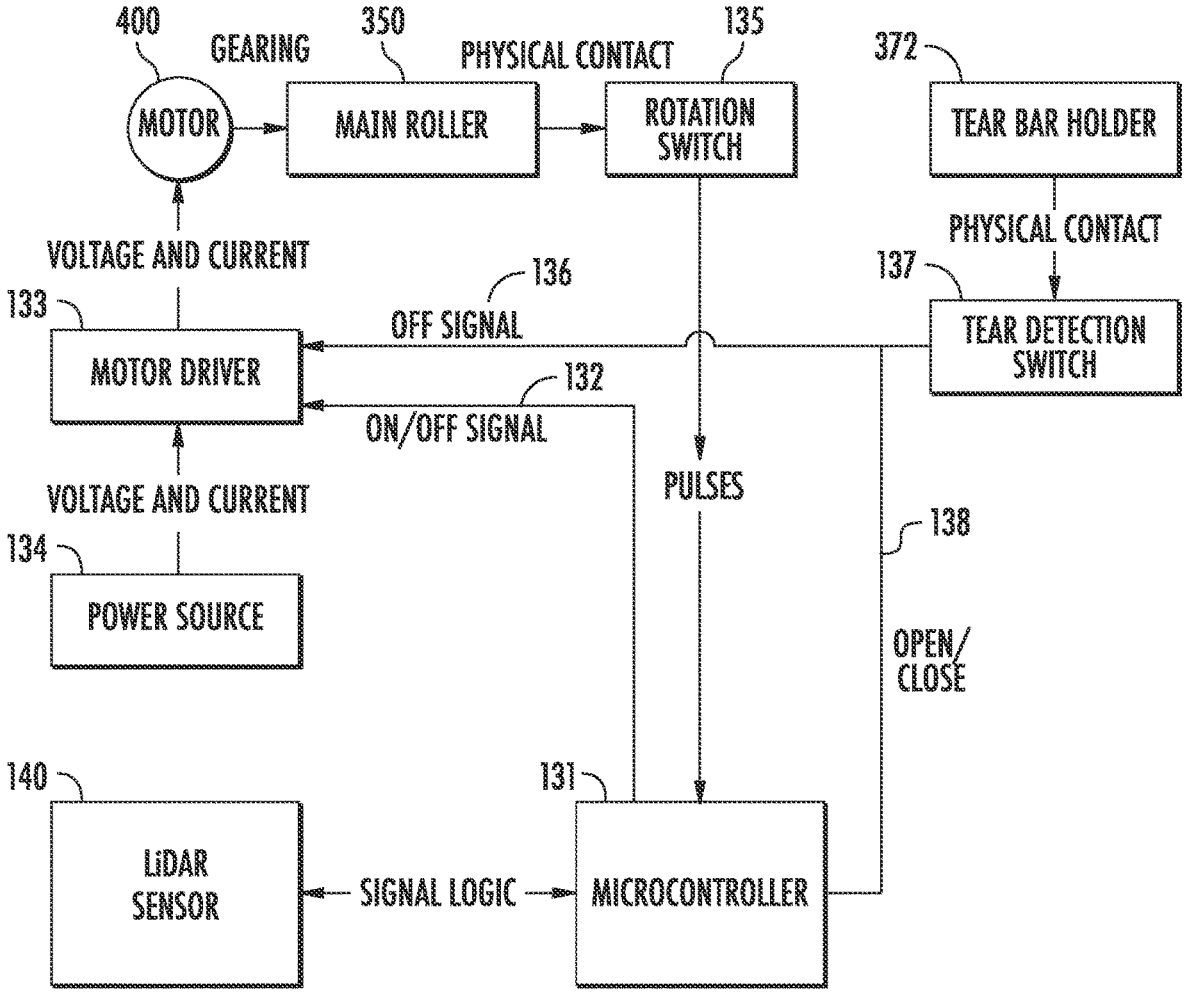
FIG. 11 is a block diagram illustrating the operation of a roll towel dispenser, according to an exemplary embodiment.
Figure 12:
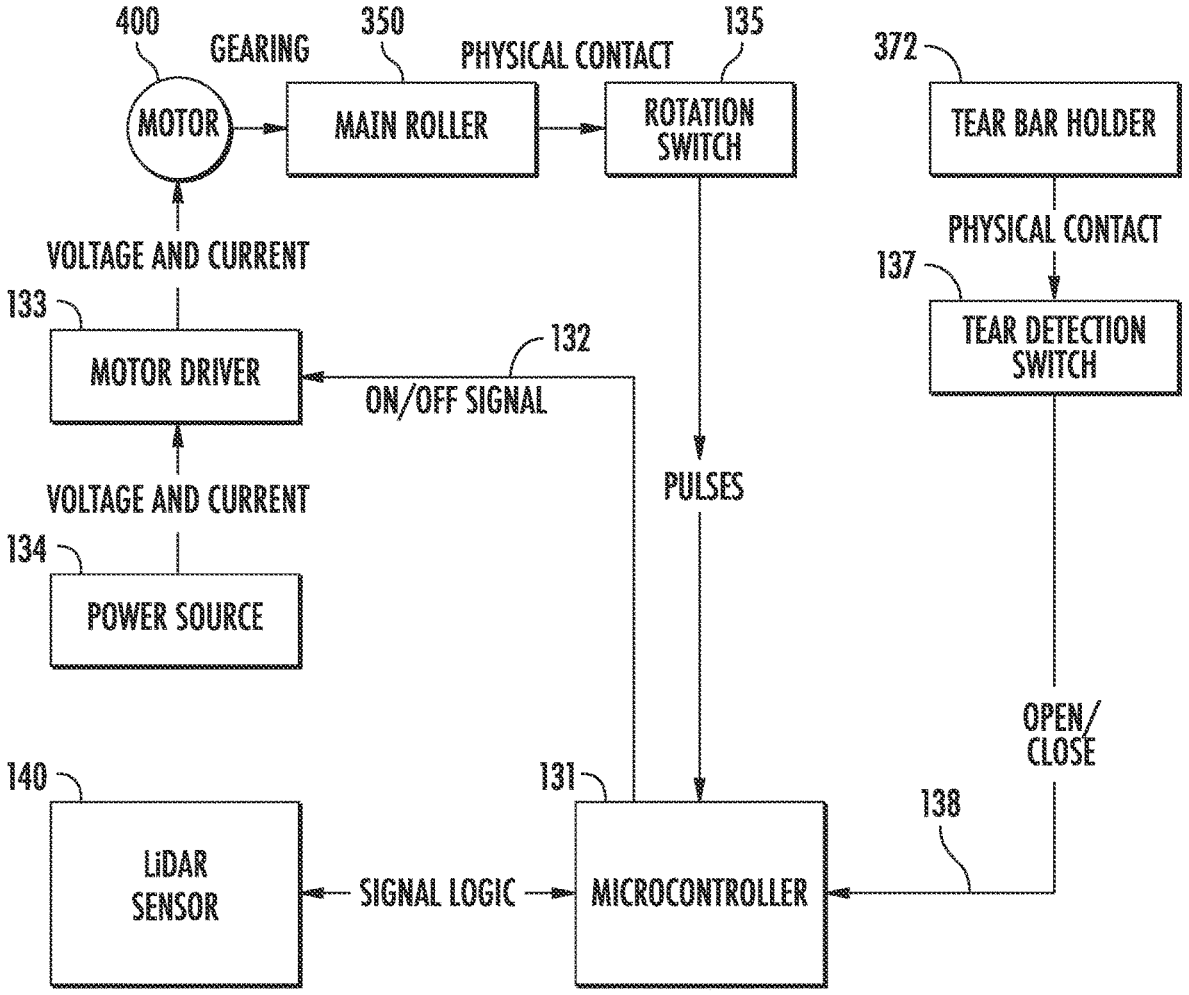
FIG. 12 is a block diagram illustrating the operation of a roll towel dispenser, according to an exemplary embodiment.

Referring generally to FIGS. 11 and 12, a description of the automatic operation of the dispenser 100 may be provided. In one embodiment, a controller, shown as a microcontroller 131, solicits the LiDAR sensor 140 for a range reading. The LiDAR sensor 140 returns data to the microcontroller 131. If the data indicates a user is in the proximity of the dispenser 100 (e.g., within a threshold distance of the LiDAR sensor 140), the microcontroller 131 begins a dispense cycle. The microcontroller 131 sends an "on" signal 132 to control circuitry (e.g., a motor controller), shown as motor driver 133, to pass power from a power source 134 to the motor 400. The motor 400 then starts the paper progression through the dispenser 100. The motor 400 drives the main roller 350 through a series of gears (e.g., the main roller gear 351, the gear 403, the gear 404, the gear 405, and the drive gear 406). As the main roller 350 rotates, the paper may progress through the dispenser 100 and exit through the dispenser opening 150. While the paper is being dispensed by rotating the main roller 350, the lobes 402 of the main roller gear 351 each engage the rotation switch 135, causing the rotation switch 135 to open and close to provide a pulse. Specifically, the lobes 402 push the top leaf spring 408 down into contact with the bottom leaf spring 409 to complete the circuit, which registers a "pulse." Accordingly, the lobes 402 and the leaf springs 408, 409 collectively form the rotation switch 135. In the configuration shown in FIG. 6D where the main roller gear 351 has four lobes 402, each pulse corresponds to a quarter turn of the main roller 350. The microcontroller 131 may count these pulses to determine a length of paper dispensed. In addition, the microcontroller 131 may keep track of the total length of paper dispensed per roll.

Various operational characteristics of the dispenser 100 are now described. Operation may be described when a user pulls on an exposed end of the paper prior to the dispense cycle being completed. A force of the user pulling on the exposed end of the paper may cause the paper to exert a force on the tear bar 370. The tear bar 370 may be rigidly affixed to the tear bar holder 372. The pulling of the paper may move (in particular, rotate) the tear bar holder 372. As the tear bar holder 372 rotates, a frontwardly extending projection or member, shown as tear bar holder arm 375, of the tear bar holder 372 comes into contact with a tear detection sensor, shown as tear detection switch 137, actuating the tear detection switch 137. The tear detection switch 137 may send a signal to the motor driver 133, indicating that a tearing event (i.e., a removal or disconnection of paper towel from the dispenser 100 by a user) is occurring/has occurred. The tear detection switch 137 may send an "open/close" (or on/off) signal 138 to the microcontroller 131, indicating that a tearing event is occurring/has occurred. The motor driver 133 continues the flow of power to the motor 400 from the power source 134 such that the registration or detection of the tearing event does not turn off the motor 400. In this regard and in this embodiment, the microcontroller 131 may interpret the signal as indicating that a tearing event has occurred, but continue dispensing paper subsequently. The dispensing of paper continues until the number of pulses (e.g., as detected from the interaction of the lobes 402 with the rotation switch 135) reaches a predefined number. The predefined number corresponds with a desired length of paper dispensed. For example and as mentioned above, each rotation of the main roller 350 may correspond with 4 pulses (corresponding to the four lobes 402). Using a correlation of revolutions to dispensed paper length (which is determined by experimental data or, in another embodiment, may be estimated based on the circumference of the main roller), the counted pulses are indicated of a total dispensed amount of paper. Thus, in this embodiment, the detected tearing event does not control operation of the motor 400.

The operation of the dispenser 100 is described when a user pulls on an exposed end of the paper prior to the dispense cycle being completed. When the user does not tear paper from the roll prematurely (i.e., before the end of the cycle), the microcontroller 131 determines when the counted number of pulses reaches the predetermined total number of pulses and sends an "off" signal 136 to the motor driver 133 to stop the motor when the counted number of pulses reaches the predetermined number. In response to the "off" signal 136, the motor driver 133 may cease the flow of power to the motor 400 from the power source 134.

Referring now to FIG. 11, a block diagram showing operation of the dispenser 100 is depicted according to an alternate embodiment. FIG. 11 depicts when a user pulls on an exposed end of paper towel from the dispenser 100. As shown, in FIG. 11, after the tear detection switch 137 is activated, the tear detection switch 137 sends a command, shown as "off" signal 136, to the motor driver 133, indicating that a tearing event is occurring/has occurred. In response to receiving the "off" signal 136, the motor driver 133 ceases the flow of power to the motor 400 from the power source 134. The microcontroller 131 may interpret the "off" signal 136 as indicating that a tearing event has occurred. In contrast to the earlier described embodiment, here, the motor 400 is turned off responsive to the detected tearing event.

Referring next to FIG. 12, a block diagram showing operation of the dispenser 100 is depicted according to another alternate embodiment. As shown in FIG. 12, after the tear detection switch 137 is activated, the tear detection switch 137 may send an "on/off" signal or "open/close" signal 138 to the microcontroller 131, indicating that a tearing event has occurred/is occurring. The microcontroller 131 may send a command, shown as "off" signal 132, to the motor driver 133 in response to receiving the "open/close" signal 138. In response to receiving the "off" signal 132, the motor driver 133 ceases the flow of power to the motor 400 from the power source 134. This end result is similar to that described above with respect to FIG. 11. However, in contrast to FIG. 11, the tear detection switch 137 does not send a signal directly to the motor driver 133.

Figure 13:
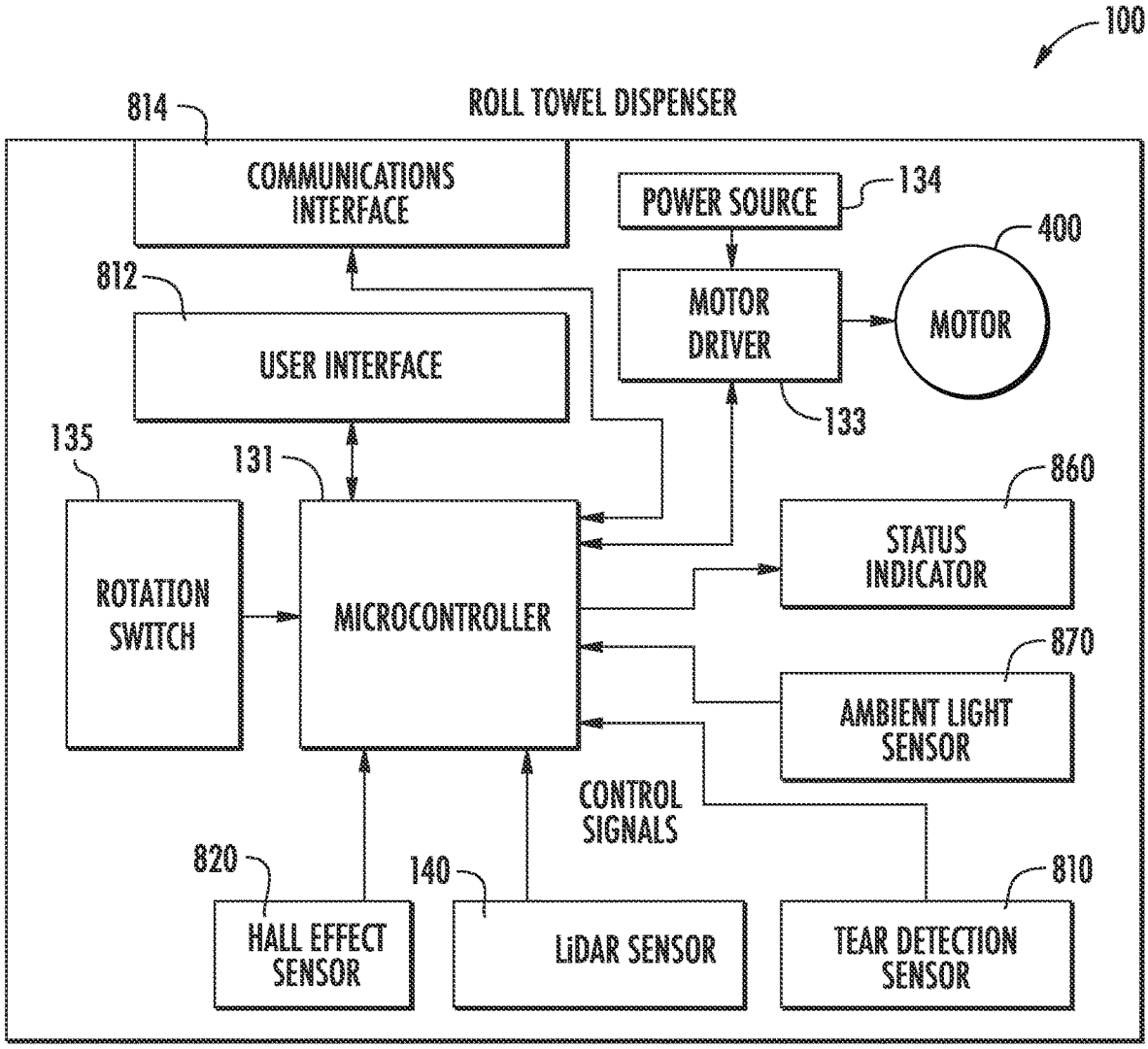
FIG. 13 is a block diagram showing various components of the roll towel dispenser of FIG. 1.
Figure 14:
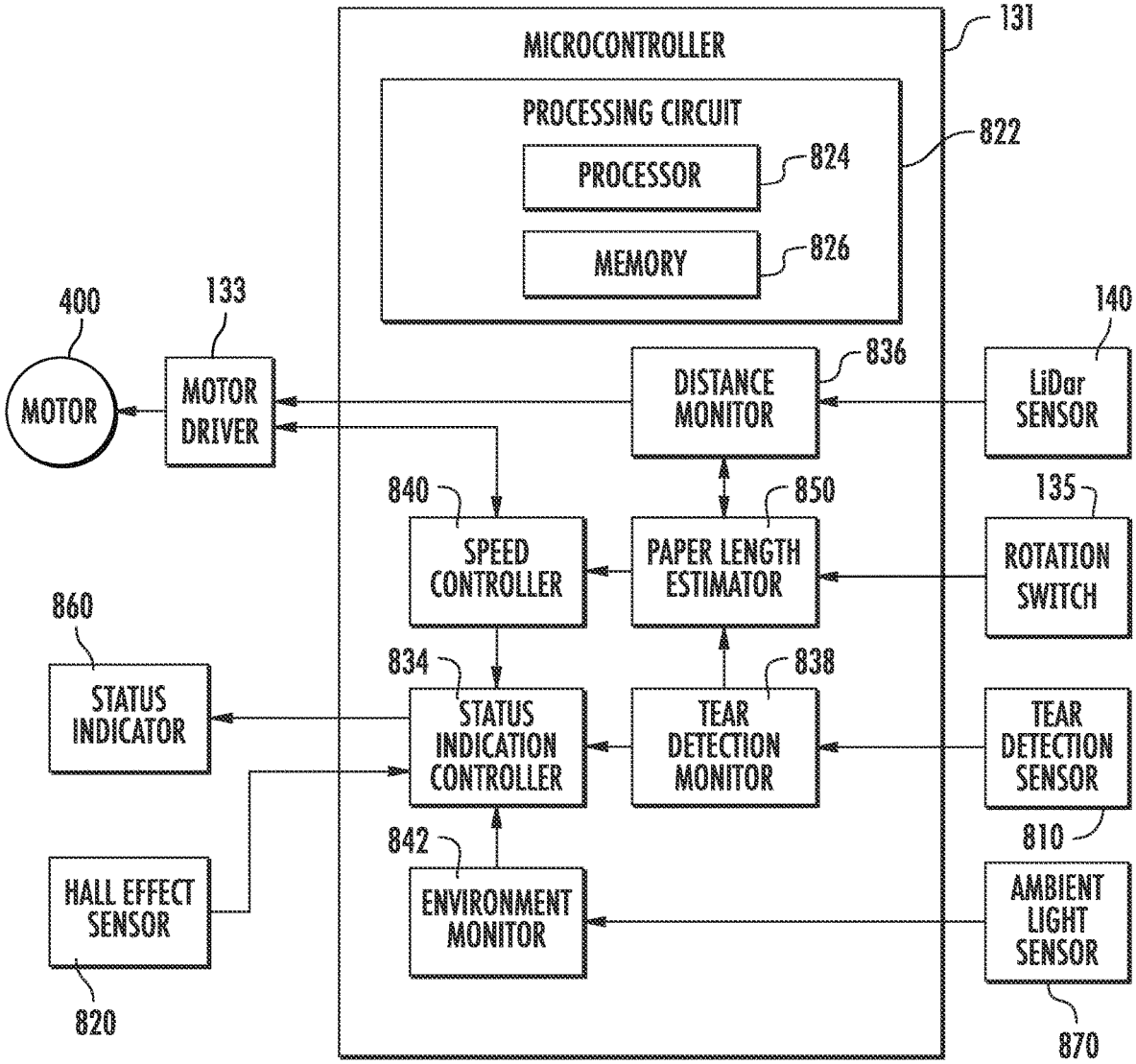
FIG. 14 is a block diagram illustrating a microcontroller of the roll towel dispenser of FIG. 1.
Figure 15:
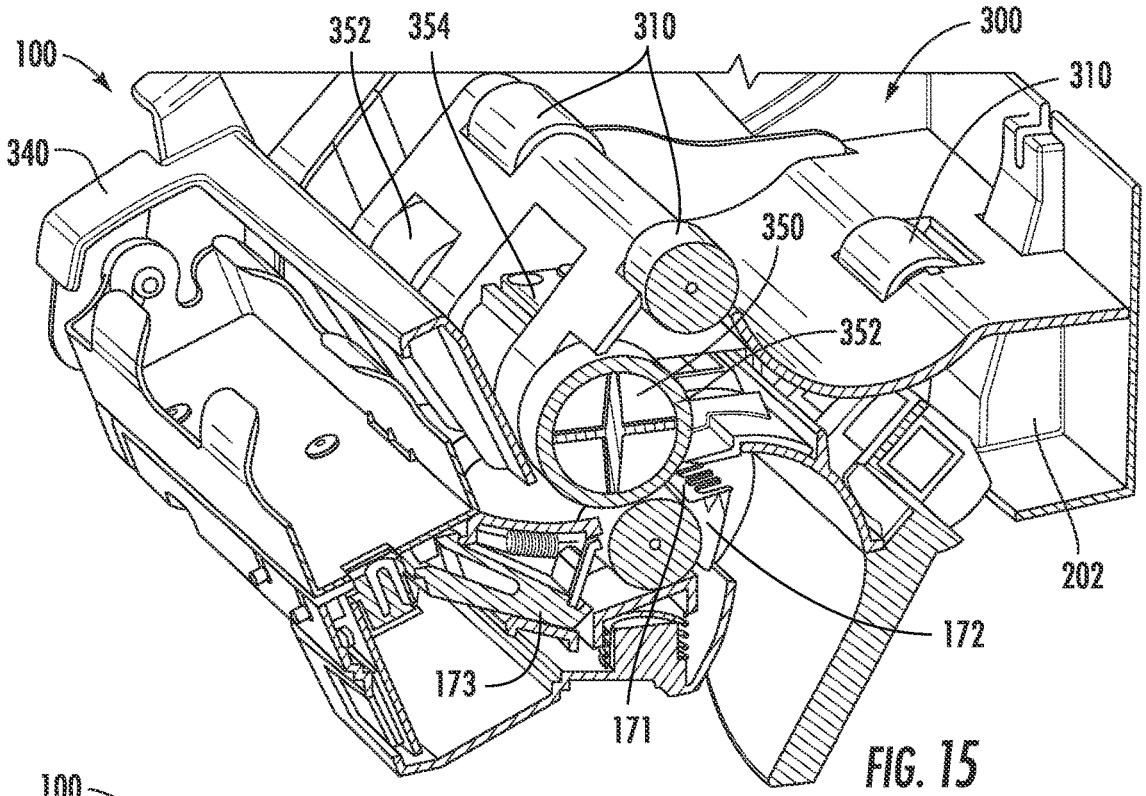
FIG. 15 is a perspective cross-sectional view of a roll towel dispenser with various components removed to show a guide fan, according to another exemplary embodiment.

Referring now to FIGS. 13 and 14, a schematic illustrating various components of the dispenser 100 is shown. As shown, the dispenser includes a motor 400, a microcontroller 131, a LiDAR sensor 140, a tear detection sensor 810, a user interface 812, a status indicator 860, and an ambient light sensor 870. The dispenser 100 additionally includes a hall effect sensor 820. It should be understood that any of the components depicted in FIGS. 13 and 14 may be included with other embodiments of the dispenser 100 (e.g., in the embodiments shown in the earlier figures) unless otherwise indicated.

The microcontroller 131 is configured to operate the motor 400 to control the amount of paper dispensed from the stub roll 210 and/or the reserve roll 220. While shown and described herein as a microcontroller, in other embodiments, the "microcontroller 131" can take a different structure and as a result need not be a "microcontroller." Therefore, this description is not meant to be limiting.

In some embodiments, the microcontroller 131 is configured to prevent the motor 400 from activating multiple times within a given time window (e.g., a predetermined time period, more than once per a five second time window, etc.). Additionally, in some situations, continued exposure of the LiDAR sensor 140 to sunlight may cause the LiDAR sensor 140 to output a signal that would be interpreted as the presence or movement of a user. Without such limitations on dispensing, such a signal could trigger continuous activation of the motor 400 and, in turn, continuous unwanted dispensing of paper (e.g., dispensing when no user is present). As a result, the microcontroller 131 can implement a time delay between the times at which the motor 400 is activated to ensure that a predetermined amount of time has elapsed between consecutive dispensing actions (e.g., dispensing a predetermined amount of paper). The maximum amount of allowed cycles (e.g., where a cycle is defined as dispensing the predefined amount of paper, such as 4 revolutions of the main roller 350, etc.) may be limited to a predefined number without actuation of the tear detection switch 137. In this regard, if the microcontroller does not receive an indication that the tear detection switch 137 has been actuated after the predefined number of cycles (e.g., 3, 4, etc.) which may indicate that a substantial and/or desired amount of paper has been dispensed, the microcontroller 131 may cease operation of the motor 400 until receiving an indication or signal that the tear detection switch 137 has been engaged. By way of example, a user may initiate dispensing of paper by moving within the range of the LiDAR sensor 140, causing the microcontroller 131 to control the motor 400 to dispense a predetermined amount of paper. The microcontroller 131 may then prevent further driving of the motor 400 until the tear detection switch 137 indicates that the user has torn and retrieved the dispensed paper. This beneficial feature is referred to as an anti-paper loss function or feature.

In some embodiments, the microcontroller 131 includes an anti-vandalism function or feature. A user may attempt to vandalize the dispenser 100 by blocking the LiDAR sensor 140 (e.g., by placing gum or another type of obstruction over the LiDAR sensor 140). When the LiDAR sensor 140 is obstructed, the LiDAR sensor 140 may continuously provide a signal indicating that paper is being solicited. By way of example, the LiDAR sensor 140 may provide a first signal (e.g., a high voltage) when an object (e.g., a user) is outside of a sensing range and a second signal (e.g., a low voltage) when an object is within the sensing range. The LiDAR sensor 140 may not differentiate between the object being a user and the object being an obstruction. Alternatively, the LiDAR sensor 140 may malfunction (e.g., due to wear or corrosion) such that the LiDAR sensor 140 provides a signal indicating a continuous solicitation of paper (e.g., a low voltage corresponding to detection of an object within the sensing range). In response to detecting a continuous solicitation signal (e.g., a solicitation signal that continues for more than a threshold period of time) from the LiDAR sensor 140, the microcontroller 131 may switch the operating mode of the dispenser 100 to an exposed mode. In the exposed mode, the microcontroller 131 may control the motor 400 such that a tail of paper towel is exposed or extends outward from the dispenser 100 until it is removed by a user. Once the paper towel is removed, the microcontroller 131 may automatically dispense a new tail. In this mode, the LiDAR sensor 140 is not relied upon. Rather, tearing of the exposed paper causes actuation of the motor 400 to drive more paper being dispensed. Beneficially, this anti-vandalism feature avoids continuous dispensing of paper towel from the dispenser 100.

Referring to FIG. 14, in an alternate embodiment, the microcontroller 131 includes control circuitry, shown as speed controller 840, which communicates with the motor driver 133 to control the speed of motor 400. The speed controller 840 can be configured to operate the motor 400 by generating and providing control signals to the motor driver 133, which in turn provides electrical energy to the motor 400. The control signals provided to the motor driver 133 can cause the motor 400 to activate, deactivate, or achieve a variable capacity or speed (e.g., operate at half speed, operate at full speed, etc.). For example, the microcontroller 131 can operate the motor 400 at a first (e.g., fast) speed to dispense paper quickly, and a second (slow) speed to dispense paper more slowly. The speed controller 840 can be configured to adjust the speed at which dispensing occurs while dispensing is in progress. In some embodiments, the speed controller 840 causes the paper to be dispensed more quickly at the beginning of the dispensing process and more slowly toward the end of the dispensing process. In some embodiments, the speed controller 840 is configured to turn the motor 400 on or off (e.g., by sending an "on" or "off" command to the motor driver 133).

The status indicator 860 may be or include a light (e.g., an LED light coupled to the outer shell 120), an audio device (e.g., a speaker), a display, a haptic feedback device (e.g., a vibration motor), or any other device capable of providing information to a user. The status indicator 860 may be provided on or as part of the user interface 812. The status indicator 860 may provide indications regarding the operational status of the dispenser 100. By way of example, an operational status may be indicated by a green light while a blinking red light may indicate a paper jam or other non-operational status. The user interface 812 may indicate information such as an amount of paper remaining in the dispenser 100 (e.g., that one or both of the paper towel rolls are depleted or nearly depleted), or the estimated time until the paper will need to be reloaded. The user interface 812 may be positioned, for example, proximate the LiDAR sensor 140, or on another area on the front portion 121 of the dispenser 100. It should be understood that the user interface 812 may include more than one individual user interfaces: for example, a first user interface may be positioned by the LiDAR sensor 140 while a second user interface is positioned on the interior of the dispenser 100. All such variations are intended to fall within the scope of the present disclosure.

In some embodiments, the dispenser 100 includes a communications interface 814 (e.g., a USB port, a wireless transceiver, etc.) configured to receive and/or transmit data. The communications interface 814 may include wired and/or wireless communications interfaces (e.g., jacks, antennas, transmitters, receivers, transceivers, wire terminals, etc.) for conducting data communications to external systems or devices (e.g., smartphones, servers, laptops, other dispensers 100, etc.). In various embodiments, the communications may be direct (e.g., a local wired or wireless communications) or conducted over a communications network (e.g., a WAN, the Internet, a cellular network, etc.). The communications interface 814 may also include a Wi-Fi transceiver or a cellular or mobile phone communications transceiver for communicating over a wireless communications network. For example, the communications interface 814 may transmit a message over a wireless internet connection to a device linked to user. Such a message may include status information, such as the amount of paper towel remaining in the dispenser 100.

The microcontroller 131 may be communicably coupled to a sensor, such as tear detection sensor 810. The tear detection sensor 810 is configured to acquire data to detect when a tearing event occurs (e.g., provide a tear detection signal indicating that a tearing event has occurred). The tear detection sensor 810 may be or include any of the tear detection sensors discussed herein (e.g., the tear detection switch 137, the tear detection switch 196, etc.). The tear detection sensor 810 may be an on/off momentary switch. When actuated "on," (e.g., when going from a closed state to an open state, when going from an open state to a closed state, etc.), the tear detection sensor 810 may send a signal (e.g., a voltage or current) representing the detection of a tearing event. The tear detection switch 137 may be substantially similar to the tear detection switch 196 except as otherwise stated. In operation, the tear bar holder 372 may engage the tear detection sensor 810 to register an "on" condition, which represents a tearing event being detected. In other embodiments, different configurations of a tear detection sensor 810 may be used to detect and determine when tearing events occur (e.g., when the tear bar holder 372 and tear bar holder arm 194 move). Additionally or alternatively, the tear detection sensor 810 can include a pressure sensor (e.g., a strain gauge may be disposed on the tear bar holder 372 to detect pressure applied to the holder, which may be indicative of a tearing event), a light interrupter or break beam sensor that detects when the tear bar holder arm 194 interrupts a beam of light to indicate a tearing event, and/or a variety of other sensors. Thus, the description and depiction herein of the tear detection sensor 810 as a momentary switch is not meant to be limiting.

In some embodiments, the microcontroller 131 utilizes information regarding when a tearing event is detected to limit the length of paper dispensed from the dispenser 100 to be less than or equal to a threshold length between consecutive tearing events. In some embodiments, the microcontroller 131 includes control circuitry, shown as paper length estimator 850. The paper length estimator 850 may be configured to utilize the number of rotations of the main roller 350 (e.g., as measured using the rotation switch 135) to determine an amount of paper dispensed. The relationship between the rotation of the main roller 350 and the amount of paper dispensed may be predetermined geometrically (e.g., using the circumference of the main roller 350, etc.) or experimentally and stored in the paper length estimator 850. The microcontroller 131 can be configured to deactivate the motor 400 after a maximum allowable amount of paper has been dispensed or unwound from the roll. This amount can be reset when the tear detection sensor 810 is actuated (e.g., when the paper is torn from the roll). In this way, the microcontroller 131 can ensure that the amount of paper dispensed is limited to a threshold length until the paper is torn from the roll. The microcontroller 131 can perform these steps as part of a tear roll detection process to determine whether to continue dispensing roll towel or to cease dispensing.

The microcontroller 131 may be communicably coupled to a light sensor (e.g., a photoresistor), shown as ambient light sensor 870, which may be positioned, for example, proximate the LiDAR sensor 140. The ambient light sensor 870 may detect the, intensity, brightness or amount of the light in the proximity of the dispenser 100 and may communicate with control circuitry of the microcontroller 131, shown as environment monitor 842. The ambient light sensor 870 and the environment monitor 842 may cooperate to measure a level of light (e.g., ambient light), compare this measurement to a predetermined light level threshold (e.g., stored by the environment monitor 842), and determine an operating mode of the dispenser 100 (e.g., a normal operating mode, a low power mode, etc.). For example, if the level of light sensed by the ambient light sensor 870 is below the predetermined light level threshold for a certain (e.g., predetermined, threshold, etc.) period of time (which may be predefined and configurable in the environment monitor 842), the microcontroller 131 may switch the unit into a low power mode. In this way, the ambient light sensor 870 may determine, for example, when a room is dark (e.g., when it is unlikely that a user is present). In the low power mode, the microcontroller 131 may suspend, disable, or otherwise reduce the operation of certain features of the dispenser 100 (e.g., the LiDAR sensor 140) to reduce power consumption. By way of example, the microcontroller 131 may disable the LiDAR sensor 140 entirely. By way of another example, the microcontroller 131 may reduce the operation of the LiDAR sensor 140 to operate less frequently (e.g., from sensing once per 0.1 second to once per 10 seconds). Upon receiving a signal (e.g., a change in a measured ambient light level from the ambient light sensor 870 or a detection by the tear detection sensor 810), the microcontroller 131 may return to a normal operating mode. Such a configuration may be advantageous when the dispenser 100 is powered by a battery given that LiDAR sensors typically consume more power than other types of sensors. Accordingly, the environment monitor 342 and the ambient light sensor 870 may facilitate prolonged operation of the dispenser 100 between battery replacements.

As shown in FIGS. 13 and 14, the microcontroller 131 is coupled to another sensor, hall effect sensor 820, according to an alternate embodiment. The hall effect sensor 820 may monitor when the transfer from the stub roll 210 to the reserve roll 220 occurs. This information can be stored by the microcontroller 131 (e.g., within the dispenser 100) and/or communicated to an external system or device (e.g., through a wired or wireless network). Advantageously, this information can be used to determine when the reserve roll 220 requires replacement before dispenser 100 is completely out of paper. This component may be an add-on when the dispenser 100 includes the communications interface 814 such that remote personnel (e.g., people or other monitors disposed geographically away from the dispenser 100) can monitor when transfers occur.

Referring to FIG. 14, a block diagram illustrating the microcontroller 131 is shown, according to an exemplary embodiment. The microcontroller 131 is shown to include a processing circuit 822 including one or more processors 824 coupled to one or more memory devices 826. The processor 824 is configured to execute computer code or instructions stored in the memory 826 or received from other computer readable media (e.g., CDROM, network storage, a remote server, etc.).

FIG. 14 shows the microcontroller 131 as including various control circuitry comprising the status indication controller 834, the distance monitor 836, the tear detection monitor 838, the speed controller 840, the environment monitor 842, the paper length estimator 850, etc. that is separate from the processing circuit 822. In one embodiment and as shown, any such control circuitry may be part of the processing circuit 822 and, in particular, stored as instructions within the memory for execution by the processor 824. In this regard, the depicted control circuitry may be embodied as machine or computer-readable media that is executable by a processor, such as the processor 824. Amongst other uses, the machine-readable media facilitates performance of certain operations described herein, such as enabling the reception and transmission of data. For example, the machine-readable media may provide an instruction (e.g., command, etc.) to, e.g., acquire data. In this regard, the machine-readable media may include programmable logic that defines the frequency of acquisition of the data (or, transmission of the data). Thus, the computer readable media may include code, which may be written in any programming language including, but not limited to, Java or the like and any programming languages, such as the "C" programming language or similar programming languages. The computer readable program code may be executed on one processor or multiple processors of the processor 824.

In other embodiments, any such control circuitry may be separate components from the microcontroller 131 that include its own dedicated components (processing circuits, etc.). In this configuration, the control circuitry may take the form of one or more analog circuits, electronic circuits (e.g., integrated circuits (IC), discrete circuits, system on a chip (SOCs) circuits, microcontrollers, etc.), telecommunication circuits, hybrid circuits, and any other type of "circuit." For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on. In this embodiment, the control circuitry may also include programmable hardware devices such as field programmable gate arrays, programmable array logic, programmable logic devices or the like. In this regard and as described above, the control circuitry may include one or more memory devices for storing instructions that are executable by the processor (s) of the control circuitry. The one or more memory devices and processor(s) may have the same definition as provided below with respect to the memory 826 and the processor 824. That said, in the embodiment depicted and as mentioned above, the control circuitry are embodied as machine or computer-readable media that may be stored in the memory 826 (despite being depicted outside of the memory 826).

The processor 824 may be implemented as one or more general-purpose processors, an application specific integrated circuit (ASIC), one or more field programmable gate arrays (FPGAs), a digital signal processor (DSP), a group of processing components, or other suitable electronic processing components. The one or more processors may be structured to perform or otherwise execute certain operations independent of the one or more co-processors. In other example embodiments, two or more processors may be coupled via a bus to enable independent, parallel, pipelined, or multi-threaded instruction execution. All such variations are intended to fall within the scope of the present disclosure.

The memory 826 (e.g., RAM, ROM, Flash Memory, hard disk storage, etc.) may include one or more devices (e.g., memory units, memory devices, storage devices, etc.) for storing data and/or computer code for completing and/or facilitating at least some of the processes described in the present disclosure. The memory 826 may be coupled to the processor 824 and may include computer code for executing (e.g., by the processor 824) one or more processes described herein. Moreover, the memory 826 may be or include tangible, non-transient volatile memory or non-volatile memory. Accordingly, the memory 826 may include database components, object code components, script components, or any other type of information structure for supporting the various activities and information structures described herein. When the processor 824 executes instructions stored in the memory 826, the processor 824 generally configures the microcontroller 131 (and more particularly the processing circuit 822) to complete such activities.

As alluded to above, the microcontroller 131 is shown to include control circuitry including a status indication controller 834. The status indication controller 834 can be configured to operate the status indicator 860. The control signals provided to the status indication controller 834 can cause the status indicator 860 to display a message or illuminate a light (e.g., to provide information to a user).

The ambient light sensor 870 can detect the brightness or amount of the light in the proximity of the dispenser 100 and may communicate with the environment monitor 842. The environment monitor 842 may control the operation of the dispenser 100 based on information from the ambient light sensor 870. By way of example, upon sensing that the lights in room in which the dispenser 100 are located are off, the environment monitor 842 may send a signal to the microcontroller 131 to switch the dispenser 100 to a low power mode. In the low power mode, the microcontroller 131 may suspend the operation of features of the dispenser 100 to reduce power consumption, and upon receiving a signal (e.g., a change in a measured ambient light level from the ambient light sensor 870 or an on/off signal provided by the tear detection sensor 810), the microcontroller 131 may return to a normal operating mode. In this way, the environment monitor 842 can determine or select an operational state of the dispenser 100 (e.g., the normal operating mode or the low power mode). The environment monitor 842 can track the signals received from the ambient light sensor 870 and store them in the memory 826. In this way, the environment monitor 842 may beneficially reduce the power draw from the dispenser 100. In addition, the environment monitor 842 can communicate with the status indication controller 834. For example, the environment monitor 842 can communicate the current operating mode of the dispenser 100 to the status indication controller 834. In response, the status indication controller 834 may direct the status indicator 860 to indicate the operating mode (e.g., by displaying the operating mode on a status indicator screen, by illuminating a corresponding light, etc.).

The LiDAR sensor 140 can detect the presence of a user and send a signal to control circuitry, shown as distance monitor 836. The distance monitor 836 may be configured to use information from the LiDAR sensor 140 to determine a distance between an object (e.g., a user) and the LiDAR sensor 140. The distance monitor 836 may be configured to send a signal to the motor controller 832 (e.g., directly, through the speed controller 840, etc.) to activate the motor 400. By way of example, the distance monitor 836 may send a signal to the motor controller 832 to activate the motor 400 when a distance between the distance between the object and the LiDAR sensor 140 is less than a threshold distance, or when a rate of change of the distance between the object and the LiDAR sensor 140 is greater than a threshold speed.

Referring still to FIG. 14, the distance monitor 836 may additionally or alternatively be configured to communicate with control circuitry, shown as paper length estimator 850 (when embodied as separate components). The paper length estimator 850 determines the number of revolutions of the main roller 350 based on an input from the rotation switch 135 (e.g., four open/close cycles of the rotation switch 135 corresponds to one revolution of the main roller 350, etc.). The paper length estimator 850 can be used to count (e.g., store the quantity of) the revolutions of the main roller 350. The paper length estimator 850 may use a correlation (e.g., a mathematical formula predetermined and stored in the memory 826) to measure or estimate the amount of paper dispensed based on the number of revolutions of the main roller 350. The paper length estimator 850 may additionally or alternatively receive information relating to the occurrence of a tearing event. By way of example, control circuitry, shown as tear detection monitor 838, may notify the paper length estimator 850 that a tearing event has occurred based on signals from the tear detection sensor 810. The paper length estimator 850 may store the total number of tearing events. The microcontroller 131 can be configured to deactivate the motor 400 after the paper length estimator 850 determines that the maximum allowable amount of paper has been dispensed or unwound from the roll. The paper length estimator 850 may prevent further operation of the motor 400 until the paper length estimator 850 determines that another tearing event has occurred. In this way, the microcontroller 131 can ensure that the amount of paper dispensed is limited to a threshold length until the paper is torn from the roll. The microcontroller 131 can perform these steps as part of a tear roll detection process to determine whether to continue dispensing roll towel or to cease dispensing. In another embodiment, the paper length estimator 850 can be configured to send a signal to the motor driver 133 (e.g., directly, through the speed controller 840, etc.) to deactivate the motor 400 after the maximum allowable amount of paper has been dispensed or unwound from the roll. This information can be used to limit the length of paper dispensed from the dispenser 100 to be less than or equal to a threshold length between consecutive tearing events.

In some embodiments, microcontroller 131 (e.g., the distance monitor 836) may monitor the sensor state of the LiDAR sensor 140 to detect potential obstructions of the LiDAR sensor 140 which may hinder proper operation. For example, the LiDAR sensor 140 and/or the distance monitor 836 may be configured to detect criteria (e.g., a sensor reading) consistent with an object obstructing the path of light of the sensor for a specified period of time. By way of example, in an instance where gum might be placed over the window of the LiDAR sensor 140, the LiDAR sensor 140 may indicate a constant presence, such that the light from the LiDAR sensor 140 may be emitted through the window, but the light is unable to be received by the LiDAR sensor 140 for a continuous period of time. The LiDAR sensor 140 may communicate this occurrence to the microcontroller 131, and the microcontroller 131 may switch an operation state of the LiDAR sensor 140 from "hidden" to "exposed." The microcontroller 131 may then determine when to dispense paper based on, for example, a tearing event indication from the tear detection sensor 810. In other words, the microcontroller 131 may register the obstruction of the LiDAR sensor 140 and rely on other features of the dispenser 100 to determine when to initiate dispensing events (e.g., dispensing a predetermined amount of paper). Once the obstruction is removed, the LiDAR sensor 140 may send signals to the microcontroller 131 consistent with normal operation, at which point the LiDAR sensor 140 may be reverted back to "exposed" operating mode, and resume normal operation.

In some embodiments, microcontroller 131 (e.g., the paper length estimator 850) may limit the amount of dispensing events or the length of paper dispensed between tearing events. By way of example, the microcontroller 131 may be configured to deactivate the motor 400 after a predetermined number (e.g., three, etc.) of dispensing events are detected (e.g., corresponding to a maximum allowed amount of paper being dispensed). By way of another example, the microcontroller 131 may be configured to deactivate the motor 400 in response to the paper length estimator 850 indicating the maximum allowed amount of paper has been dispensed since the last tearing event. The microcontroller 131 may cease activation of the motor 400 (e.g., cease dispensing paper) until the tear detection sensor 810 detects a tearing event, which may be provided to the tear detection monitor 838. Such a configuration may beneficially prevent the dispenser 100 from continuously dispensing paper in an instance where the motor 400 or microcontroller 131 experience an error which causes the motor 400 to activate.

In some embodiments, the speed controller 840 sends signals (e.g., commands) to the motor driver 133 to control operation of the motor 400. By way of example, the speed controller 840 may control an on/off state of the motor 400. By way of another example, the speed controller 840 may control a speed of the motor 400 (e.g., by commanding the motor driver 133 to vary a voltage supplied to the motor 400. The speed controller 840 may be configured to direct the motor 400 to operate at a first fast speed to dispense paper quickly, and a second slower speed to dispense paper more slowly.

Referring now to FIGS. 15-18, another embodiment of the dispenser 100 is shown. The dispenser 100 shown in FIGS. 15-18 may be substantially similar to the other embodiments of the dispenser 100 (e.g., as shown in FIG. 8) except as otherwise specified herein. In this embodiment, the dispenser 100 includes a paper guide, guide member, or set of deflection fingers, shown as guide fan 171, a tear bar 172, a tear bar holder 173 coupled to the tear bar 172, a tear detection sensor, shown as tear detection switch 196, and a circuit board 197. The tear bar holder 173 includes a switch engagement projection, shown as tear bar holder arm 194, and a tear bar holder pivot 195 that pivotally couples the tear bar holder 173 to the frame 202. The guide fan 171 may be coupled (e.g., pivotally, fixedly, etc.) to the frame 202. The guide fan 171 may have a substantially flat top surface. The guide fan 171 is positioned and oriented such that paper engages the top surface of the guide fan 171, and the guide fan 171 guides the paper to over the tear bar 172. The guide fan 171 reduces the chance of the paper snagging or getting jammed during dispensing of paper. The guide fan 171 may have a similar position and orientation to the tear bar holder 372. The guide fan 171 may extend substantially horizontally to facilitate paper flowing over it. The guide fan 171 includes teeth or deflection fingers that protrude substantially horizontally outward from a distal end thereof and at least partly over the tear bar 172. The tear bar 172 is coupled to the tear bar holder 173 and extends substantially vertically upward (e.g., towards a top of the dispenser 100). A lower surface of the tear bar 172 is coupled (e.g., fixedly) to an upper surface of a distal end (e.g., distal from the tear bar holder pivot 195) of the tear bar holder 173 (e.g., by one or more fasteners (e.g., screws, etc.) or an adhesive). An upper end portion of the tear bar 172 defines a series of teeth or deflection fingers that extend upward. The teeth may be positioned between the deflection fingers such that the teeth can extend upward through the deflection fingers as the tear bar 172 moves relative to the guide fan 171. The lower end of the tear bar 172 overlays a portion of the distal end of the tear bar holder 173, such that the tear bar 172 is supported by the tear bar holder 173 along a portion of the length of the tear bar 172. In this way, the tear bar holder 173 may provide additional support to the tear bar 172 during tearing events.

The tear bar holder arm 194 is disposed at an end of the tear bar holder 173 opposite the tear bar 172, and extends substantially horizontally away from the tear bar 172. The tear bar holder 173 is pivotally coupled to an inner surface of the dispenser 100 (e.g., the frame 202) by the tear bar holder pivot 195. Specifically, the tear bar holder pivot 195 may have a generally "C" shape, with the central opening of the "C" shape facing downwards such that the central opening receives a pin, about which the tear bar holder 173 rotates. The pin is positioned within a lower, front portion of the dispenser 100 and extends generally parallel to the front surface of the dispenser 100 such that the tear bar holder 173 rotates about a lateral axis. The pin may extend generally across the width of the dispenser 100, such that the distal ends of the pin may be fixedly received within mating apertures along the inner side walls of the dispenser 100. In this way, the pin may be rotatably received within the tear bar holder pivot 195, and may pivotally couple the tear bar holder 173 to the frame 202 support the tear bar holder 173 within the dispenser 100. The tear bar holder arm 194 and the tear bar holder 173 may be substantially similar to the tear bar holder arm 375 and the tear bar holder 372 shown in FIG. 8. In both embodiments, the tear bar holder also includes a tear bar holder arm that selectively contacts the tear detection switch 137.

The circuit board 197 may be coupled to an inner surface of the dispenser 100 (e.g., the frame 202). Specifically, the circuit board 197 is coupled (e.g., mounted with one or more fasteners) to the frame 202 along the front portion of the dispenser 100, and extends substantially downward from the frame 202. The circuit board 197 includes a tear detection switch 196 protruding from a lower end of the circuit board 197. The tear detection switch 196 is configured to at least selectively engage the tear bar holder arm 194. During a tearing event, a downward force may be applied to the tear bar 172 by the paper, causing the tear bar holder 173 to pivot about the lateral axis extending through the tear bar holder pivot 195. Due to the position of the tear bar holder arm 194 opposite the tear bar 172, a downward movement of the tear bar 172 has a corresponding upward movement of the tear bar holder arm 194. The tear detection switch 196 is positioned such that the upward rotation of the tear bar holder arm 194 during a tearing event causes the tear bar holder arm 194 to engage and depress the tear detection switch 196, indicating to the microcontroller 131 that a tearing event has occurred. As mentioned above, the tear detection switch 137 and the tear detection switch 196 are structured as momentary switches that register detections when actuated.

Figure 16:
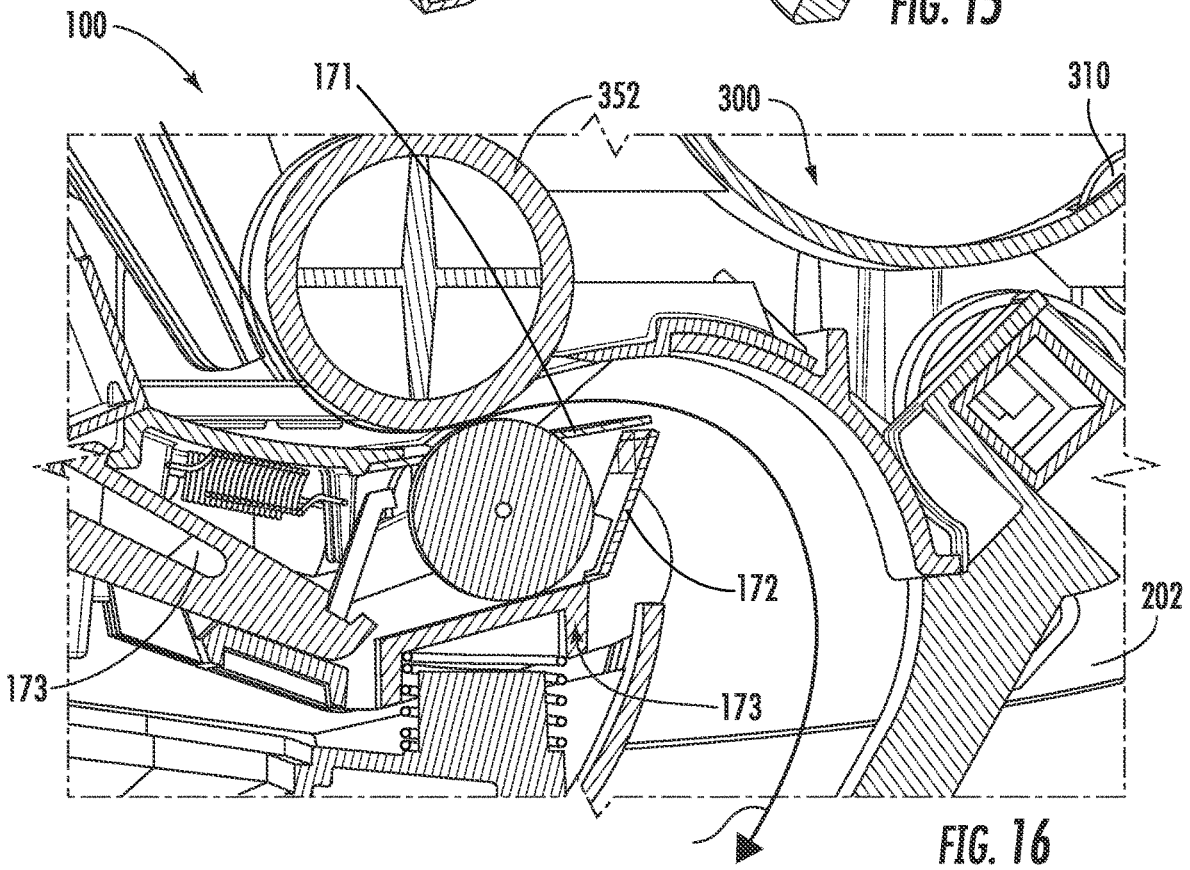
FIG. 16 is a side cross-sectional view of the roll towel dispenser of FIG. 15 with various components removed to show the flow of paper in greater detail.
Figure 17:
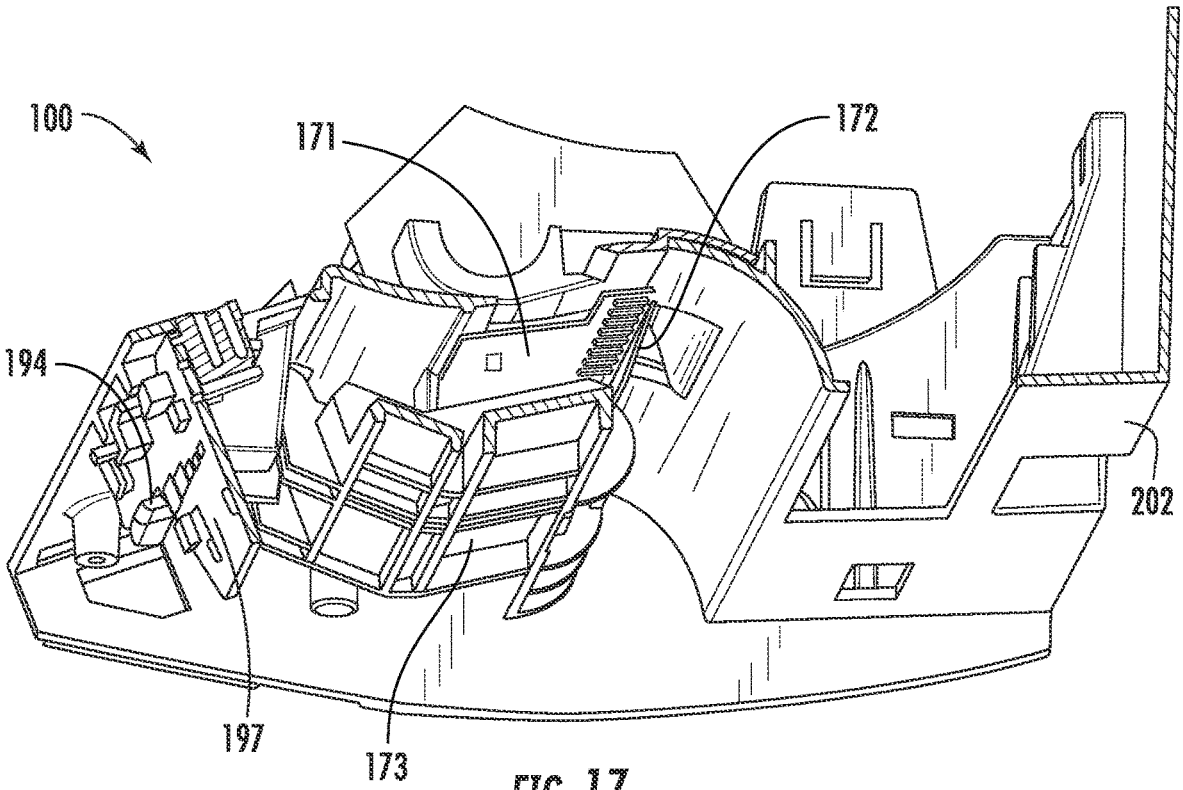
FIG. 17 is another perspective cross-sectional view of the roll towel dispenser of FIG. 15 with various components removed in order to show the guide fan and circuit board in more detail.
Figure 18:
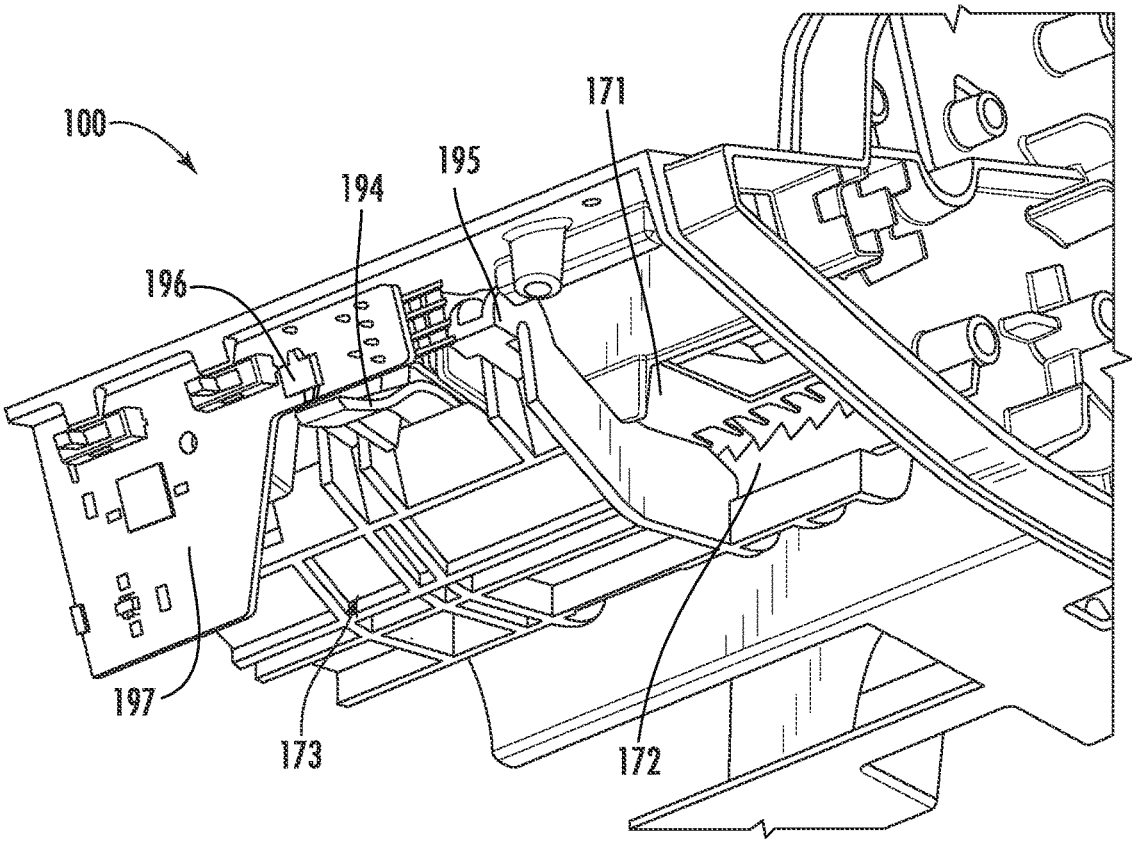
FIG. 18 is yet another perspective cross-sectional view of the roll towel dispenser of FIG. 15 with various components removed to show the tear bar holder, tear bar holder arm, tear bar holder pivot, switch, and circuit board in greater detail.

As shown in FIG. 16, the paper may flow substantially horizontally over the guide fan 171, and may then fall downward over the tear bar 172. When a user pulls on the paper, the paper may place a downward force on the guide fan 171, causing the guide fan 171 to deflect downward. In some embodiments, the guide fan 171 is pivotally coupled to the frame 202, and the downward movement of the guide fan 171 corresponds to rotation of the guide fan 171 (e.g., about a lateral axis). In other embodiments, the guide fan 171 is fixedly coupled to the frame 202, and the downward movement of the guide fan 171 corresponds to bending of the guide fan 171 (e.g., about a lateral axis). As the guide fan 171 deflects downward, the paper comes into direct contact with the tear bar 172 (e.g., with the teeth of the tear bar 172), causing the paper to tear. The teeth of the tear bar 172 may be sharpened to facilitate tearing of the paper. As the tear bar 172 has a downward force exerted on it, the force causes the tear bar holder 173 to pivot about the tear bar holder pivot 195. In this regard, the tear bar 172 also moves downward. As this occurs, the tear bar holder arm 194 rotates upward (i.e., due to the rotation of the tear bar holder 173 about the tear bar holder pivot 195) and contacts the tear detection switch 196 on the circuit board 197. The tear detection switch 196 may send a signal to the microcontroller 131, indicating that a tearing event has occurred.

Figure 19:
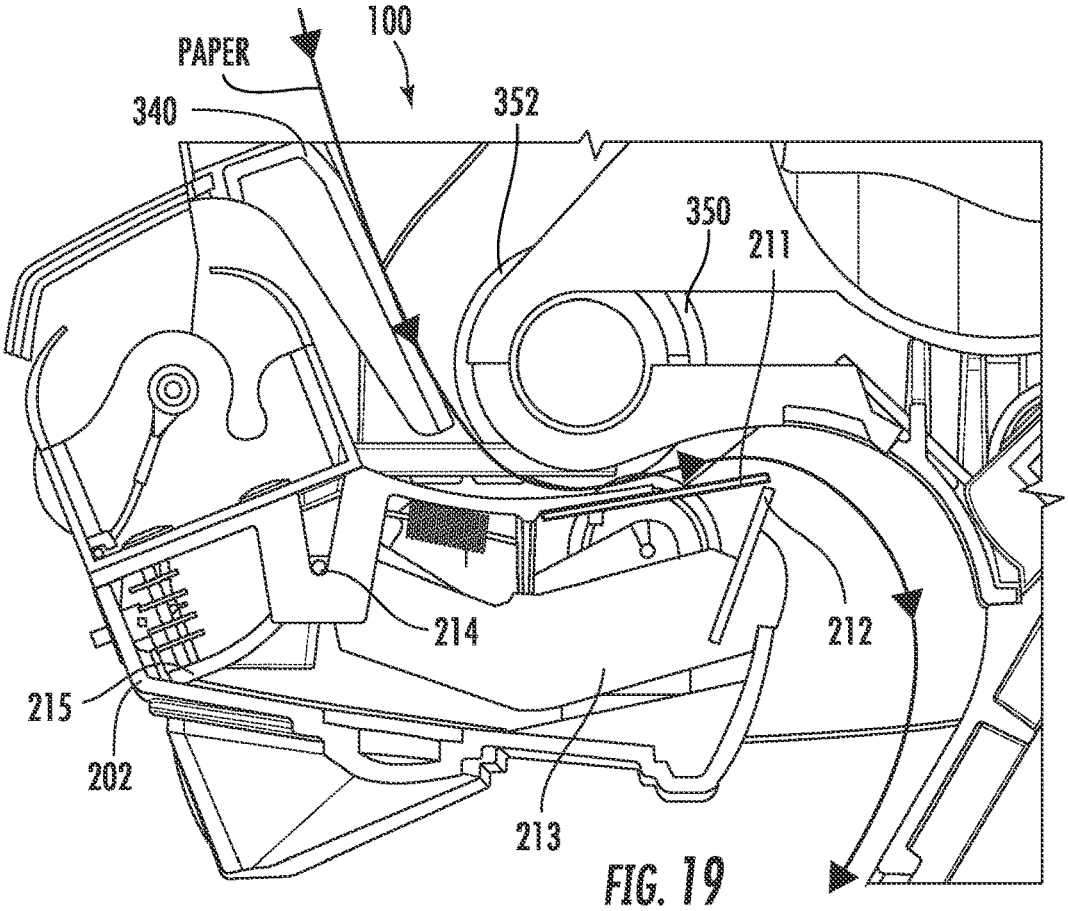
FIGS. 19-24 are side cross-sectional views of roll towel dispensers, according to various exemplary embodiments.

Referring now to FIG. 19, the dispenser 100 is shown according to another alternate embodiment. The dispenser 100 shown in FIG. 19 may be substantially similar to the other embodiments of the dispenser 100 (e.g., as shown in FIGS. 15-18) except as otherwise specified herein. In this embodiment, the dispenser 100 includes a guide member, shown as guide fan 211, a tear bar 212, and a tear bar holder 213. The guide fan 211 extends substantially horizontally to facilitate paper flowing over it. The guide fan 211 may have deflection fingers which protrude substantially horizontally from a distal end thereof. The tear bar 212 is coupled to the tear bar holder 213. Specifically, the tear bar 212 may be mounted to the tear bar holder 213 and extends substantially vertically. The tear bar 212 has teeth which protrude substantially vertically from a distal end. The distal end of the tear bar 212 may be disposed below the distal end of the guide fan 211. In this way, the paper may flow substantially horizontally over the guide fan 211, and may then fall downward over the tear bar 212. When a user pulls on the paper, the paper may place a downward force on the guide fan 211, causing the guide fan 211 to deflect downward. As the guide fan 211 deflects downward, the paper may come into direct contact with the tear bar 212. The tear bar holder 213 is pivotally coupled to the frame 202 by a pin 214 extending substantially laterally across the dispenser 100. The tear bar 212 may additionally rotate downward about the pin 214 as a result of the downward force applied to the tear bar 212. The tear bar holder 213 further includes a tear bar holder arm 215 extending forward of the pin 214. As the tear bar 212 rotates downward about the pin 214, the tear bar holder arm 215 rotates upward (i.e., due to the rotation of the tear bar holder 213) and contacts the tear detection switch 196. The tear detection switch 196 may send a signal to the microcontroller 131, indicating that a tearing event has occurred.

Figure 20:
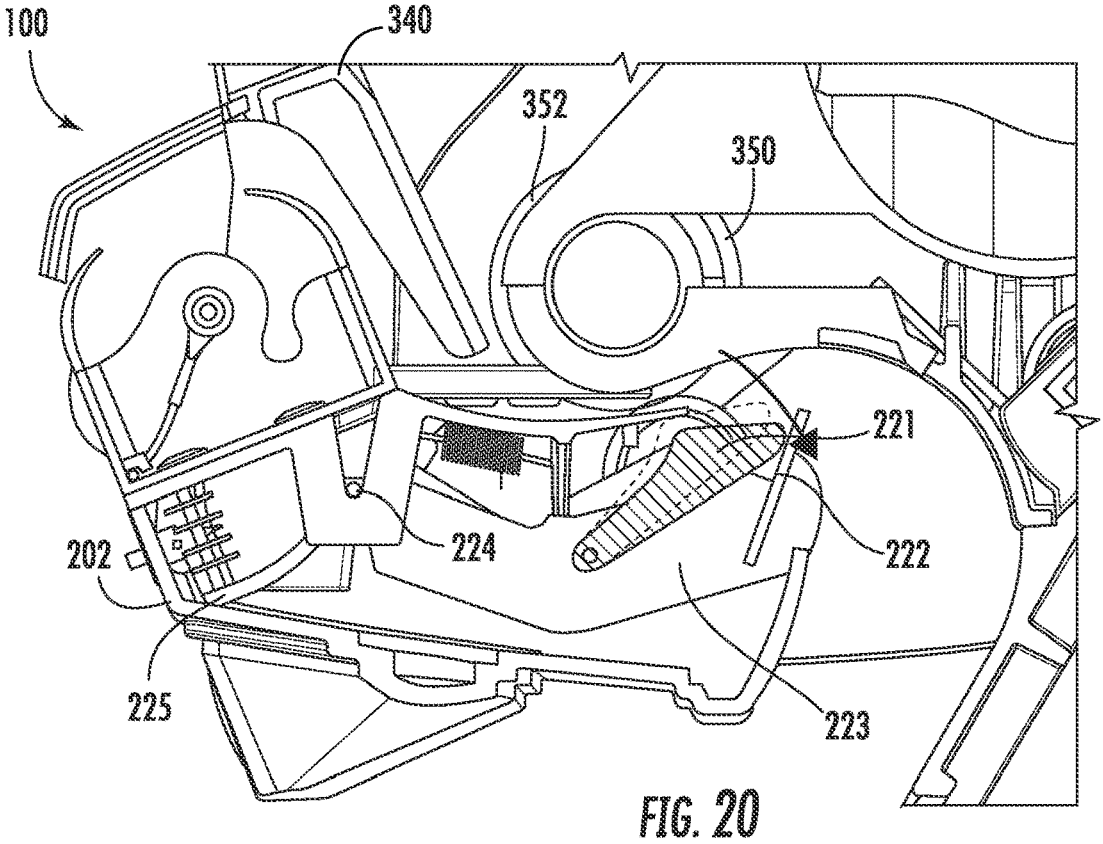

Referring now to FIG. 20, a dispenser 100 is shown according to another exemplary embodiment. This dispenser 100 includes a deflection structure configured to prevent paper from getting stuck on a tear bar. The dispenser 100 shown in FIG. 20 may be substantially similar to the other embodiments of the dispenser 100 (e.g., as shown in FIGS. 15-18) except as otherwise specified herein. In this embodiment, the dispenser 100 includes a guide member, shown as guide structure 221, a tear bar 222, and a tear bar holder 223. The guide structure 221 is pivotally coupled to the tear bar holder 223 at a lower end of the guide structure 221 (e.g., such that the guide structure 221 rotates about a lateral axis). The guide structure 221 may extend at approximately 45 degree upward angle (e.g., measured relative to a vertical plane), and may have a substantially flat surface on a distal end (e.g., distal to the point where the guide structure 221 is coupled to the tear bar holder 223). This flat surface facilitates paper flowing over the guide structure 221. The tear bar 222 is coupled to the tear bar holder 223. Specifically, the tear bar 222 may be mounted (e.g., fixedly coupled) to the tear bar holder 223 and extends substantially vertically. The tear bar 222 may have teeth which protrude substantially vertically from a distal end thereof. The distal end of the tear bar 222 may be disposed in front of the distal end of the guide structure 221. In this way, the paper (e.g., a paper nib) may flow substantially horizontally over the guide structure 221, and may then fall downward over the tear bar 222. When a user pulls on the paper, the paper may place a downward force on the guide structure 221, causing the guide structure 221 to pivot and deflect downward. As the guide structure 221 deflects downward, the paper may come into direct contact with the tear bar 222, causing the paper to tear. The tear bar holder 223 is pivotally coupled to the frame 202 by a pin 224 extending substantially laterally across the dispenser 100. The tear bar 222 may additionally rotate downward about the pin 224 as a result of the downward force applied to the tear bar 222. The tear bar holder 223 further includes a tear bar holder arm 225 extending forward of the pin 224. As the tear bar 222 rotates downward about the pin 224, the tear bar holder arm 225 rotates upward (i.e., due to the rotation of the tear bar holder 223) and contacts the tear detection switch 196. The tear detection switch 196 may send a signal to the microcontroller 131, indicating that a tearing event has occurred.

Figure 21:
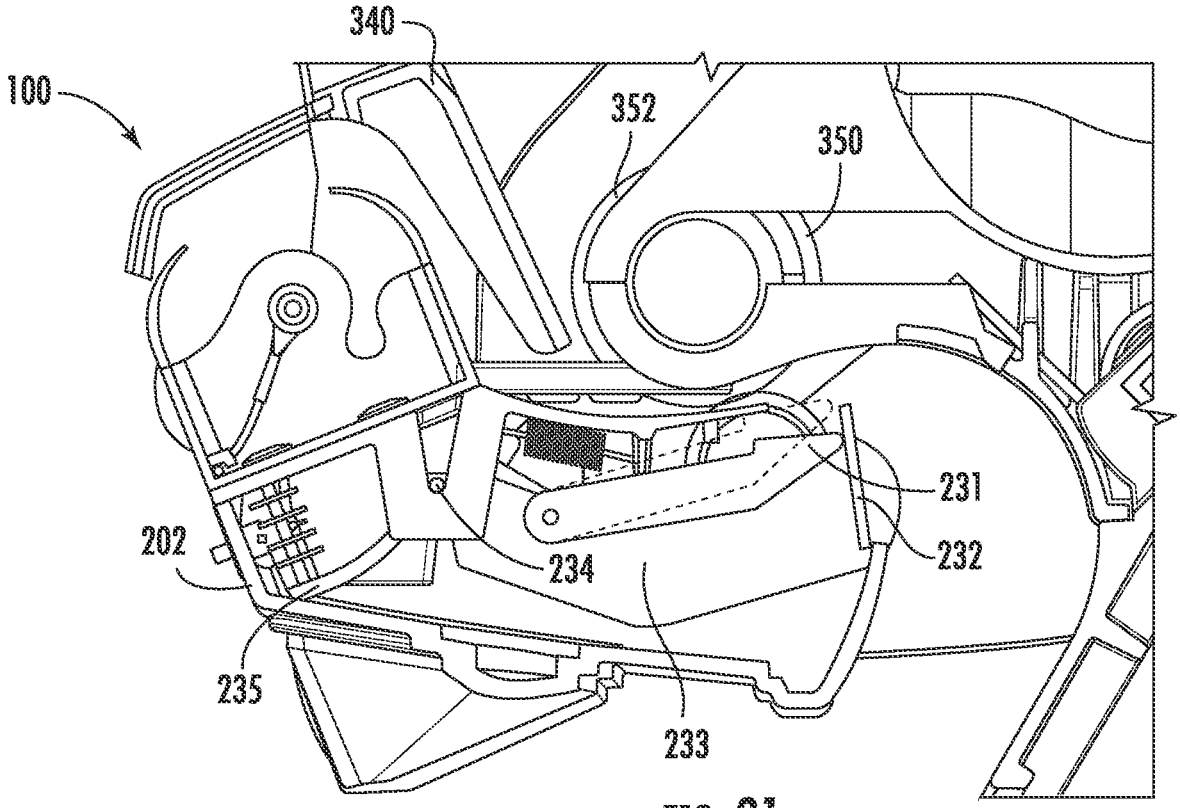

Referring now to FIG. 21, a dispenser 100 is shown according to another exemplary embodiment. This dispenser 100 includes another deflection structure configured to prevent paper from getting stuck on a tear bar. The dispenser 100 shown in FIG. 21 may be substantially similar to the other embodiments of the dispenser 100 (e.g., as shown in FIGS. 15-18) except as otherwise specified herein. In this embodiment, the dispenser 100 includes a guide member, shown as guide structure 231, a tear bar 232, and a tear bar holder 233. The guide structure 231 is coupled to the tear bar holder 223. Specifically, the guide structure 231 is pivotally to the tear bar holder 233 at a lower end of the guide structure 231 (e.g., such that the guide structure 231 rotates about a lateral axis). The guide structure 231 extends substantially horizontally and slightly vertically and has a substantially flat surface on a distal end (e.g., distal to the point where the guide structure 231 is coupled to the tear bar holder 233). The flat surface facilitates paper flowing over the guide structure 231. The tear bar 232 may be mounted (e.g., fixedly coupled) to the tear bar holder 233 and extends substantially vertically, and also slightly horizontally inward, such that it does not extend beyond the tear bar holder 233 into the dispenser opening 150. The distal end of the tear bar 232 may be disposed in front of the distal end of the guide structure 231. In this way, the paper may flow substantially horizontally over the guide structure 231, and may then fall downward over the tear bar 232. When a user pulls on the paper, the paper may place a downward force on the guide structure 231, causing the guide structure 231 to pivot and deflect downward. As the guide structure 231 deflects downward, the paper may come into direct contact with the tear bar 232, causing the paper to tear. The tear bar holder 233 is pivotally coupled to the frame 202 by a pin 234 extending substantially laterally across the dispenser 100. The tear bar 232 may additionally rotate downward about the pin 234 as a result of the downward force applied to the tear bar 232. The tear bar holder 233 further includes a tear bar holder arm 235 extending forward of the pin 234. As the tear bar 232 rotates downward about the pin 234, the tear bar holder arm 235 rotates upward (i.e., due to the rotation of the tear bar holder 233) and contacts the tear detection switch 196. The tear detection switch 196 may send a signal to the microcontroller 131, indicating that a tearing event has occurred.

Figure 22:
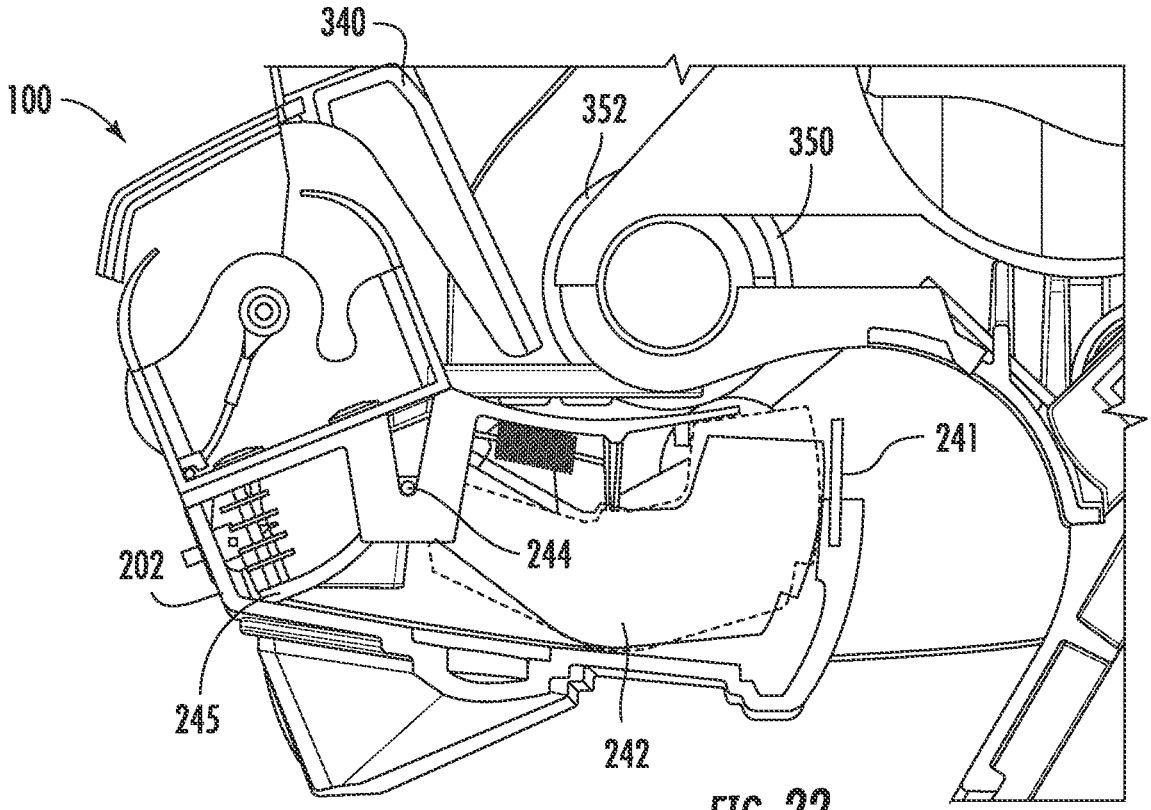

Referring now to FIG. 22, a dispenser 100 is shown according to another exemplary embodiment. This dispenser 100 includes another deflection structure configured to prevent paper from getting stuck on a tear bar. The dispenser 100 shown in FIG. 22 may be substantially similar to the other embodiments of the dispenser 100 (e.g., as shown in FIGS. 15-18) except as otherwise specified herein. In this embodiment, the dispenser 100 includes a tear bar 241 and a guide member, shown as guide structure 242. The guide structure 242 is coupled to the dispenser 100. Specifically, the guide structure 242 is pivotally coupled to the frame 202 at a lower end of the dispenser 100. The guide structure 242 extends substantially horizontally to facilitate paper flowing over the guide structure 242. The tear bar 241 is coupled to the dispenser 100. Specifically, the tear bar 241 may be mounted (e.g., fixedly coupled) to the frame 202 at a lower end of the dispenser 100 and extends substantially vertically. The tear bar 241 may have teeth which protrude substantially vertically from a distal end thereof. The distal end of the tear bar 241 may be disposed in front of the distal end of the guide structure 242. In this way, the paper may flow substantially horizontally over the guide structure 242, and may then fall downward over the tear bar 241. When a user pulls on the paper, the paper may place a downward force on the guide structure 242, causing the guide structure 242 to pivot and deflect downward. As the guide structure 242 deflects downward, the paper may come into direct contact with the tear bar 241, causing the paper to tear. The guide structure 242 is pivotally coupled to the frame 202 by a pin 244 extending substantially laterally across the dispenser 100. The guide structure 242 further includes an arm 245 extending forward of the pin 244. As the guide structure 242 rotates about the pin 244, the arm 245 rotates upward and contacts the tear detection switch 196. The tear detection switch 196 may send a signal to the microcontroller 131, indicating that a tearing event has occurred.

Figure 23:
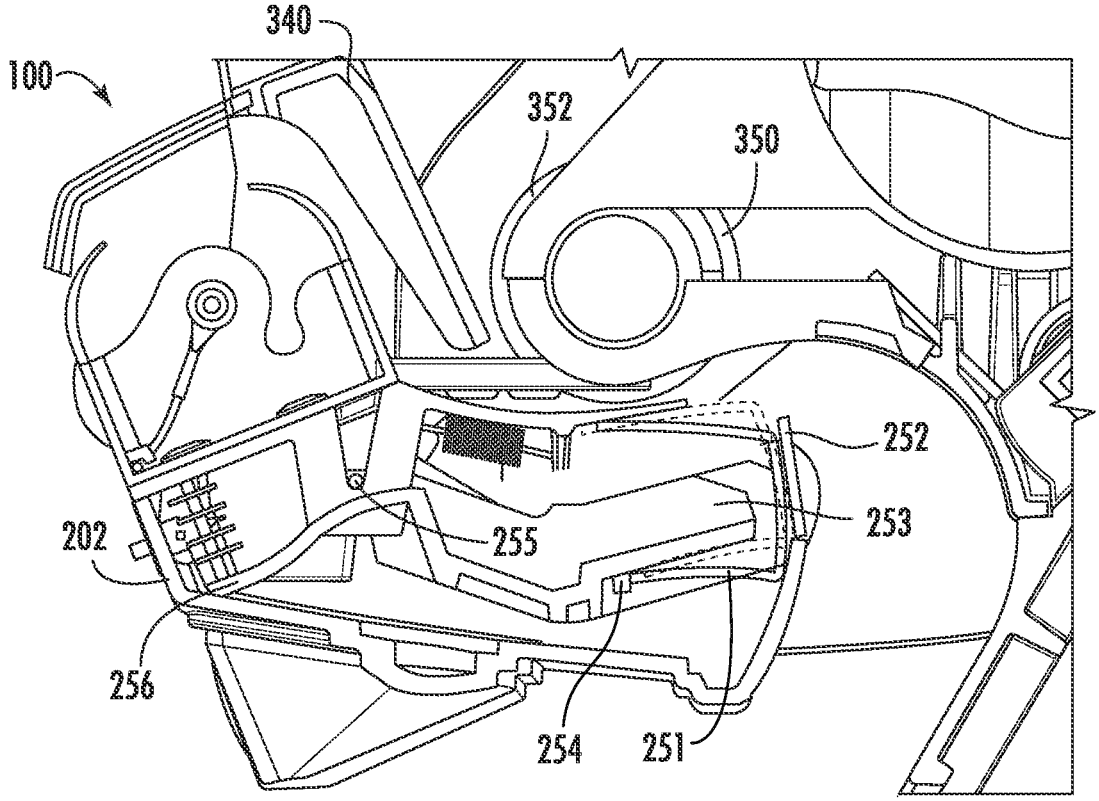

Referring now to FIG. 23, a dispenser 100 is shown according to another exemplary embodiment. This dispenser 100 includes another deflection structure configured to prevent paper from getting stuck on a tear bar. The dispenser 100 shown in FIG. 23 may be substantially similar to the other embodiments of the dispenser 100 (e.g., as shown in FIGS. 15-18) except as otherwise specified herein. In this embodiment, the dispenser 100 includes a guide member, shown as deflection unit 251, a tear bar 252, and a tear bar holder 253. The deflection unit 251 may be compliant (e.g., malleable, flexible, resilient, etc.), and may have a reverse C-shaped cross section (e.g., three sides of a square). The deflection unit 251 is coupled to the tear bar holder 253. Specifically, the deflection unit 251 is coupled (e.g., pivotally coupled, fixedly coupled) to the tear bar holder 253 at an anchor point 254. The deflection unit 251 extends substantially horizontally to facilitate paper flowing over the deflection unit 251. The tear bar 252 may be coupled to the tear bar holder 253. Specifically, the tear bar 252 may be partially received within and mounted (e.g., fixedly coupled) to the tear bar holder 253 and extends substantially vertically and slightly inward. The tear bar 252 may have teeth which protrude substantially vertically from a distal end and which may extend above a top surface of the tear bar holder 253. The distal end of the tear bar 252 may be disposed in front of a distal end of the deflection unit 251. In this way, the paper may flow substantially horizontally over the deflection unit 251, and may then fall downward over the tear bar 252. When a user pulls on the paper, the paper may place a downward force on the deflection unit 251, causing the deflection unit 251 to pivot or bend about the anchor point 254 and deflect downward. As the deflection unit 251 deflects downward, the paper may come into direct contact with the tear bar 252, causing the paper to tear. The tear bar holder 253 is pivotally coupled to the frame 202 by a pin 255 extending substantially laterally across the dispenser 100. The tear bar 252 may additionally rotate downward about the pin 255 as a result of the downward force applied to the tear bar 252. The tear bar holder 253 further includes a tear bar holder arm 256 extending forward of the pin 255. As the tear bar 252 rotates downward about the pin 255, the tear bar holder arm 256 rotates upward (i.e., due to the rotation of the tear bar holder 253) and contacts the tear detection switch 196. The tear detection switch 196 may send a signal to the microcontroller 131, indicating that a tearing event has occurred.

Figure 24:
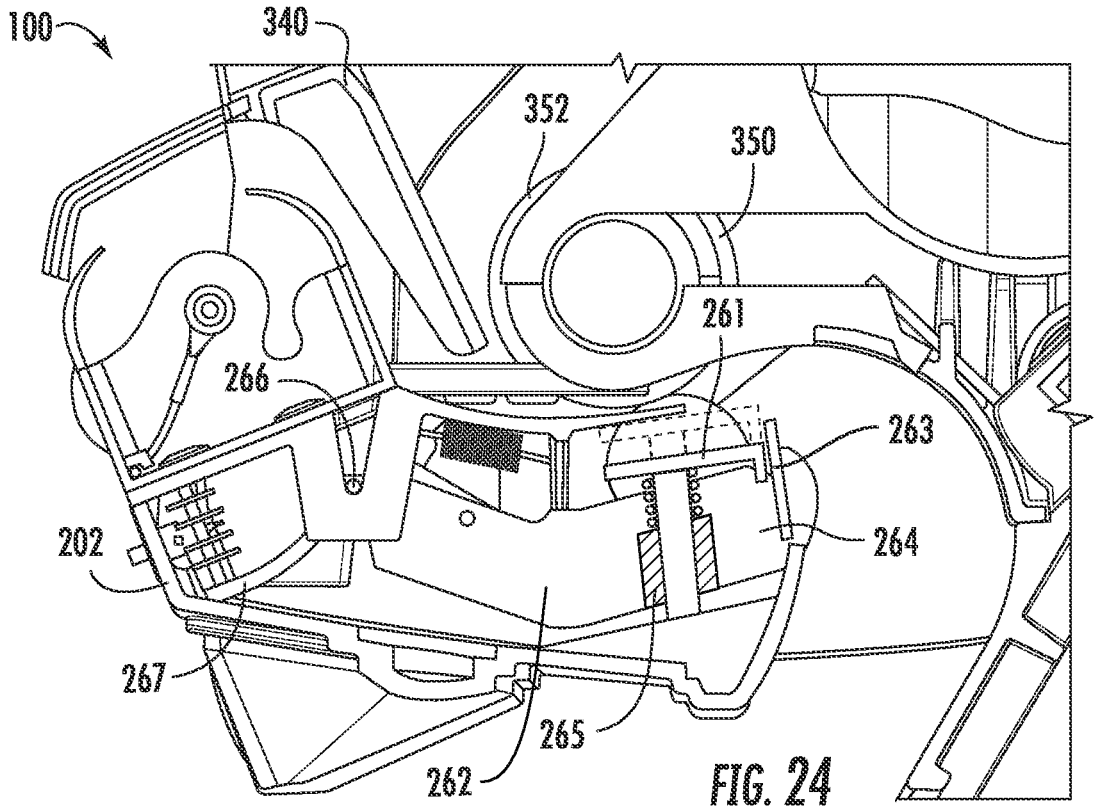

Referring now to FIG. 24, a dispenser 100 is shown according to another exemplary embodiment. This dispenser 100 includes another deflection structure configured to prevent paper from getting stuck on a tear bar. The dispenser 100 shown in FIG. 24 may be substantially similar to the other embodiments of the dispenser 100 (e.g., as shown in FIGS. 15-18) except as otherwise specified herein. In this embodiment, the dispenser 100 includes a guide member, shown as deflection unit 261, a biasing member, shown as spring 262, a tear bar 263, and a tear bar holder 264. The deflection unit 261 may be a rigid component and may have a substantially T-shaped cross section. A lower portion of the deflection unit 261 is received within an aperture or opening 265 defined in the tear bar holder 264. In addition, the spring 262 may be surround the lower portion of the deflection unit 261 and may engage a shoulder surrounding the opening 265. In this way, the spring 262 may be positioned such that it engages with a lower surface of the deflection unit 261 and forces (e.g., biases) the deflection unit 261 upwards. A top surface of the deflection unit 261 may extend substantially horizontally to facilitate paper flowing over the deflection unit 261. The tear bar 263 is coupled to the tear bar holder 264. Specifically, the tear bar 263 may be partially received within and mounted (e.g., fixedly coupled) to the tear bar holder 264 and extends substantially vertically and slightly inward. The tear bar 263 may have teeth which protrude substantially vertically from a distal end and which may extend above a top surface of the tear bar holder 264. The distal end of the tear bar 263 may be disposed in front of a distal end of the deflection unit 261. In this way, the paper (e.g., a paper nib) may flow substantially horizontally over the deflection unit 261, and may then fall downward over the tear bar 263. When a user pulls on the paper, the paper may place a downward force on the deflection unit 261, causing the deflection unit 261 to place a downward force on the spring 262. The spring 262 may compress, permitting the deflection unit 261 to translate linearly downward through the opening 265. As the deflection unit 261 deflects downward, the paper may come into direct contact with the tear bar 263, causing the paper to tear. The tear bar holder 264 is pivotally coupled to the frame 202 by a pin 266 extending substantially laterally across the dispenser 100. The tear bar 263 may additionally rotate downward about the pin 266 as a result of the downward force applied to the tear bar 263. The tear bar holder 264 further includes a tear bar holder arm 267 extending forward of the pin 266. As the tear bar 263 rotates downward about the pin 266, the tear bar holder arm 267 rotates upward (i.e., due to the rotation of the tear bar holder 264) and contacts the tear detection switch 196. The tear detection switch 196 may send a signal to the microcontroller 131, indicating that a tearing event has occurred.

Figure 25:
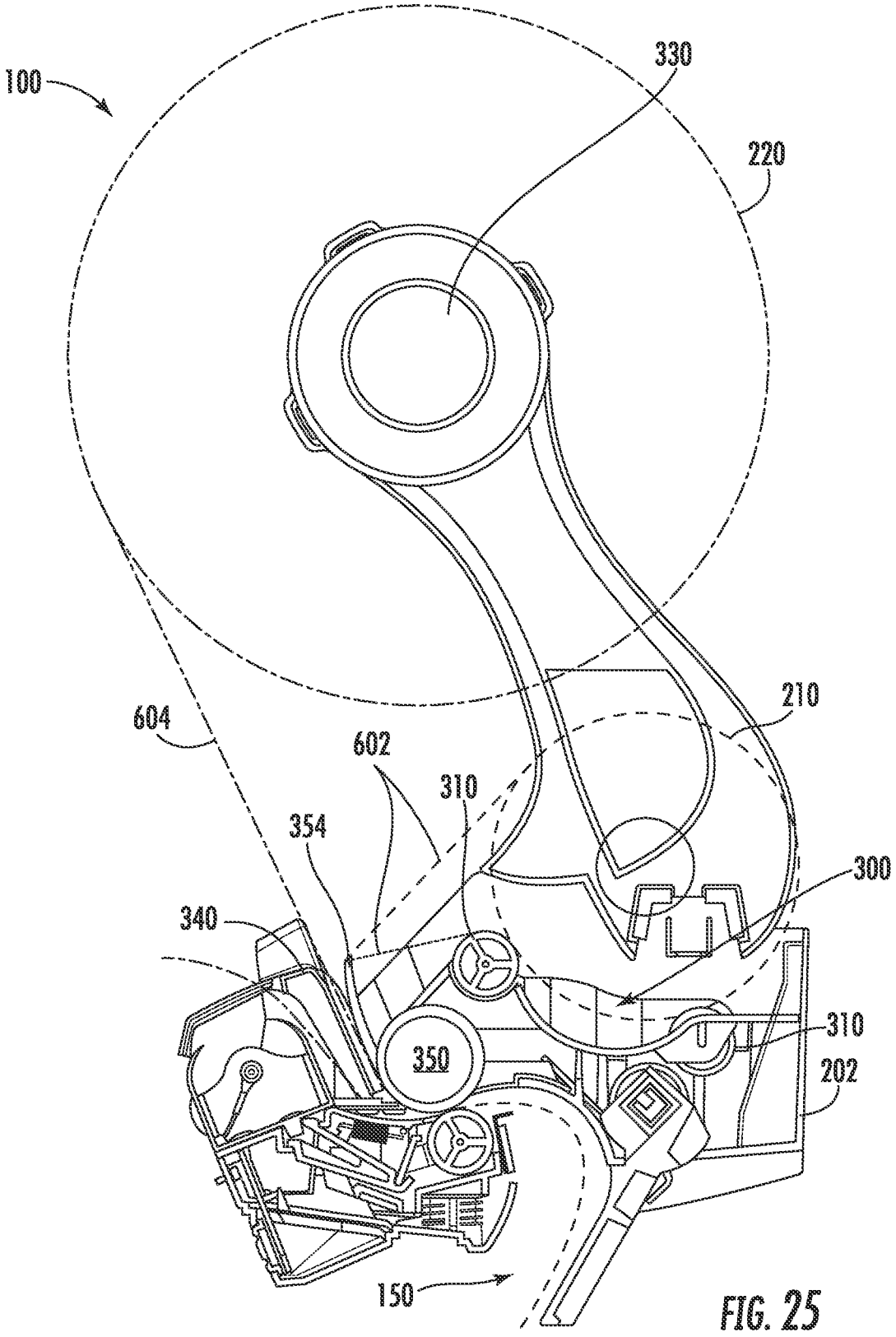
FIG. 25 is a side cross-sectional view of the roll towel dispenser of FIG. 1.
Figure 26:
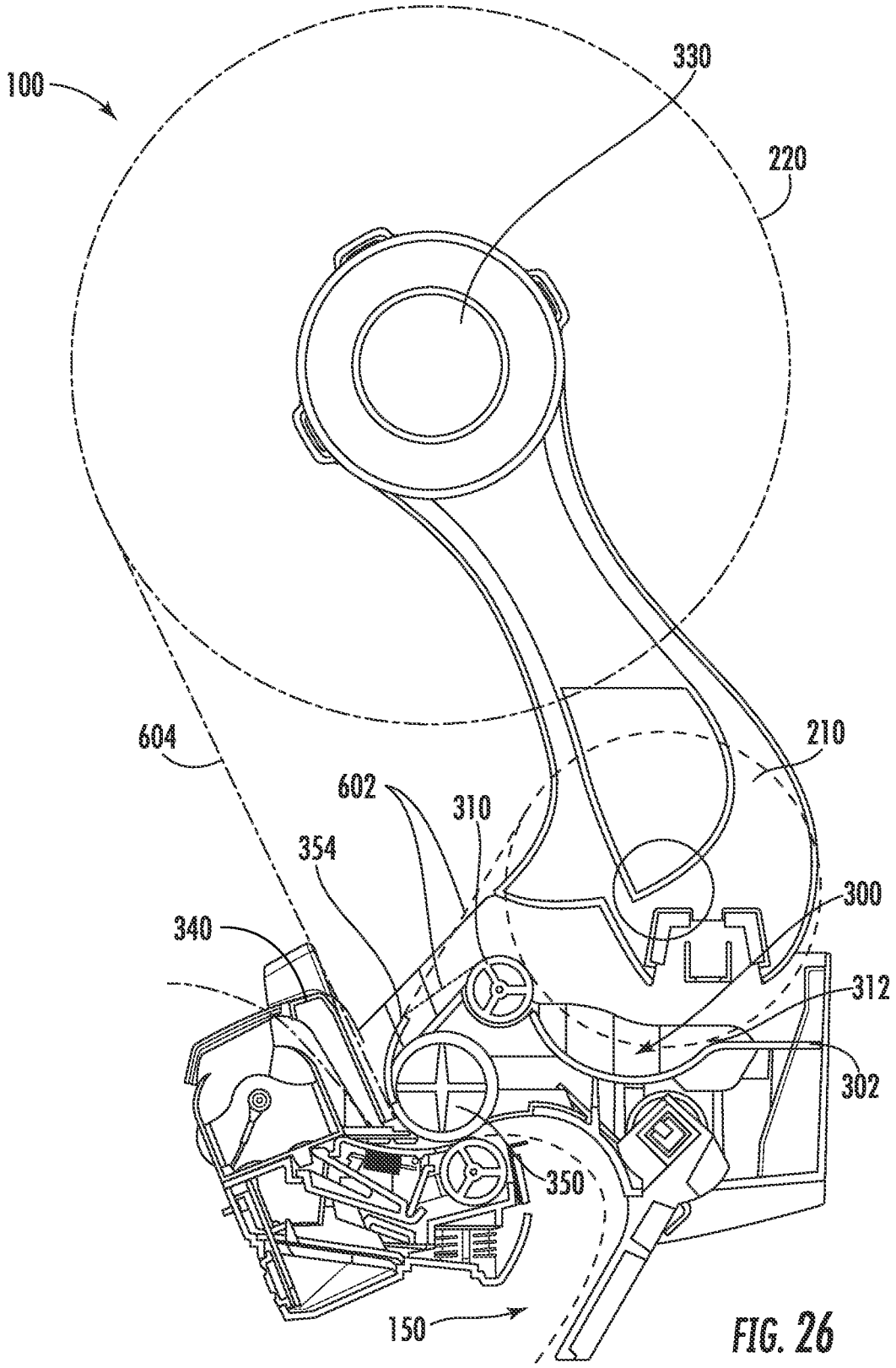
FIGS. 26 and 27 are side cross-sectional views of a roll towel dispenser, according to another exemplary embodiment.
Figure 27:
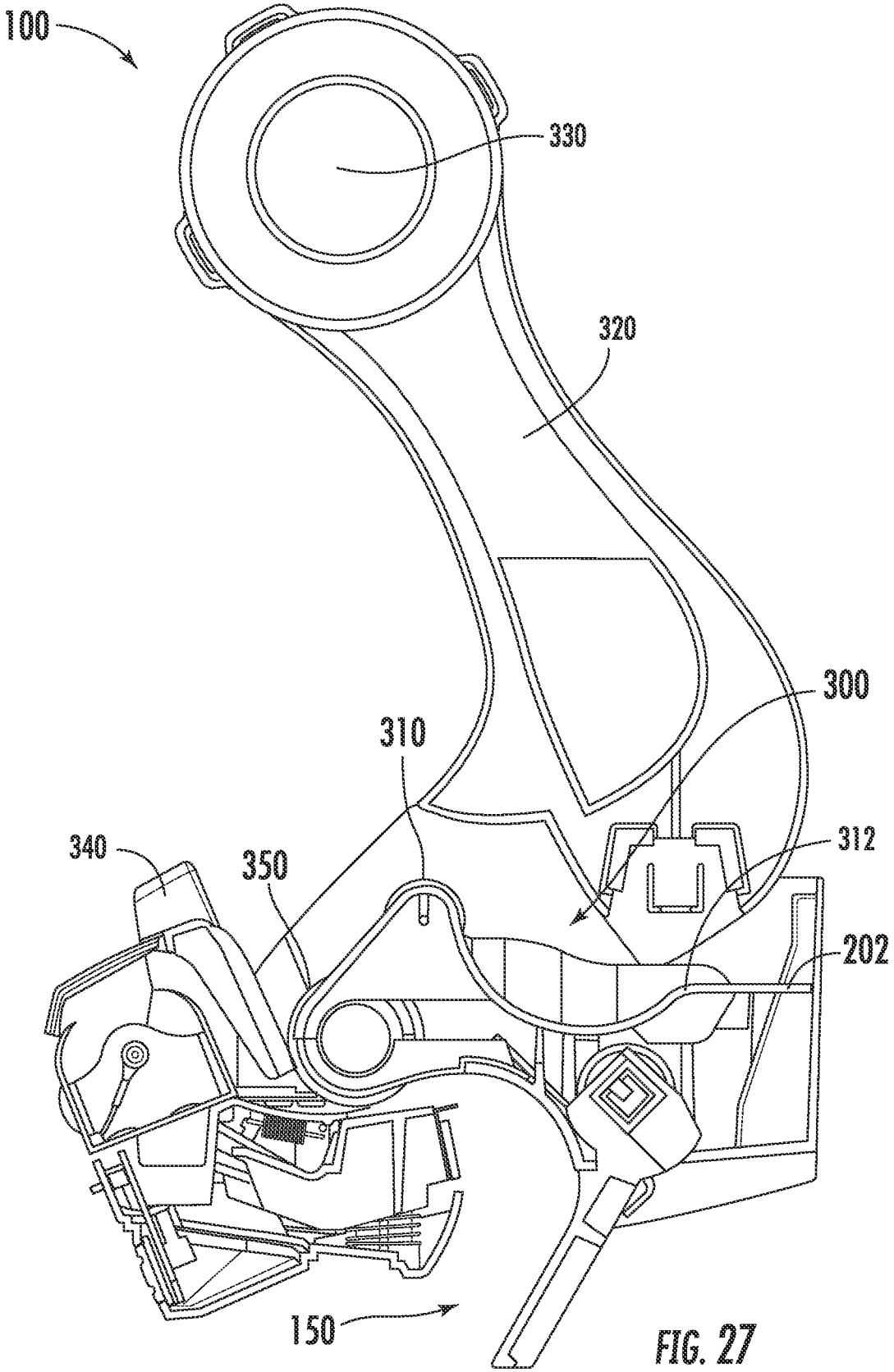
Figure 28:
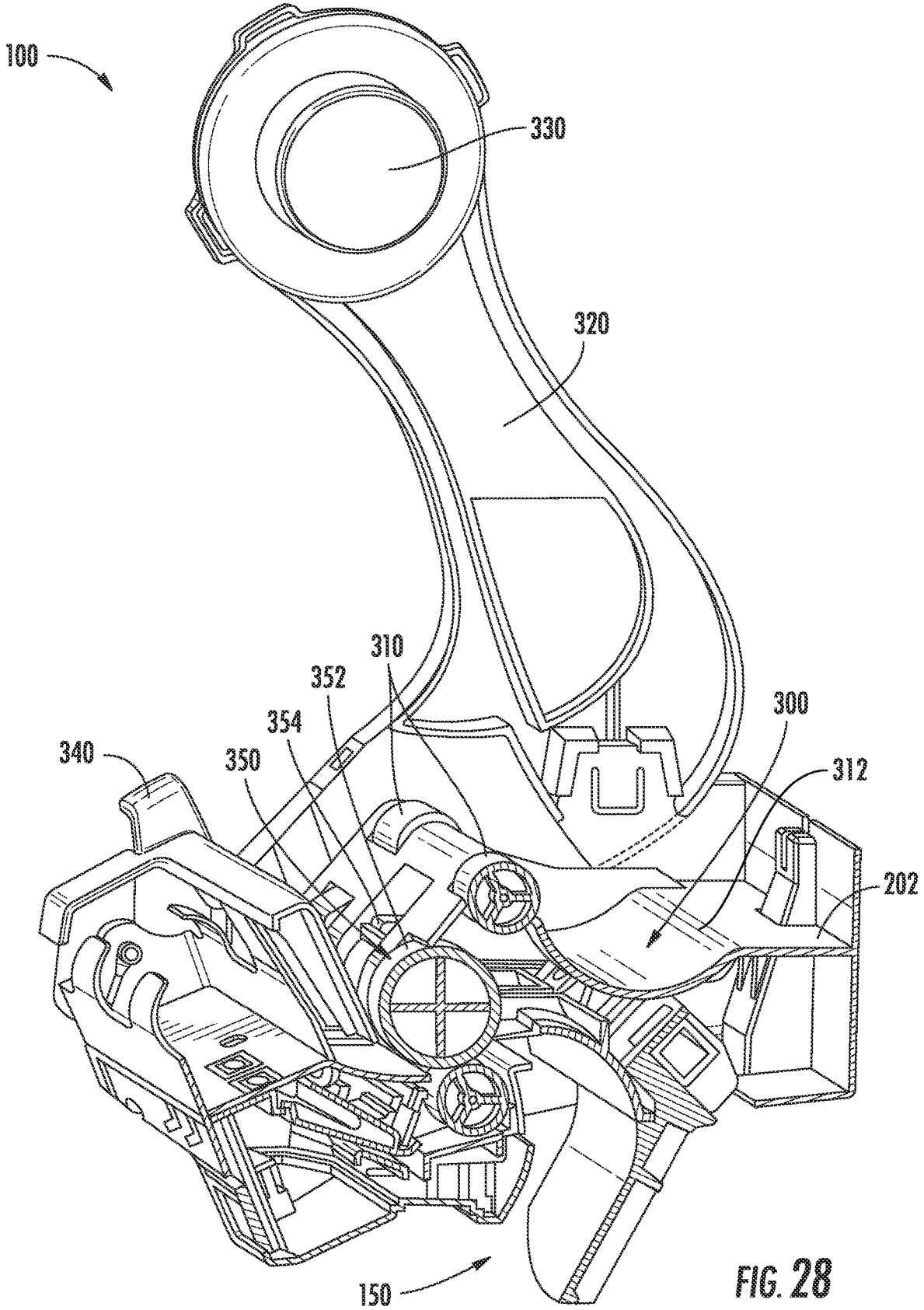
FIG. 28 is a perspective cross-sectional view of the roll towel dispenser of FIG. 26.
Figure 29:
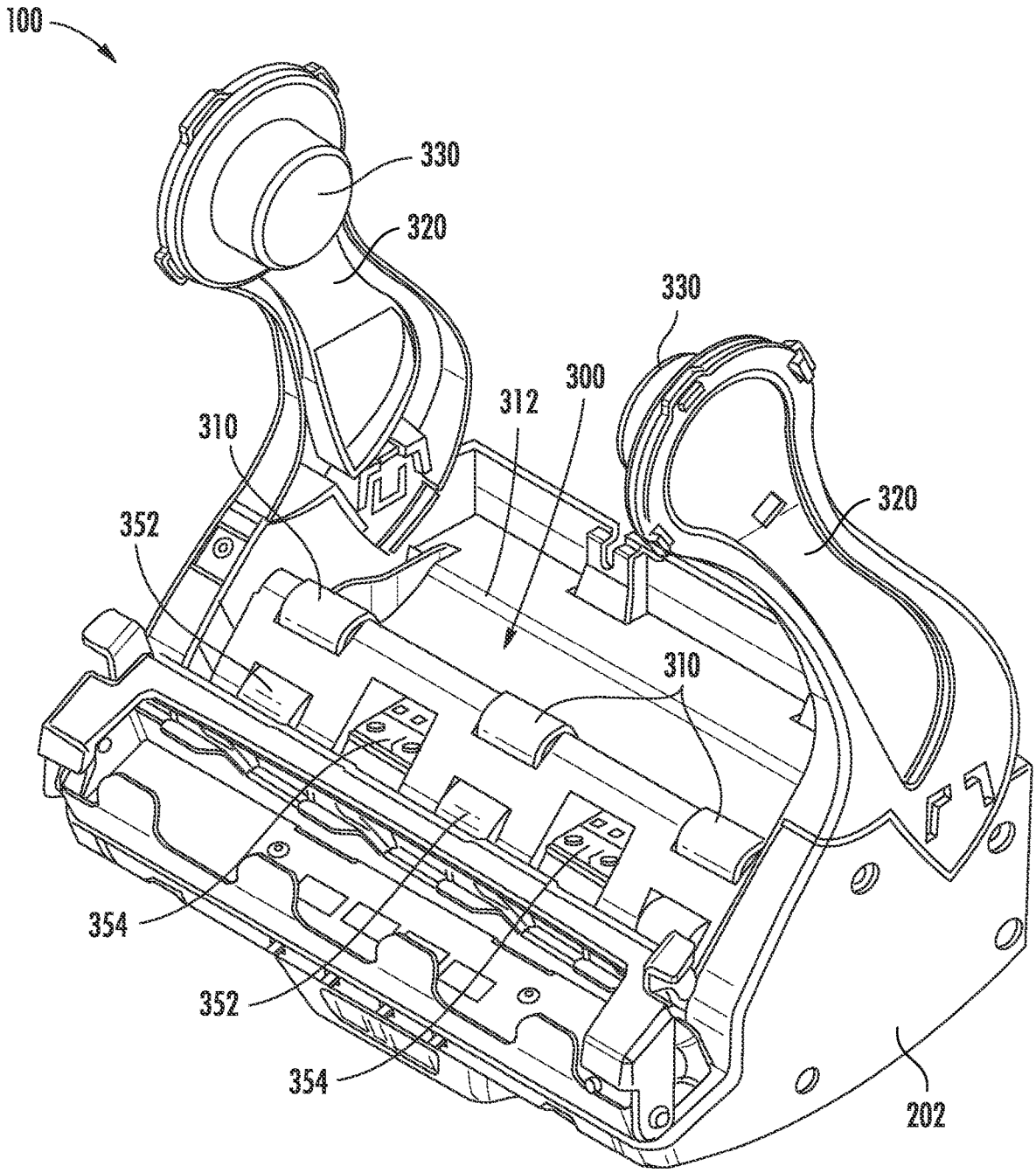
FIG. 29 is a perspective view of the roll towel dispenser of FIG. 26.
Figure 30:
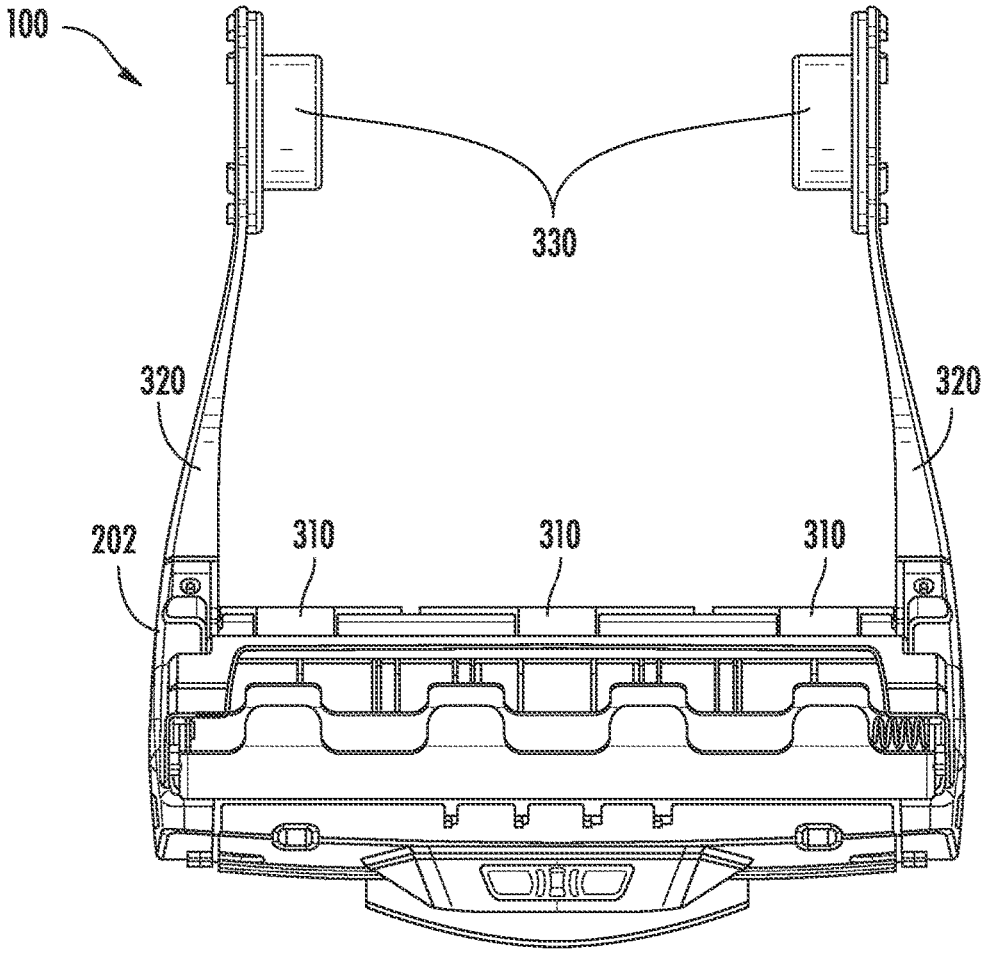
FIG. 30 is a front view of the roll towel dispenser of FIG. 26.
Figure 31:
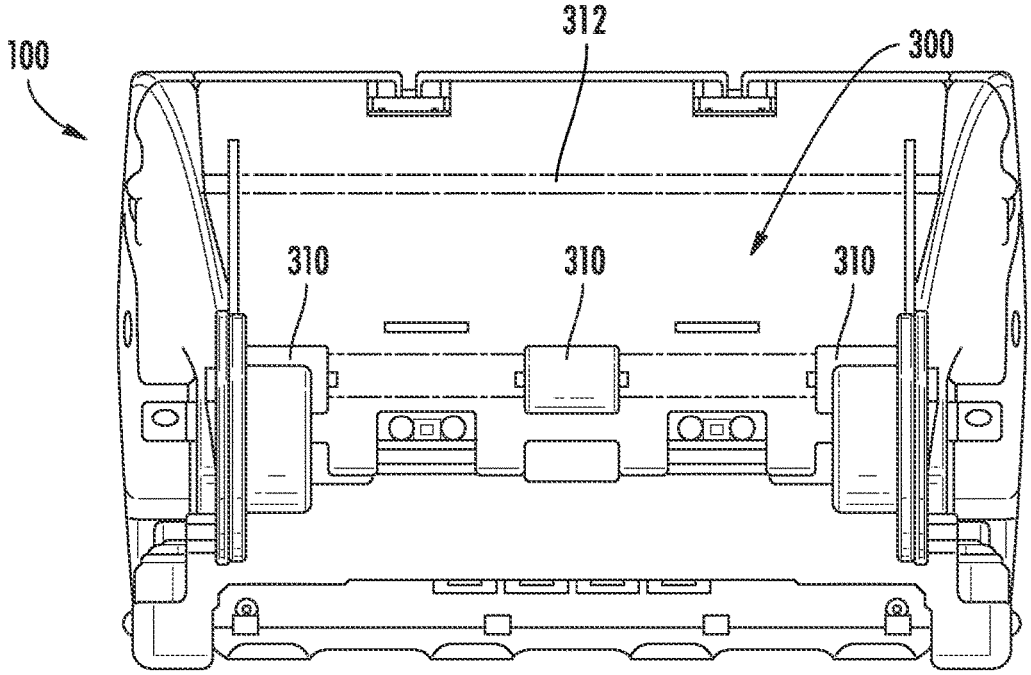
FIG. 31 is a top view of the roll towel dispenser of FIG. 26.

Referring now to FIG. 25, a dispenser is shown according to an exemplary embodiment. In this embodiment, the stub roll 210 is supported by two subsets or groups of idle rollers 310. Specifically, a first group or subset of the idle rollers 310, which includes two of the idle rollers 310 laterally offset from one another, is positioned near a front side of the receptacle 300. A second group or subset of the idle rollers 310, which includes a single idle roller 310 that is positioned substantially laterally centered within the dispenser 100, is positioned near the rear side of the receptacle 300. In other embodiments, the first group and/or the second group include more or fewer idle rollers 310. The idle rollers 310 tangentially engage the stub roll 210. The center of gravity of the stub roll 210 is positioned longitudinally between the first group of idle rollers 310 and the second group of idle rollers 310 such that the stub roll 210 is supported by the idle rollers 310, even as the diameter of the stub roll 210 changes (e.g., when paper towel is dispensed from the stub roll 210). The paper 602 from the stub roll 210 wraps around the main roller 350 and is dispensed through the dispenser opening 150. As the stub roll 210 decreases in size, the trajectory of the paper 602 generally moves downward. In FIG. 25, the trajectory of the paper 602 where the stub roll 210 is near its maximum size is shown as a first dashed line, and the trajectory of the paper 602 when the stub roll 210 is nearly depleted is shown as a dotted line.

In the embodiment shown in FIG. 25, the idle rollers 310 are configured to rotate freely such that they exert a relatively small (e.g., minimal, negligible, etc.) frictional force on the stub roll 210. Accordingly, the tensile force exerted on the paper 602 by the transfer tabs 354 of the main roller 350 to dispense the paper 602 from the stub roll 210 is relatively small. This tensile force causes the transfer tabs 354 to deflect (e.g., bend, deform, etc.) toward the stub roll 210 and away from the paper 604. Because this tensile force is relatively small, the deflection of the transfer tabs 354 away from the paper 604 is relatively small, increasing the likelihood of a double feed situation where the paper 602 presses against the paper 604 hard enough to pull both through the dispenser opening 150 simultaneously.

FIGS. 26-31 illustrate an alternative embodiment of the dispenser 100. FIGS. 26-31 illustrate an embodiment where an increased amount of force is required to rotate the stub roll 210 relative to that shown in FIG. 25. Beneficially and described herein, increasing the amount of force increases the pressure put on the transfer tabs 354, which causes the transfer tabs 354 to move or deflect closer to the stub roll 210 and further from the paper from the reserve roll 220. As a result, the transfer tabs 354 exert a relatively lesser amount of force on the paper 604 from the reserve roll 220. Due to this decrease in pressure or force between paper from the reserve and stub rolls, there is a relatively lesser chance of a double feed situation.

The dispenser 100 shown in FIGS. 26-31 may be substantially similar to the dispenser 100 shown in FIG. 25 except as disclosed herein. In this embodiment, the second set of idle rollers 310 is omitted (i.e., the rearly positioned rollers). Instead of rolling freely on the idle rollers 310, the rear portion of the stub roll 210 directly engages a stationary engagement surface 312 defined by the frame 202. Accordingly, the stub roll 210 slides across the engagement surface 312 when rolling. The engagement surface 312 may be shaped (e.g., pointed, radiused, etc.) such that the stub roll 210 engages the engagement surface 312 regardless of the size of the stub roll 210. The contact between the stub roll 210 and the engagement surface 312 imparts a relatively higher frictional force on the stub roll 210 (e.g., higher than the frictional force from rolling on the idle roller 310 like shown in FIG. 25), which in turn makes rotation of the stub roll 210 relatively more difficult (i.e., more force is required to rotate the stub roll 210). This in turn causes the transfer tabs 354 to deflect or move a relatively larger distance away from the paper 604. This reduces the contact force between the paper 602 and the paper 604 and the force imparted by the transfer tabs 354 on the paper 604 thereby reducing the likelihood of a double feed situation. In some situations, the contact surface area between the two papers is reduced. Additionally or alternatively, the force on the paper 604 is reduced. This situation may occur with the contact surface area reducing or staying the same. Once the stub roll 210 is depleted, the increased frictional force on the stub roll 210 has no effect on the transfer tabs 354, and the main roller 350 is permitted to engage the paper 604 to begin feeding from the reserve roll 220. The transfer tabs 354 snap or move back to engagement or contact with paper 604. In some embodiments, the first group of idle rollers 310 are still permitted to roll freely (e.g., as opposed to removing both sets of idle rollers 310). This may help prevent the stub roll 210 from engaging the frame 202 and climbing out of the receptacle 300. The material and texture of the engagement surface 312 may be selected to achieve a desired friction between the stub roll 210 and the engagement surface 312. In some embodiments, the friction between the stub roll 210 and the engagement surface 312 is limited to prevent the paper 602 from ripping or tearing prematurely (e.g., due to the friction preventing rotation of the stub roll 210 entirely).

Thus, removing the rear idle rollers 310 is one way to increase the force required to rotate the stub roll which, in turn, increases the movement or deflection of the transfer tabs 354 away from the paper 604 to reduce the likelihood of a double feed situation. This concept may be referred to as a tensioning methodology and structure because tension within the paper 602 applies a bending force to the transfer tabs 354 to move them away from the paper 604 and reduce the force on the paper 604 to reduce the likelihood of a double feed situation. However, a variety of other mechanisms may also be used in combination with or in alternative to this tensioning methodology and structure. For example, in one embodiment, a brake is added to one or more of the idle rollers 310 such that rotation of the one or more idle rollers 310 is constrained or restricted. As a result, dispensing paper from the stub roll 210 may require more force, which causes a movement or deflection of the transfer tabs 354 away from the paper from the reserve roll 220 and towards the stub roll 210. In another embodiment, friction between the idle rollers 310 and the stub roll 210 may be increased by adding a rubberized coating to the idle rollers 310, by texturing the idle rollers 310, and so on to prevent slippage between the idle rollers 310 and the stub roll 210. In this situation, relatively more force may be required to cause paper from the stub roll 210 to be dispensed, which in turn moves or deflects the transfer tabs 354 away from the paper 604. In still another embodiment, the stub roll 210 is supported from the core instead of on an exterior surface. By way of example, the frame 202 may include a pair of cups, similar to the dual cups 330, that enter into the central aperture of the core of the stub roll 210 to support the stub roll 210. The cups may engage the core of the stub roll 210 such that the cups rotate with the core (e.g., in unison with the stub roll 210). A brake may be added to one or both of the cups to increase the frictional force on the stub roll 210.

In still another embodiment, an engagement member (e.g., a finger, etc.) is added to the frame 202. The engagement member is configured to engage an outer surface of the stub roll 210 such that the stub roll 210 slides relative to the engagement member to dispense paper. The engagement member imparts a frictional force on the stub roll 210. The engagement member is biased into engagement with the outer surface of the stub roll 210. By way of example, the engagement member may be biased by gravity, by a biasing member (e.g., a spring), or by deformation of the frame 202 and/or the engagement member. The biasing force controls the frictional force imparted on the stub roll 210. In some embodiments, the biasing force facilitates the engagement member moving to maintain contact with the stub roll 210 as the stub roll 210 decreases in size. Thus, the amount of pressure on the stub roll 210 by the engagement member may control the amount of force required to rotate the stub roll 210, which in turn adds more pressure on the transfer tabs 354 such that they deflect away from the paper 604.

In some embodiments, the rotational speed of the stub roll 210 is controlled relative to the rotational speed of the main roller 350 (e.g., such that a constant ratio is maintained between the linear speed of the paper 602 and the rotational speed of the main roller 350). By way of example, one or more of the idle rollers 310 may be rotationally coupled (e.g., by a sprocket and chain arrangement, by a timing belt and pulley arrangement, by a series of gears, etc.) such that a constant ratio is maintained between the rotational speeds of the idle rollers 310 and the main roller 350. The idle rollers 310 may be configured with sufficient friction that no slippage occurs between the idle rollers 310 and the stub roll 210. Alternatively, the idle rollers 310 can be configured with sufficient friction that a controlled amount of slippage occurs between the idle rollers 310 and the stub roll 210 (e.g., the tensile force in the paper 602 required to slip the idle rollers 310 is controlled). By controlling the speed of the stub roll 210 relative to the main roller 350, the tensile force within the paper 602 may be set at a desired force. Thus, the speed difference between the main roller and the stub roll is highly configurable such that a variety of properties or characteristics may be achieved (e.g., more force required to rotate the stub roll to cause more deflection in the transfer tabs).

While a few structures and methods for increasing the force required to rotate the stub roll and dispense paper from the stub roll (e.g., removing one or more idle rollers, the inclusion of a brake with the idle rollers to make it harder for the stub roll to rotate, using a high friction texture with the idle rollers, using a cup structure to support the stub roll with a mechanism that makes rotation of the stub roll more difficult, etc.), this list is not meant to be limiting as other structures and methods may also be utilized. In this regard, other tensioning concepts may also be used.

Configuration of Exemplary Embodiments

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

As mentioned above and in one configuration, the "circuits" (i.e., control circuitry described above) may be implemented in machine-readable medium for execution by various types of processors, such as processor 824 of FIG. 14. An identified circuit of executable code may, for instance, comprise one or more physical or logical blocks of computer instructions, which may, for instance, be organized as an object, procedure, or function. The executables of an identified circuit need not be physically located together, but may comprise disparate instructions stored in different locations which, when joined logically together, comprise the circuit and achieve the stated purpose for the circuit. Indeed, a circuit of computer readable program code may be a single instruction, or many instructions, and may even be distributed over several different code segments, among different programs, and across several memory devices. Similarly, operational data may be identified and illustrated herein within circuits, and may be embodied in any suitable form and organized within any suitable type of data structure. The operational data may be collected as a single data set, or may be distributed over different locations including over different storage devices, and may exist, at least partially, merely as electronic signals on a system or network.

While the term "processor" is briefly defined above, it should be understood that the term "processor" and "processing circuit" are meant to be broadly interpreted. In this regard and as mentioned above, the "processor" may be implemented as one or more general-purpose processors, application specific integrated circuits, field programmable gate arrays, digital signal processors, or other suitable electronic data processing components structured to execute instructions provided by memory. The one or more processors may take the form of a single core processor, multi-core processor (e.g., a dual core processor, triple core processor, quad core processor, etc.), microprocessor, etc. In some alternate embodiments, the one or more processors may be external to the roll towel dispenser, for example the one or more processors may be a remote processor (e.g., a cloud based processor). Alternatively or additionally, the one or more processors may be internal and/or local to the apparatus. In this regard, a given circuit or components thereof may be disposed locally (e.g., as part of the roll towel dispenser—like shown and described in the embodiments herein) or remotely (e.g., as part of a remote server such as a cloud based server).

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the roll towel dispenser as shown in the various exemplary embodiments is illustrative only. Additionally, any element disclosed in one embodiment may be incorporated or utilized with any other embodiment disclosed herein. For example, the arrangement of the idle rollers 310 of the exemplary embodiment shown in FIGS. 26-31 may be incorporated in the dispenser 100 of the exemplary embodiment shown in FIG. 2. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A roll towel dispenser, comprising:

a frame configured to support a roll of paper towel, the roll of paper towel including a primary roll of paper towel and a reserve roll of paper towel;

a main roller coupled to the frame, the main roller having an axis of rotation;

a transfer tab coupled to main roller and extending away from the main roller; and a transfer bar rotatably coupled to the frame and configured to pivot between a first position and a second position, the transfer tab being closer to the main roller in the second position than when in the first position;

wherein the transfer tab is configured to move relative to the main roller during operation of the roll towel dispenser and grip a portion of the roll of paper towel and pull the roll of paper towel during operation of the roll towel dispenser; and wherein, in the second position, the transfer bar is configured to place a portion of the reserve roll of paper towel in contact with a portion of the primary roll of paper towel.

2. The roll towel dispenser of claim 1, further comprising:

a one-way clutch coupled to the main roller;

a motor coupled to the frame and the one-way clutch; and a manual actuator coupled to the frame and configured to drive the main roller;

wherein the one-way clutch is configured to transfer torque from the motor to the main roller to drive the main roller, and wherein the one-way clutch permits selective relative movement of the main roller to one of the motor or the manual actuator.

3. The roll towel dispenser of claim 2, further comprising a main roller gear coupled to the one-way clutch, wherein the main roller gear is positioned between the one-way clutch and the motor such that the main roller gear and the one-way clutch are directly coupled to each other.

4. The roll towel dispenser of claim 2, further comprising a battery receptacle configured to receive a battery that provides power to the motor.

5. The roll towel dispenser of claim 4, wherein the battery receptacle is integral with the frame.

6. The towel dispenser of claim 1, wherein the main roller further comprises a raised contact body, wherein the transfer tab extends a relatively further distance away from the axis of rotation than the contact body.

7. The roll towel dispenser of claim 1, wherein the transfer tab is a first transfer tab, and wherein the main roller further comprises a second transfer tab spaced apart from the first transfer tab.

8. The roll towel dispenser of claim 1, wherein the transfer bar is disposed nearer to the primary roll of paper towel in the second position than in the first position.

9. The roll towel dispenser of claim 1, wherein the transfer tab is configured to:

grip a portion of the primary roll of paper towel and pull the primary roll of paper towel during operation of the roll towel dispenser; and upon emptying of the primary roll of paper towel, grip a portion of the reserve roll of paper towel and pull the reserve roll of paper towel during operation of the roll towel dispenser.

10. The roll towel dispenser of claim 1, wherein the portion of the primary roll of paper towel is configured to slide past the portion of the reserve paper towel during operation of the roll towel dispenser.

11. A roll towel dispenser, comprising:

a frame configured to support a primary roll of paper towel and a reserve roll of paper towel;

a main roller coupled to the frame and having an axis of rotation;

a transfer tab extending away from the main roller and configured to move relative to the main roller during operation of the roll towel dispenser, the transfer tab configured to grip a portion of one of the primary roll of paper towel and the reserve roll of paper towel during operation of the roll towel dispenser; and a transfer bar pivotably coupled to the frame of the roll towel dispenser and configured to pivot about a lateral axis between a first position and a second position, the transfer bar being disposed nearer to the primary roll of paper towel in the second position than when in the first position;

wherein, in the second position, the transfer tab is configured to place a portion of the reserve roll of paper towel in contact with a portion of the primary roll of paper towel.

12. The roll towel dispenser of claim 11, wherein the transfer tab is further configured to:

grip a portion of the primary roll of paper towel and pull the primary roll of paper towel during operation of the roll towel dispenser; and upon emptying of the primary roll of paper towel, grip a portion of the reserve roll of paper towel and pull the reserve roll of paper towel during operation of the roll towel dispenser.

13. The roll towel dispenser of claim 11, wherein the portion of the primary roll of paper towel slides past the portion of the reserve paper towel during operation of the roll towel dispenser.

14. The roll towel dispenser of claim 11, wherein the transfer tab comprises a plurality of transfer tabs spaced apart from each other along a main roller.

15. The roll towel dispenser of claim 11, further comprising:

a one-way clutch coupled to the main roller;

a motor coupled to the one-way clutch; and a manual actuator coupled to the frame and configured to drive the main roller;

wherein the one-way clutch is configured to transfer torque from the motor to the main roller to drive the main roller, and wherein the one-way clutch permits selective relative movement of the main roller to one of the motor or the manual actuator.

16. The roll towel dispenser of claim 15, further comprising a main roller gear coupled to the one-way clutch, wherein the main roller gear is positioned between the one-way clutch and the motor such that the main roller gear and the one-way clutch are directly coupled to each other.

17. The roll towel dispenser of claim 15, further comprising a battery receptacle integral with the frame and configured to receive a battery that provides power to the motor.

* * * * *